US006803162B2

(12) United States Patent
Niimi

(10) Patent No.: US 6,803,162 B2
(45) Date of Patent: Oct. 12, 2004

(54) ELECTROPHOTOGRAPHIC IMAGE FORMING APPARATUS, PHOTORECEPTOR THEREFOR AND METHOD FOR MANUFACTURING THE PHOTORECEPTOR

(75) Inventor: Tatsuya Niimi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 48 days.

(21) Appl. No.: 10/205,413

(22) Filed: Jul. 26, 2002

(65) Prior Publication Data

US 2003/0190539 A1 Oct. 9, 2003

(30) Foreign Application Priority Data

Jul. 26, 2001 (JP) ..... 2001-226432

(51) Int. Cl.[7] ..... G03G 5/14

(52) U.S. Cl. ..... 430/56; 430/66; 430/127; 399/159; 399/174

(58) Field of Search ..... 430/56, 58.7, 66, 430/127, 69, 133; 399/159, 174

(56) References Cited

U.S. PATENT DOCUMENTS

| | | | | |
|---|---|---|---|---|
| 4,740,441 A | | 4/1988 | Otomura | |
| 4,942,104 A | | 7/1990 | Kitajima et al. | |
| 5,028,502 A | | 7/1991 | Yuh et al. | |
| 5,100,453 A | | 3/1992 | Richards | |
| 5,339,138 A | | 8/1994 | Mishima et al. | |
| 5,411,827 A | | 5/1995 | Tamura et al. | |
| 5,496,671 A | | 3/1996 | Tamura et al. | |
| 5,547,790 A | | 8/1996 | Umeda et al. | |
| 5,578,405 A | | 11/1996 | Ikegami et al. | |
| 5,669,045 A | * | 9/1997 | Swain | 399/159 |
| 5,677,094 A | | 10/1997 | Umeda et al. | |
| 5,682,581 A | * | 10/1997 | Honma et al. | 399/167 |
| 5,702,855 A | | 12/1997 | Ikegami et al. | |
| 5,789,128 A | | 8/1998 | Adachi et al. | |
| 5,804,343 A | | 9/1998 | Umeda et al. | |
| 5,834,145 A | | 11/1998 | Yoshinaga et al. | |
| 5,846,680 A | | 12/1998 | Adachi et al. | |
| 5,853,935 A | | 12/1998 | Suzuki et al. | |
| 5,871,832 A | * | 2/1999 | Finn et al. | 428/98 |
| 5,871,876 A | | 2/1999 | Ikuno et al. | |
| 5,910,561 A | | 6/1999 | Adachi et al. | |
| 5,928,828 A | | 7/1999 | Suzuki | |
| 5,942,363 A | | 8/1999 | Tanaka et al. | |
| 5,999,773 A | | 12/1999 | Yasutomi et al. | |
| 6,026,262 A | | 2/2000 | Kinoshita et al. | |
| 6,030,736 A | | 2/2000 | Ikegami et al. | |
| 6,069,224 A | | 5/2000 | Adachi et al. | |
| 6,087,055 A | | 7/2000 | Niimi | |
| 6,132,911 A | | 10/2000 | Niimi | |
| 6,132,923 A | * | 10/2000 | Maty et al. | 430/129 |
| 6,136,483 A | | 10/2000 | Suzuki et al. | |
| 6,191,249 B1 | | 2/2001 | Tanaka et al. | |
| 6,218,533 B1 | | 4/2001 | Niimi | |
| 6,249,304 B1 | | 6/2001 | Sawayama et al. | |
| 6,319,878 B1 | | 11/2001 | Ina et al. | |
| 6,322,940 B1 | | 11/2001 | Nishigaki et al. | |
| 6,326,112 B1 | | 12/2001 | Tamura et al. | |
| 6,366,751 B1 | | 4/2002 | Shakuto et al. | |
| 6,432,596 B2 | | 8/2002 | Ikuno et al. | |
| 6,444,387 B2 | | 9/2002 | Ri et al. | |

FOREIGN PATENT DOCUMENTS

| | | |
|---|---|---|
| JP | 02-148059 | 6/1990 |
| JP | 04-336556 | 11/1992 |
| JP | 04-360167 | 12/1992 |
| JP | 05-107871 | 4/1993 |
| JP | 05-127496 | 5/1993 |
| JP | 05-273837 | 10/1993 |
| JP | 05-307279 | 11/1993 |
| JP | 06-308807 | 11/1994 |
| JP | 07-121002 | 5/1995 |
| JP | 07-168417 | 7/1995 |
| JP | 08-202126 | 8/1996 |
| JP | 09-171282 | 6/1997 |
| JP | 10-288881 | 10/1998 |
| JP | 11-095523 | 4/1999 |

* cited by examiner

*Primary Examiner*—John L Goodrow
(74) *Attorney, Agent, or Firm*—Oblon, Spivak, McClelland, Maier & Neustadt, P.C.

(57) ABSTRACT

An image forming apparatus including a photoreceptor, wherein the photoreceptor includes an image forming portion having two ends substantially parallel to the rotating direction and a gap forming member located outside of each of the two ends of the image forming portion; a charging roller configured to charge the photoreceptor, wherein the charging roller contacts the gap forming members of the photoreceptor to form a gap g between the surface of the image forming portion and the peripheral surface thereof; an imagewise light irradiator; an image developer; and an image transfer device, wherein the relationship $t \geqq 2g$ is satisfied, where g represents the gap and t represents a distance between an inside edge of one of the gap forming members and nearer one of the two ends of the image forming portion of the photoreceptor.

83 Claims, 28 Drawing Sheets

ELECTROPHOTOGRAPHIC IMAGE FORMING APPARATUS, PHOTORECEPTOR THEREFOR AND METHOD FOR MANUFACTURING THE PHOTORECEPTOR

BACKGROUND OF THE INVENTION

1. Field of the Invention

The present invention relates to an electrophotographic image forming apparatus and a process cartridge for electrophotographic image forming apparatus. In particular, the present invention relates to an electrophotographic image forming apparatus using a proximity charger, and a process cartridge therefor. In addition, the present invention also relates to a photoreceptor for use in the electrophotographic image forming apparatus, and to a method for manufacturing the photoreceptor.

2. Discussion of the Background

Recently the growth of electrophotographic information processing apparatus using a photoreceptor, such as copiers, printers and facsimiles, is remarkable. In particular, photo-printers capable of recording digital information using light have been drastically improving in recording qualities and reliability. This digital recording technique is applied to copiers as well as photo-printers. The copiers to which both the conventional analogue copying technique and this digital technique are applied have various image forming functions. Therefore it is considered that the demand for such copiers increases more and more.

In attempting to reduce the quantity of ozone and NOx generated in an electrophotographic image forming apparatus and the electric power consumption of the image forming apparatus when performing charging, charging methods using a charging roller have been proposed.

For example, Japanese Laid-Open Patent Publication No. (hereinafter referred to as JOP) 4-336556 discloses a contact charging device in which a charging roller charges a photoreceptor while contacting the photoreceptor. In this contact charging device, the surface of the charging roller is made of a dielectric material, and the rotating direction of the charging roller is the same as that of the photoreceptor used (i.e., at the contact point between the charging roller and the photoreceptor, the moving direction of the charging roller is opposite to that of the photoreceptor).

In this case, even when there is a pinhole on the surface of the photoreceptor, a problem in that a non-charged area is not formed on the area around the pin hole does not occur. This is because the surface of the charging roller is dielectric and therefore the charges of an area around the portion of the charging roller, which portion faces the pinhole of the photoreceptor, do not decay when performing charging. In addition, even when the photoreceptor and dielectric charging roller are frictionally charged due to friction between the photoreceptor and the charging roller, which rotates in a direction opposite to the rotating direction of the photoreceptor at the contact point thereof, a surface area of the photoreceptor to be charged can be contacted with a surface area of the charging roller having a relatively low charge potential (i.e., a surface area of the charging roller which is not the surface area having a high potential because of having been just rubbed with the photoreceptor). Thereby, the photoreceptor can be charged to a desired potential even when a relatively low voltage is applied thereto. Since the charging roller charges the photoreceptor while contacting the photoreceptor, the applied voltage is relatively low compared to non-contact chargers such as scorotrons, and therefore the quantity of the above-mentioned reactive gasses to be generated, such as ozone and NOx, can be reduced.

However, the contact charging devices have the following drawbacks:

(1) unevenly charging a photoreceptor (i.e., traces of the charging roller used can be observed in the resultant images) due to uneven contact of the charging roller with the photoreceptor used, etc.;
(2) producing large charging noise;
(3) charging ability deteriorates when toner particles, etc. present on the surface of the photoreceptor adhere on the surface of the charging roller;
(4) photosensitive properties of the photoreceptor change when one or more constituents of the charging roller adhere (migrate) to the photoreceptor; and
(5) the charging roller deforms when the photoreceptor is stopped for a long period of time, resulting in uneven charging.

The uneven charging mentioned above in item (1) is caused by adhesion of the constituents of the charging roller on the photoreceptor when the photoreceptor is stopped because the constituents migrate from the charging roller to the photoreceptor. The large noise mentioned above in item (2) is caused by vibrational contact of the charging roller with the photoreceptor. The vibration of a charging roller is caused when an AC voltage is applied to the charging roller.

In attempting to solve these problems, proximity charging devices have been proposed. In the proximity charging devices, a photoreceptor is charged by applying a voltage to a charger, which faces the photoreceptor while a narrow gap of from 0.005 mm to 0.3 mm is formed between the charger and the photoreceptor.

The proximity charging devices do not cause the problems mentioned above in items (4) and (5) because the charger does not contact the photoreceptor. In addition, with respect to the problem mentioned above in item (3), the proximity charging devices are superior to the contact charging devices because the quantity of toner particles adhered on the charger is less than in the case of the contact charging devices.

Proximity charging has been disclosed in, for example, JOPs 2-148059, 5-127496, 5-273837, 5-307279, 6-308807, 8-202126, 9-171282 and 10-288881.

These publications relate to proximity charging methods and it is described therein that a photoreceptor is experimentally charged with a charger while a gap is formed therebetween to observe whether the photoreceptor is evenly charged. However, there is no specific description in the publications as to how the charger is set closely to the photoreceptor, namely, ideas of constitution of proximity chargers are merely described therein. Actually, it is not easy to form a uniform gap not greater than hundreds of micrometers between a charger and a photoreceptor and stably maintain the gap. Namely, the proximity charging methods have a big problem of how to stably maintain a gap not greater than hundreds of micrometers between a charger and a photoreceptor.

In contrast, specific embodiments of a charger set closely to a photoreceptor are described in JOPs 5-107871, 5-273873, 7-168417 and 11-95523.

JOPs 5-107871 and 5-273873 have proposed a method in which an insulating tape whose ends are fixed by springs or the like and which serves as a gap forming member is set between a charger and a photoreceptor, to form a gap between the charger and the photoreceptor. This method is effective in forming a gap between a photoreceptor and a charger. However, when such a gap forming member is practically set in an image forming apparatus, a tension is applied to the springs in only one direction because the photoreceptor rotates in only one direction. Therefore, the springs are easily fatigued. In addition, when such a member is set in the image forming apparatus, the configuration of the resultant image forming apparatus becomes complex although this member has a simple mechanism. Therefore the maintenance of the image forming apparatus cannot be easily performed. For example, the image forming apparatus has a drawback in that when the gap forming member is changed, the photoreceptor has to be also changed.

JOP 7-168417 discloses a method in which a gap is formed between a photoreceptor and a charging roller by setting spacers on bearings of the charging roller, wherein the spacers contact the surface of the photoreceptor. In this case, the spacers have to be a part which is different from the charging portion of the charging roller in size and material, resulting in complication of the constitution of the charging roller. In addition, in this case the charging roller is made of an insulating material, and therefore a voltage applying roller which applies a voltage to the charging roller is needed, resulting in further complication of the constitution of the charging roller and increase of manufacturing costs of the charger.

JOP 11-95523 discloses a method in which a gap is formed between a charger and a photoreceptor by setting a gap forming member on at least one of the charger and the photoreceptor. This apparatus has a simple constitution, but there is no specific description about the specific constitution of the gap forming member and how to set the gap forming member. Therefore, the gap can be stably maintained (i.e., the photoreceptor can be stably charged) when the charging device is used for a long period of time.

JOP 4-360167 discloses a proximity charging device using a charger, on both ends of which a projected portion is formed to form a gap between the charger and a photoreceptor. By charging the photoreceptor with this charger while contacting the projected portion of the charger with the photoreceptor, proximity charging can be performed. However, there is no description about how to support the gap forming member and the photoreceptor and how to arrange the gap forming member relative to the image forming portion of the photoreceptor. Therefore, it is unknown whether a gap can be stably maintained (i.e., the photoreceptor can be stably charged) when the charging device is used for a long period of time.

In addition, there is no description about the measures against uneven charging around the edge portions of the photoreceptor close to the projected portions. Further there is no description about the measures against accumulation of toner particles on the edge portions of the photoreceptor close to the projected portions when the charger is repeatedly used. Therefore, it is unknown whether this proximity charging device can be stably used for a long period of time. Namely, the reliability of this proximity charging device is unknown in particularly when the charging device is practically used repeatedly.

JOP 7-121002 discloses an image forming apparatus in which a ring-form spacer is set on both ends of a cylindrical photoreceptor to form a gap between the photoreceptor and a charger. Around the photoreceptor, other devices such as an image developer, an image transferer and a cleaner are set while contacting the photoreceptor or being close to the photoreceptor. When such a ring spacer as mentioned above is set on both ends of the photoreceptor, the devices mentioned above cannot be provided on the ring spacer. Therefore the length of the photoreceptor in the axial direction needs to be extended to secure the desired image forming portion on the photoreceptor.

In addition, in this charging method charging near the ring spacers tends to become uneven (i.e., the potential on the edge portions tends to decrease). When such a charging method is used in combination with a nega-posi developing method which is suitable for digital image writing methods because image writing time can be saved, a problem such that background development is observed in these edge portions of the photoreceptor tends to occur.

Further, the spacers themselves and/or the charger tend to be contaminated. Therefore, the edge portions of the photoreceptor near the spacers should be cleaned such that there are no residual toner particles. However, since the spacers are formed on the photoreceptor, the edge portions cannot be cleaned. Accordingly, it is considered that this charging device has poor reliability when practically used repeatedly.

Because of these reasons, a need exists for a proximity charging device which has a simple constitution and in which a uniform gap is formed between the charger and a photoreceptor even when the charging device is repeatedly used.

SUMMARY OF THE INVENTION

Accordingly, an object of the present invention is to provide an electrophotographic image forming apparatus including a simple and low-cost proximity charging device which hardly causes the above-mentioned problems of the contact charging methods and which can be practically used. Specifically, a gap can be stably maintained between a charger and a photoreceptor without forming a toner film on the surface of the charger even when the charging device is repeatedly used.

Another object of the present invention is to provide an electrophotographic image forming apparatus including a proximity charging device which does not cause uneven charging, such as a banding problem specific to proximity charging, even in long repeated use, resulting in formation of good images for a long period of time.

Yet another object of the present invention is to provide a highly durable electrophotographic image forming apparatus and process cartridge, by which images having good image qualities can be stably produced even when repeatedly used without frequently changing the photoreceptor and charger due to abrasion resistance.

A further object of the present invention is to provide a photoreceptor for use in the electrophotographic image forming apparatus and process cartridge mentioned above.

A still further object of the present invention is to provide a method of manufacturing the photoreceptor.

Briefly these objects and other objects of the present invention as hereinafter will become more readily apparent can be attained by an electrophotographic image forming apparatus including at least a photoreceptor which rotates in a direction and which includes a gap forming member on both ends, wherein the photoreceptor includes an image forming portion having two ends substantially parallel to the rotating direction; a charger which is configured to charge the photoreceptor while rotating, wherein a gap is formed between the surface of the image forming portion of the photoreceptor and the periphery surface of the charger by the gap forming member and wherein the gap forming members do not contact the image forming portion of the photoreceptor; a light irradiator configured to irradiate the photoreceptor with light to form an electrostatic latent image in the image forming portion of the photoreceptor; an image developer configured to develop the latent image with a toner to form a toner image thereon; and an image transfer device configured to transfer the toner image onto a receiving material, wherein the following relationship is satisfied:

$$t \geqq 2g$$

where g represents the gap and t represents a distance between the inside edge of one of the gap forming members and one of the two ends of the image forming portion of the photoreceptor, which is closer to the inside edge of the one of the gap forming members.

The gap is preferably from 10 $\mu$m to 200 $\mu$m.

The gap forming members can be formed, for example, by forming a layer (projection) at the edge portions of the photoreceptor; by forming a thicker photosensitive layer at the edge portions of the photoreceptor than the photosensitive layer at the image forming portion thereof; by using a substrate for the photoreceptor, wherein the substrate has a thickness larger than that at the image forming portion thereof; or by providing a flange on the edge portions (i.e., non-image forming portions) of the photoreceptor.

The photoreceptor may be a belt-form photoreceptor which is supported and driven by at least a driving (or driven) roller. In this case, the width of the roller is longer than that of the belt photoreceptor, and the extended portions of the roller has a diameter larger than that of the central portion of the roller to form a gap.

It is preferable that at least one of the charger and the photoreceptor (or the driving or driven roller) is pressed toward the other by a spring, etc.

It is preferable that the rotating shaft of the charging roller is coupled with the rotating shaft of the photoreceptor by a ring member.

In addition, it is preferable that each of the charging roller and the photoreceptor has a respective driving device such as gears, couplings and belts so as to be independently rotated.

In another aspect of the present invention, a process cartridge is provided which includes at least the above-mentioned photoreceptor having a gap forming member on both ends; and the charging roller mentioned above, wherein a gap is formed between the image forming portion of the photoreceptor and the periphery surface of the charger, and wherein the following relationship is satisfied:

$$t \leqq 2g$$

wherein g represents the gap and t represents a distance between the inside edge of one of the gap forming members and one of the two ends of the image forming portion of the photoreceptor, which is closer to the inside edge of the one of the gap forming members.

In yet another aspect of the present invention, a photoreceptor is provided which includes at least an electroconductive substrate and a coating (i.e., a layer or layer) including at least a photosensitive layer located overlying the electroconductive substrate, wherein the thickness of the coating at the edge portions (i.e., the non-image portions) of the photoreceptor is thicker than that at the image forming portion of the photoreceptor. Alternatively, the thickness of the substrate at the edge portions may be greater than that at the image forming portion of the photoreceptor.

The photoreceptor may be provided with a flange on both ends thereof such that the flange covers the non-image portions, wherein the diameter of the flange is greater than that of the photoreceptor at the image forming portion.

It is preferable that the thickness difference of the coating or the substrate or the difference in diameter between the flange and photoreceptor at the image forming portion is preferably from 10 to 200 $\mu$m.

The photosensitive layer preferably includes a charge generation layer and a charge transport layer located on the charge generation layer. The charge transport layer preferably includes a polycarbonate resin having a triarylamine unit in the main chain or side chain thereof.

The coating of the photoreceptor preferably includes a protective layer located overlying the photosensitive layer. The protective layer preferably includes a filler and/or a charge transport material.

In a further aspect of the present invention, a method for preparing the photoreceptor is provided which includes the steps of forming a coating including at least a photosensitive layer on a surface of an electroconductive substrate; and cutting a central portion of the coating, to form a thickness difference between the central portion and the edge portions thereof.

Alternatively, the method may include the steps of providing an electroconductive substrate in which the thickness (or diameter) of the edge portions is larger than that at the central portion, for example, by cutting; and forming a coating including at least a photosensitive layer on the surface of the edge portions and central portion of the surface of the electroconductive substrate.

The coating is preferably formed by a spray coating method.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
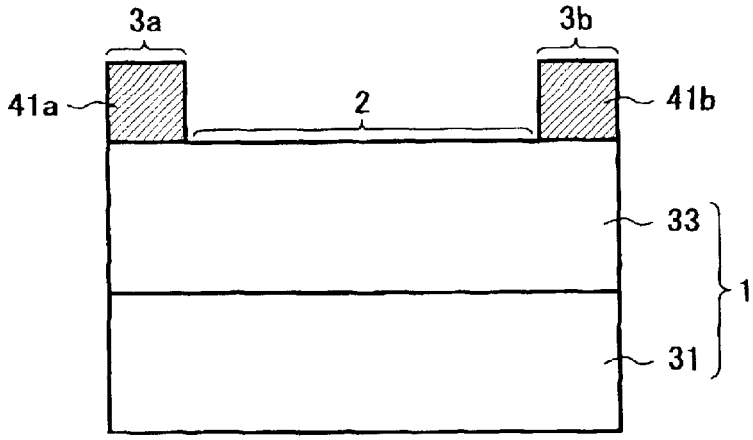
FIGS. 1 to 3 are schematic views illustrating cross-sections of embodiments of the photoreceptor for use in the image forming apparatus of the present invention.

As mentioned above, when contact charging devices are used for electrophotographic image forming apparatus, problems which occur are that a toner film is formed on the charger and a charger deforms, resulting in uneven charging or defective charging. In attempting to solve these problems, proximity charging devices have been proposed. However, there is no proximity charging device which has a low cost and a simple structure and in which a gap is stably formed between the charger and the photoreceptor used and maintained even when used for a long period of time.

As a result of the present inventors' investigation, it is discovered that by providing a gap forming member on both end portions (i.e., non-image portions) of the periphery surface of a photoreceptor and arranging the charging roller such that the charging roller and the image forming portion of the photoreceptor have a specific positional relationship, the above-mentioned problems can be solved. Thus, the present invention is made.

In the present invention, the image forming portion of the photoreceptor is defined as an area of the photoreceptor in which charging, imagewise irradiation, developing and transferring processes are performed. In addition, the ends of the image forming portion are defined as the outermost side edges of the image forming portion. If the outermost side edges are different for the image forming portions of the charging, imagewise light irradiation, developing and transferring processes, the ends of the image forming portion are defined as the most inside edges among the outermost edges. The photoreceptor may be a drum-form photoreceptor or a belt-form photoreceptor supported by a driving and/or driven roller, and the charging, developing, and transferring processes are performed such that the ends of their image forming portions are substantially parallel to the rotating direction of the photoreceptor. In addition, imagewise light irradiation is also performed such that the side ends of the largest optical solid image are substantially parallel to the rotating direction of the photoreceptor. At this point, the term "substantially" means that the end lines are almost parallel to the rotating direction of the photoreceptor although the end lines are zigzagged due to movements of the elements such as developing roller in the direction perpendicular to the rotating direction, low-precision elements of the light irradiator, etc.

The charging roller is arranged such that a gap is formed between the surface of the image forming portion of the photoreceptor and the surface of the charging roller. In this case, as shown in FIGS. 5, 24, 33, 40 and 52, it is necessary that a charge applying portion NC of the charging roller is longer than the width of an image forming portion 2 of a photoreceptor 1.

In addition, the charging roller and the photoreceptor are preferably arranged as shown in FIGS. 5, 24, 33, 40 and 52. Namely, the distance t between an edge PEa (or PEb) of the image forming portion and an inside edge GEa (or GEb) of the gap forming member 41*a*, 43*a*, 233*a*, 237*a*, 239*a*, 333*a*, 337*a*, 339*a*, 580*a* or 52*pa* (41*b*, 43*b*, 233*b*, 237*b*, 239*b*, 333*b*, 337*b*, 339*b*, 580*b* or 52*pb*) is not less than 2 g, wherein g represents the gap.

The reasons why the distance t is preferably not less than 2 g are as follows:

(1) In proximity charging methods, the photoreceptor is charged by discharging through a narrow gap between the charging roller and the photoreceptor. In this case, if charges are vertically showered on the surface of the photoreceptor, the ends PEa and PEb of the image forming portion 2 can be extended to the inside edges GEa and GEb of the gap forming members. However, in reality all charges are not vertically showered, and charges diffuse in various directions at a certain rate. Therefore, the edge portions of the photoreceptor near the gap forming members are charged relatively unevenly (i.e., the charge potential thereof is relatively low) compared to the central portion of the photoreceptor.

When a nega-posi developing method (i.e., a reverse developing method), which is typically used for current electrophotographic digital image forming apparatus, is used, fatal defective images such as black spots and background fouling are produced. In particular, in a system in which half tone images are produced by developing medium potentials formed on the photoreceptor by a multi-value image writing method, these undesired images are remarkably produced.

As a result of the present inventors' investigation, it is discovered that the width of the unevenly charged area depends on the gap between the photoreceptor and the charging roller. When the distance t is varied while keeping the gap constant, undesired images are not observed when the distance t is not less than a certain value. In addition, when this experiment is repeated while changing the gap to determine the relationship between the gap and the width of the unevenly charged area, it is discovered that by arranging the charging roller and the photoreceptor such that the distance t is not less than 2 g, charging can be stably performed, resulting in formation of good images.

(2) The other reason is that the end portions of the photoreceptor and the charging roller can be easily cleaned in this proximity charging device. The proximity charging device as mentioned above have an advantage over the contact charging devices such that the contamination of the surface of the charging roller is less than in the contact charging devices. However, the toner particles remaining on the photoreceptor even after the developing, transferring and cleaning processes tend to stay at the inside edges of the gap forming members when image forming processes are repeatedly performed, resulting in uneven charging and formation of undesired images.

This problem can also be avoided when the distance t is set so as to be not less than 2 g. Thus, the present invention is made.

The distance t also influences on the noise generated when charging is performed. In the charging system mentioned above for use in the present invention, the area between the outside edge (e.g., PEa and PEb) of the image forming portion and the inside edge (e.g., GEa and GEb) of the gap forming member can also be charged. When charging is performed while an DC voltage overlapped with an AC voltage is applied to stabilize charging, the shorter then distance t, the less the charging noise. Therefore, the distance t is preferably not greater than 100 g or 10 mm.

The present invention will be explained referring to five embodiments to be able to be fully understood.

First Embodiment of the Image Forming Apparatus of the Present Invention

The first embodiment of the image forming apparatus of the present invention will be explained referring to drawings. At first, the photoreceptor for use in the first embodiment of the image forming apparatus will be explained.

As mentioned above, a gap forming member is formed on both end portions (i.e., non-image portions) of the photoreceptor. In order to form a gap forming member on the photoreceptor, the following two methods can be used.

The first method is to form a gap forming layer made of an electrically insulating material on both ends of the photoreceptor. The following is an embodiment of the gap forming layer, but the present invention is not limited thereto. Any known photoreceptors can be used regardless of their materials and constitutions if the photoreceptors include such a gap forming layer as mentioned below.

FIG. 1 is a cross section of an embodiment of a photoreceptor 1 for use in the first embodiment of the image forming apparatus of the present invention. In the photoreceptor as shown in FIG. 1, a single-layered type photosensitive layer 33, which includes a charge generation material (hereinafter sometimes referred to as a CGM) and a charge transport material (hereinafter sometimes referred to as a CTM) as main components, is formed on an electroconductive substrate 31. In addition, gap forming layers 41*a* and 41*b* are formed on both ends of the photosensitive layer 33. Numeral 2 denotes an image forming portion.

Figure 2:
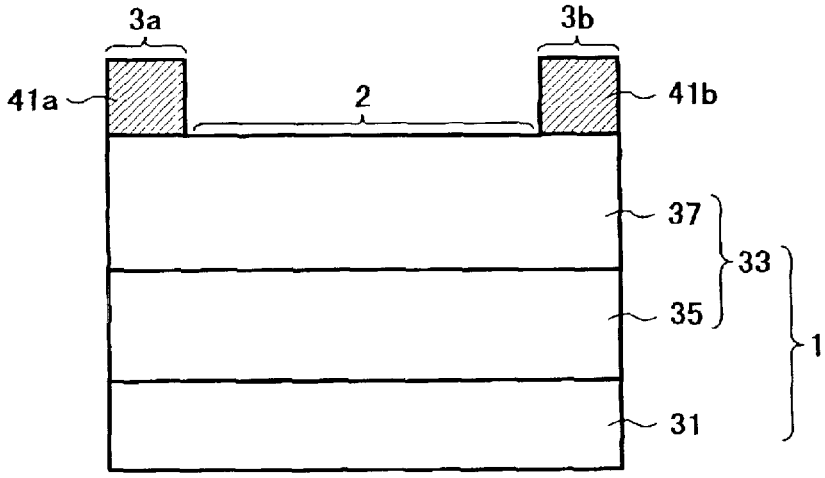

FIG. 2 is a cross section of another embodiment of the photoreceptor for use in the first embodiment of the image forming apparatus. In the photoreceptor as shown in FIG. 2, a charge generation layer 35 (hereinafter sometimes referred to as a CGL) including a CGM as a main component and a charge transport layer 37 (hereinafter sometimes referred to as a CTL) including a CTM as a main component are overlaid on an electroconductive substrate 31 as a layered photosensitive layer 33. The positions of the CGL 35 and CTL 37 maybe reversed. In addition, gap forming layers 41*a* and 41*b* are formed on both ends of the layered photosensitive layer 33.

Figure 3:
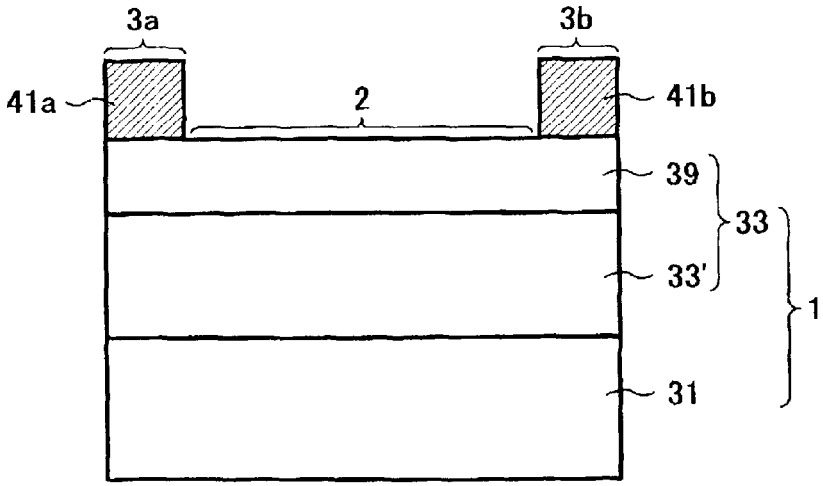

FIG. 3 is a cross section of yet another embodiment of the photoreceptor for use in the first embodiment of the image forming apparatus. In the photoreceptor as shown in FIG. 3, a photosensitive layer 33' is formed on an electroconductive substrate 31. In addition, a protective layer 39 is formed thereon. Further, gap forming layers 41*a* and 41*b* are formed on both ends of the protective layer 39. In this case, the photosensitive layer 33' may be a single-layered type photosensitive layer or a layered photosensitive layer.

Figure 4:
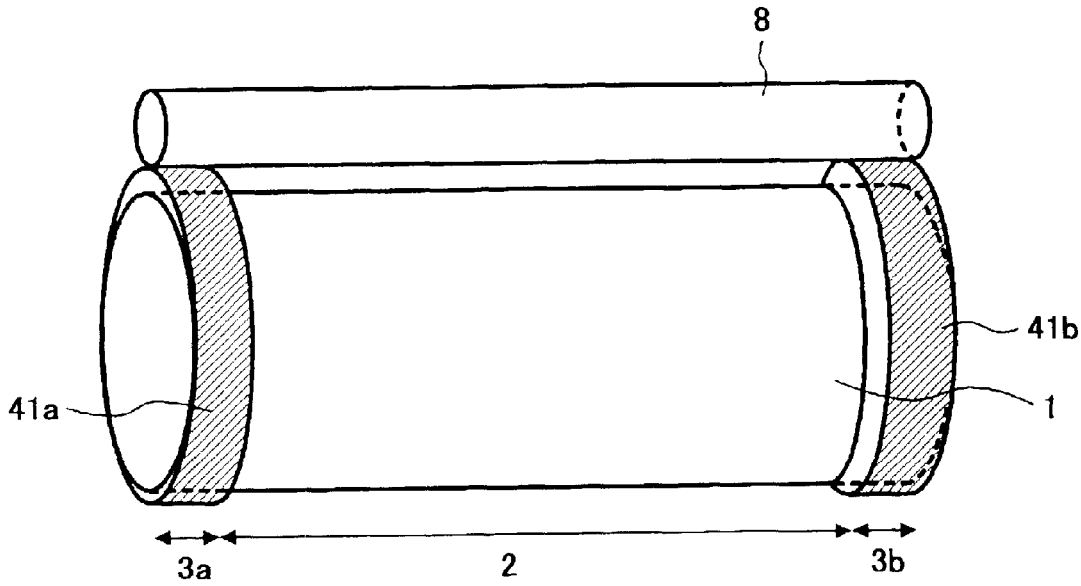
FIG. 4 is a schematic view illustrating an embodiment of the configuration of the charging roller and the photoreceptor in the image forming apparatus of the present invention.

FIG. 4 is a schematic view illustrating an embodiment of the configuration of the photoreceptor 1 and a charger 8 for use in the first embodiment of the image forming apparatus. The gap forming layers 41*a* and 41*b* formed on both ends of the photoreceptor 1 contact the charger 8 to form a gap between the peripheral surface of the charger 8 and the image forming portion 2 of the photoreceptor 1. Numerals 3*a* and 3*b* denote the non-image portion of the photoreceptor 1. Thus, the image forming portion 2 of the photoreceptor 1 can be charged while not contacting the charger 8.

Figure 5:
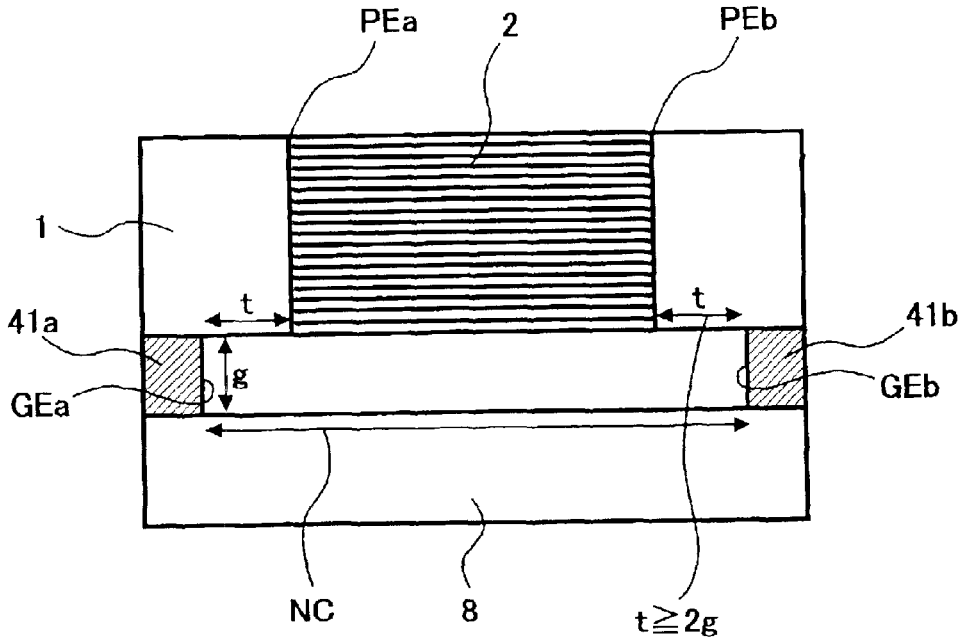
FIG. 5 is a schematic view illustrating the positional relationship between the charging roller and the photoreceptor, which are shown in FIG. 4.

FIG. 5 is a schematic view illustrating the positional relationship between the image forming portion 2 of the photoreceptor 1 and the gap forming members (i.e., the gap forming layers) 41*a* and 41*b* formed on the non-image portions of the photoreceptor 1. In the present invention, this relationship is very important. Namely, it is important that, as shown in FIG. 5, an inside edge GEa (or GEb) of the gap forming member 41*a* (or 41*b*) is located outside an end PEa (or PEb) of the image forming portion 2 of the photoreceptor 1. In addition, a distance t between the inside edge GEa (or GEb) of the gap forming member 41*a* (or 41*b*) and the end PEa (PEb) of the image forming portion 2 is preferably not less than twice a gap g between the photoreceptor 1 and the charger 8. When the distance t is too short, the above-mentioned problems tend to occur. To the contrary, when the distance t is too long, the photoreceptor and charger need to be lengthen, and thereby the image forming apparatus becomes large in size. Therefore, it is preferable that the distance t is not greater than 100 times the gap g or not greater than 10 mm.

Then the second method in which a gap forming material is formed on both ends of the photoreceptor as the gap forming member instead of the gap forming layers mentioned above will be explained in detail. The following is an embodiment of the gap forming material, but the present invention is not limited thereto, and known gap forming materials can be used.

Figure 6:
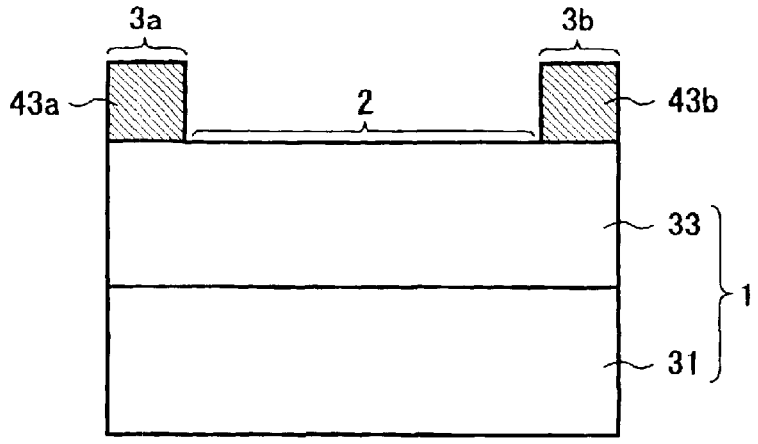
FIGS. 6 to 8 are schematic views illustrating cross-sections of other embodiments of the photoreceptor for use in the image forming apparatus of the present invention.

FIG. 6 is a cross section of another embodiment of the photoreceptor 1 for use in the image forming apparatus.

In the photoreceptor as shown in FIG. 6, a single-layered type photosensitive layer 33, which includes a CGM and a CTM as main components, is formed on an electroconductive substrate 31. In addition, gap forming materials 43*a* and 43*b* are formed on both ends of the photosensitive layer 33.

Figure 7:
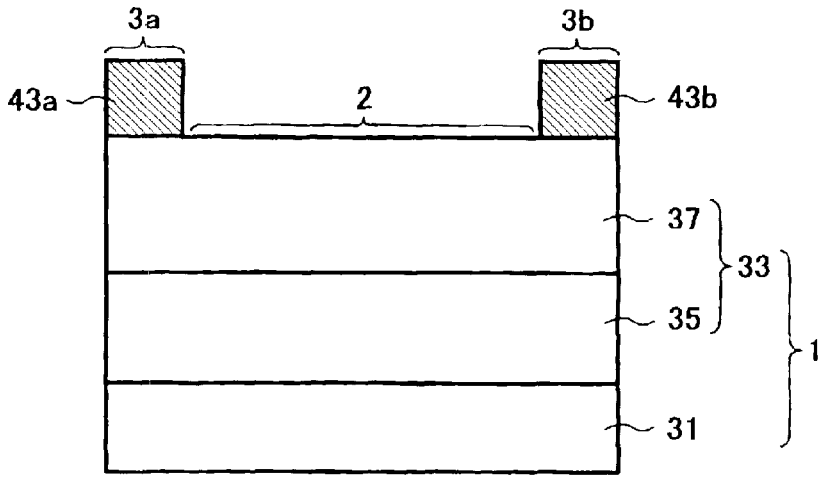

FIG. 7 is a cross section of another embodiment of the photoreceptor 1 for use in the first embodiment of the image forming apparatus. In the photoreceptor as shown in FIG. 7, a CGL 35 including a CGM as a main component and a CTL 37 including a CTM as a main component are overlaid on an electroconductive substrate 31 as a layered photosensitive layer. The positions of the CGL 35 and CTL 37 may be reversed. In addition, gap forming materials 43*a* and 43*b* are formed on both ends of the layered photosensitive layer 33.

Figure 8:
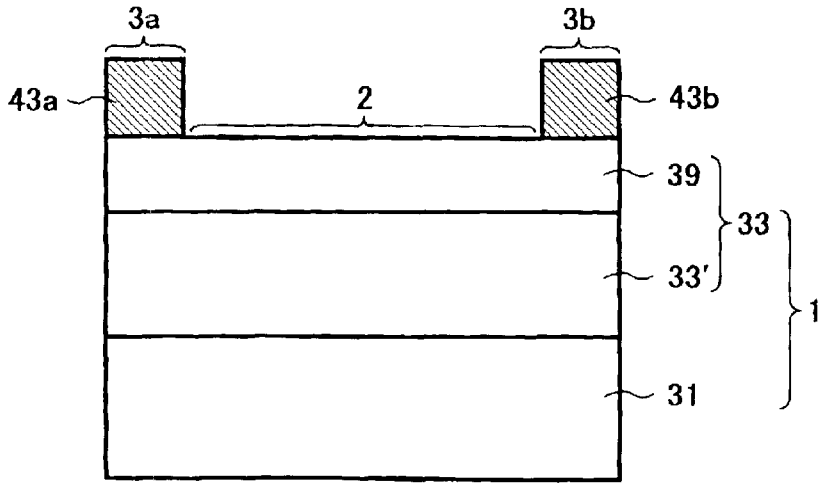

FIG. 8 is a cross section of another embodiment of the photoreceptor 1 for use in the first embodiment of the image forming apparatus. In the photoreceptor as shown in FIG. 8, a photosensitive layer 33' is formed on an electroconductive substrate 31. In addition, a protective layer 39 is formed thereon. Further, gap forming materials 43*a* and 43*b* are formed on both ends of the protective layer 39. In this case, the photosensitive layer 33' may be a single-layered type photosensitive layer or a layered photosensitive layer.

Figure 9:
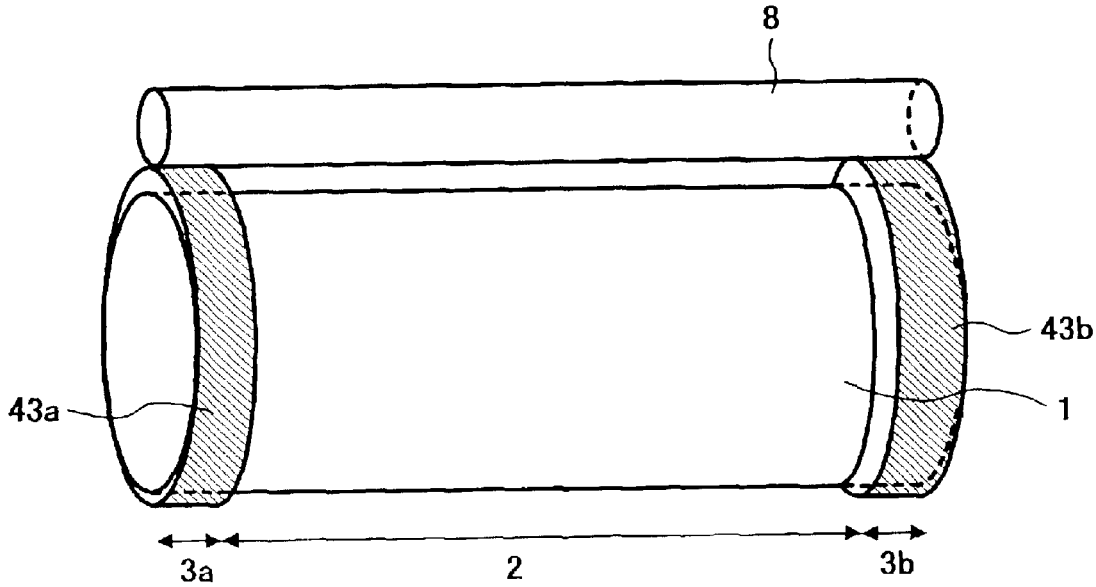
FIG. 9 is a schematic view illustrating another embodiment of the configuration of the charging roller and the photoreceptor in the image forming apparatus of the present invention.

FIG. 9 is a schematic view illustrating an embodiment of the configuration of the photoreceptor 1 and the charger 8 for use in the first embodiment of the image forming apparatus. Only the gap forming materials 43*a* and 43*b* formed on both ends of the photoreceptor 1 contact the charger 8 to form a gap between the peripheral surface of the charger 8 and the image forming portion 2 of the photoreceptor 1. Thus, the image forming portion 2 of the photoreceptor 1 can be charged while not contacting the charger 8.

The gap forming layers 41*a* and 41*b* are made from insulation materials to avoid undesired discharging between the charger and the gap forming layers. In this case, the "insulation materials" mean materials having a resistance not less than $10^{10}$ Ω·cm, i.e., a resistance greater than at least the resistance of the surface of the photoreceptor 1.

In addition, the gap forming layers 41*a* and 41*b* are preferably made from a material having good abrasion resistance because of being rubbed with the charger 8 when image forming operations are repeatedly preformed. Suitable materials for use in the gap forming layers 41*a* and 41*b* include engineering plastics having a good film formability and the like materials. Specific examples of such materials include polyamides, polyurethanes, epoxy resins, polyketones, polycarbonates, silicone resins, acrylic resins, polyvinyl butyrals, polyvinyl formals, polyvinyl ketones, polystyrene, polysulfones, poly-N-vinylcarbazole, polyacrylamide, polyvinyl benzal, polyesters, phenoxy resins, vinyl chloride-vinyl acetate copolymers, polyvinyl acetate, polyphenylene oxide, polyvinyl pyridine, cellulose resins, casein, polyvinyl alcohols, polyvinyl pyrrolidone, etc.

In addition, in order to reduce the friction coefficient of the gap forming layers 41*a* and 41*b*, materials which are prepared by modifying the above-mentioned materials with fluorine or silicon or materials in which a fluorine-containing resin or a silicone resin is dispersed can be preferably used. Further, a filler can be included in the gap forming layers 41*a* and 41*b* to improve the abrasion resistance thereof.

The gap forming layers 41*a* and 41*b* for use in the first embodiment can be formed by various methods. Among the methods, wet coating methods are preferably used because of being simple. The wet coating methods are broadly classified into the following two processes.

One of the methods of forming the gap forming layers 41*a* and 41*b* is to coat a coating liquid on both end portions of a photoreceptor by spray coating or nozzle coating while masking the image forming portion 2. In addition, it is also preferable that the gap forming layers 41*a* and 41*b* can be formed one by one by a dip coating method.

The other of the methods is to coat a coating liquid on the entire surface of a photoreceptor and then cut the central portion of the coated layer to form the image forming portion 2.

Both the methods can be used, however, the wet coating method is preferable in view of ecology.

The thickness of the gap forming layers 41*a* and 41*b* is preferably from 10 to 200 μm, and more preferably from 20 to 100 μm. When the gap forming layers are too thin, there is a possibility that the charger 8 contacts the photoreceptor 1. In addition, the toner remaining on the surface of the photoreceptor 1 tends to adhere to the charger 8. Therefore, it is not preferable. When the gap forming layers are too thick, the voltage applied to the charger 8 has to be increased, resulting in increase of electric power consumption. In addition, the photoreceptor 1 tends to be unevenly charged, and therefore it is not preferable.

The gap forming materials 43*a* and 43*b* are also made from an insulating material to avoid undesired discharging between the charger and the photoreceptor.

The gap forming materials 43*a* and 43*b* are preferably made of an insulating material having a resistance not less than $10^{10}$ Ω·cm. In addition, the insulating material preferably has good abrasion resistance because the gap forming materials 43*a* and 43*b* are rubbed with a charger when image forming operations are preformed. Suitable materials for use in the gap forming materials 43*a* and 43*b* include the engineering plastics having a good film formability and the like materials mentioned above for use in the gap forming layers. A filler can be included in the gap forming materials 43*a* and 43*b* to improve the abrasion resistance thereof. The gap forming materials 43*a* and 43*b* preferably have a form like a tape, a label or a tube.

The gap forming materials 43*a* and 43*b* can be formed by various methods. The methods are broadly classified into the following two methods.

One of the methods of forming the gap forming materials 43*a* and 43*b* is to use a seamless material. This method is preferable when taking into consideration that the charger 8 and the photoreceptor 1 contact at the gap forming materials 43*a* and 43*b*. In order to form a seamless gap forming materials, for example, the following methods can be used:

(1) a heat shrinking tube is set on both ends of the photoreceptor and then the tube is heated so as to be shrunk, resulting in formation of seamless gap forming materials; and (2) a tube is set on each end portion of the photoreceptor such that the tube covers the end portion.

Figure 10A:
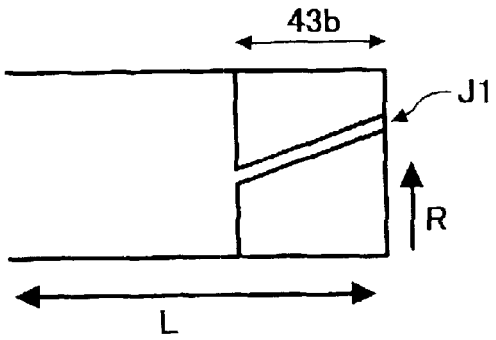
FIGS. 10A and 10B are schematic views illustrating embodiments of a seam of the gap forming member formed on both ends of the photoreceptor.
Figure 10B:
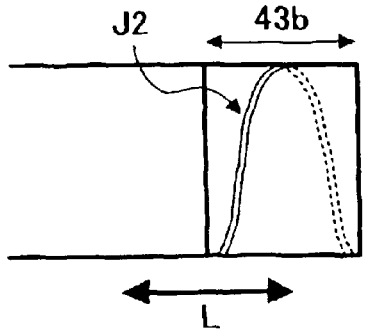

The other method of forming the gap forming materials 43*a* and 43*b* is to use a material having a seam. When using such a material having a seam, the gap has to be stably maintained even when image forming operations are repeatedly performed. In general, tapes and labels are wound around the end portions of the photoreceptor to form the gap forming materials 43*a* and 43*b*. To form a gap forming material having a uniform thickness, the following methods can be used:

(1) the thickness of both end portions of a tape (or label) is decreased such that when the tape is wound around an end portion of the photoreceptor, the overlapped portion of the tape has the same thickness as that of the other portion in which the tape is not overlapped: and (2) both end portions of a tape is slantingly cut such that the seam is slantingly formed as shown in FIGS. 10A and 10B relative to a rotating axis direction R of the photoreceptor.

When a tape is wound as shown in FIGS. 10A and 10B, the ratio of the width of a seam J1 or J2 to the width of the tape in a direction L (i.e., the longitudinal direction of the photoreceptor) is very small, and therefore the gap forming material can be used similarly to a seamless gap forming material. Accordingly this method is preferably used because the gap forming material can be easily prepared and the resultant gap forming material exhibits good performance.

For the same reasons as mentioned above in the case of the gap forming layers, the thickness of the gap forming materials 43*a* and 43*b* is preferably from 10 to 200 μm, and more preferably from 20 to 100 μm.

In the present invention, it is very important to control the gap g between the charger and the photoreceptor. By using the gap forming members (i.e., the gap forming layers or the gap forming materials), the gap g can be controlled so as not to become much narrower than a predetermined value. However, the gap forming members cannot control the gap so as not to become much wider than a predetermined value.

Various methods can be used for controlling the gap so as not to become much wider than a predetermined value.

Figure 11:
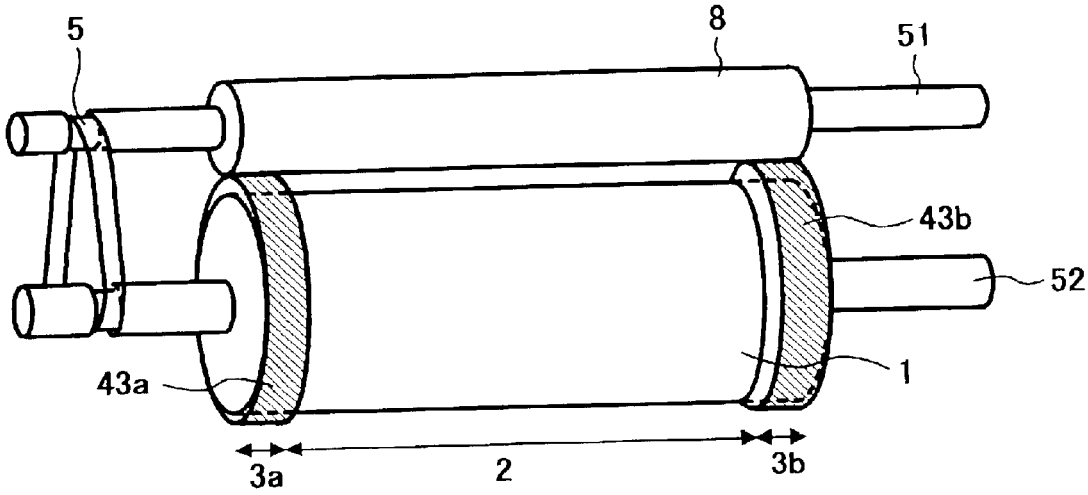
FIGS. 11 and 12 are an elevational view and a side view illustrating an embodiment of the combination of the charging roller and the photoreceptor, which are connected by a ring member.
Figure 12:
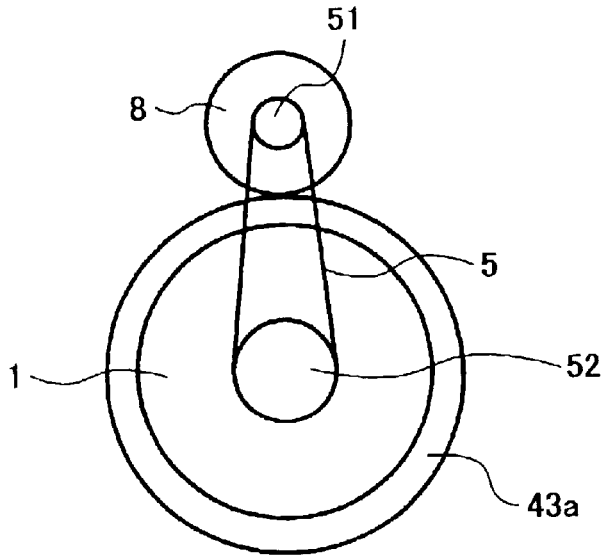

For example, one of the methods is to regulate the distance between the charger and the photoreceptor. Specifically, the method is to fix the charger and the photoreceptor at a state in which they contact each other via the gap forming members. More specifically, the rotating shafts of the charger and the photoreceptor are fixed using a ring member 5 as shown in FIGS. 11 and 12. As can be understood from FIGS. 11 and 12, the gap between the charger 8 and the photoreceptor 1 is controlled by a ring member 5 so as not to become wider than a predetermined value. Suitable materials for use as the ring member 5 include rings having flexibility and belt-form rings. In particular, seamless metal belts and plastic films can be preferably used.

The advantages of using the ring member 5 are as follows:

(1) Designing Flexibility can be Increased when a Photoreceptor and a Charger are Arranged.

In order to control the gap so as not to become much wider than a predetermined value, the charger is generally set at an upper position than the photoreceptor because the gravity of the charger can be utilized. Thus, the configuration of the charger and the photoreceptor is determined for only the designing reason (i.e., the designing flexibility is low). However, when such a ring member 5 is used, the charger 8 can be set at any position. Thus, designing flexibility can be increased, and thereby the image forming apparatus can be miniaturized.

(2) Production of Undesired Images can be Prevented.

When a photoreceptor and a charger are miniaturized in diameter and in addition they are used for fairly high speed recording, the rotation speed thereof becomes very high. In such a case, the gap between the photoreceptor and the charger tends to become wider than a predetermined value, resulting in uneven charging, and thereby an undesired image problem, a so-called "banding phenomenon", in which horizontal stripes are formed in half tone images, is caused. By using the ring member 5, the gap can be severely controlled and therefore the banding phenomenon can be avoided. This method is more effective than the pressing method using a spring mentioned below. A combination of this method and the pressing method using a spring can also be used.

(3) Charging Noises can be Decreased.

When proximity charging or contact charging is performed, a DC voltage overlapped with an AC voltage is typically used. In such a case, the photoreceptor often vibrates sympathetically to the AC voltage, resulting in generation of noises. In this case, a measure in which a stuffed photoreceptor is used to change the vibration frequency of the photoreceptor is typically used. This measure is effective but the photoreceptor has a heavy weight. Therefore, the measure produces adverse effects such that torque of the motor used for driving the photoreceptor needs to be increased and the cost of the photoreceptor increases.

When the gap is controlled using the ring member 5, the charger and the photoreceptor can be arranged while the sympathetic vibration of the photoreceptor is avoided (i.e., generation of charging noises can be avoided). In order to decrease charging noises, this method is more effective than the pressing method using a spring mentioned below. A combination of this method and the pressing method using a spring can also be used.

(4) Influence of Vibration of Driving Members can be Decreased.

In full color image forming apparatus, a tandem type image forming system using plural photoreceptors is typically used to increase the recording speed. Such image forming apparatus have various output modes. For example, the rotating speeds of the photoreceptors are changed depending on whether the priority is given to image qualities or recording speed. In addition, the rotating speeds of the photoreceptors are changed depending on whether full color recording is performed or black and white recording is performed. When black and white recording is performed, there is a case in which only the black image forming unit is operated.

In these cases, the four color image forming units (i.e., four pairs of at least a photoreceptor and a charger) operate randomly and the operation speeds are often changed. In such a case, the photoreceptors are influenced by the vibration of the driving motors and drive-transmitting members, and thereby undesired images tend to be produced. In particular, when gear driving is used to perform precision driving, the influence is very large. In these cases, by using the ring member 5, the gap between the photoreceptor and the charger can be severely controlled, and thereby the influence can be decreased.

Figure 13:
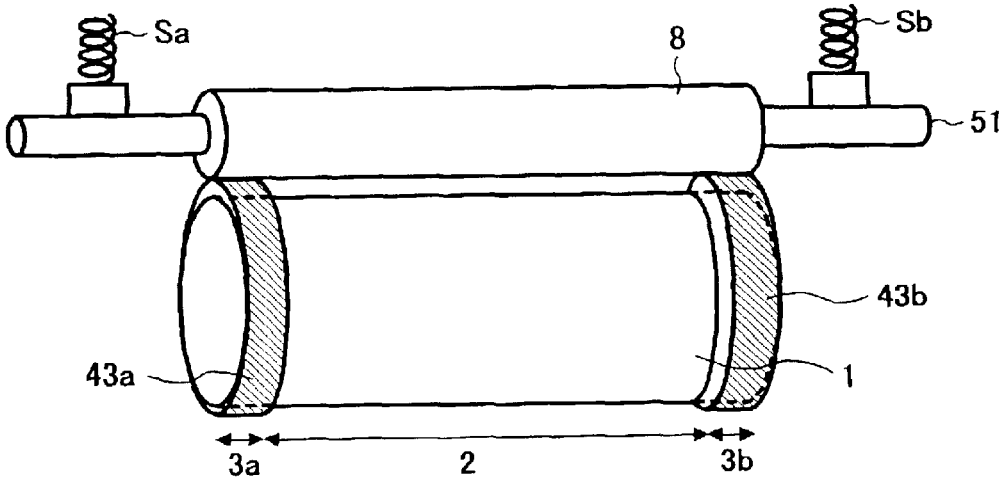
FIGS. 13 and 14 are schematic views illustrating other embodiments of the configuration of the charging roller and the photoreceptor.

Another method for controlling the gap g is a pressing method in which pressure is mechanically applied to the charger using a spring or the like member such that the charger is pressed toward the photoreceptor as shown in FIG. 13. In FIG. 13, springs Sa and Sb contact the rotating shaft 51 of the charger 8 but the springs Sa and Sb may directly press the peripheral surface of the charger 8. In addition, it is possible to press the photoreceptor 1 toward the charger 8. However, when using this method, other members contacting the photoreceptor are influenced, and therefore the former method is preferable.

Figure 14:
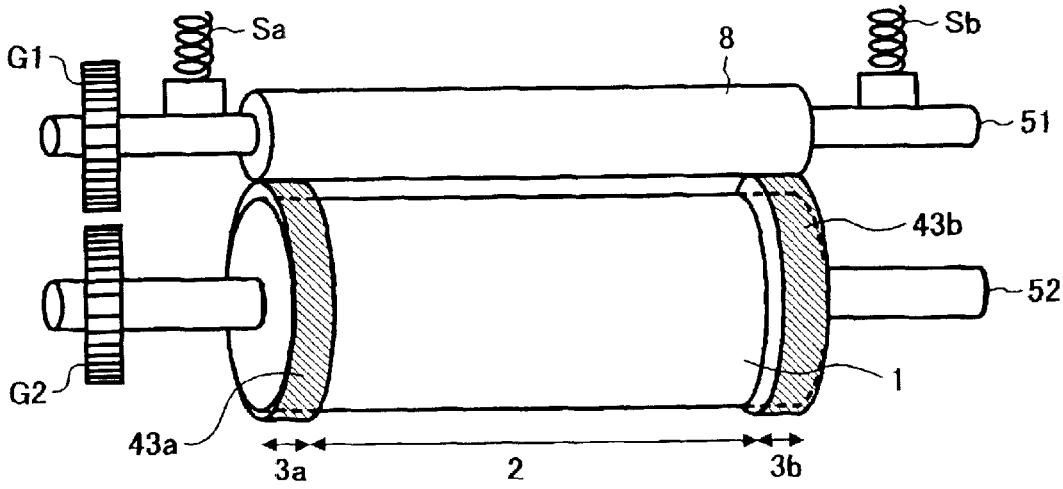

In this method, it is preferable that gears G1 and G2 (or couplings, belts or the like members) are provided on the shafts of the charger 8 and the photoreceptor 1 as shown in FIG. 14, to independently drive the charger and the photoreceptor. It is possible that one member of the photoreceptor and the charger is driven by a driving device and the other is frictionally driven by the member using the friction between the photoreceptor and the charger. However, in this method the contact pressure of the charger with the photoreceptor has to be increased and therefore it is not satisfactory in view of durability.

The rotating speeds of the photoreceptor and the charger can be set independently. However, when taking into consideration of the abrasion of the gap forming members, it is preferable that the charger and the photoreceptor rotate at the same speed.

The advantages of the method using a pressing member such as springs are as follows:

(1) Designing Flexibility can be Increased when a Photoreceptor and a Charger are Arranged.

In order to control the gap so as not to become much wider than a predetermined value, the charger is generally set at an upper position than the photoreceptor because the gravity of the charger can be utilized. Thus, the configuration of the charger and the photoreceptor is determined for only the designing reason. However, when such a pressing member such as springs Sa and Sb is used, the charger 8 can be set at any position. Thus, designing flexibility can be increased, and thereby the image forming apparatus can be miniaturized.

(2) Production of Undesired Images can be Prevented.

When a photoreceptor and a charger are miniaturized in diameter and in addition they are used for fairly high speed recording, the rotation speed thereof becomes very high. In such a case, the gap between the photoreceptor and the charger tends to become wider than a predetermined value, resulting in uneven charging, and thereby an undesired image problem, the so-called "banding phenomenon" is caused. By using the pressing member such as springs Sa and Sb, the gap can be severely controlled and therefore the banding phenomenon can be avoided. In addition, by controlling the weight and elastic coefficient of the springs Sa and Sb used, problems such as production of jitter images due to vibration of the springs can be avoided.

(3) Charging Noises can be Decreased.

When proximity charging or contact charging is performed, a DC voltage overlapped with an AC voltage is typically used. In such a case, the photoreceptor often vibrates sympathetically to the AC voltage, resulting in generation of noises. In this case, a measure in which a stuffed photoreceptor is used to change the vibration frequency of the photoreceptor is typically used. This measure is effective but the photoreceptor has a heavy weight. Therefore, the measure produces adverse effects such that torque of the motor used for driving the photoreceptor needs to be increased and the cost of the photoreceptor increases.

In contrast, in the present invention by applying a pressure to one member of the charger and the photoreceptor using a pressing member such as springs to press the member to the other member while controlling the weight and elastic coefficient of the springs, the charger and the photoreceptor can be arranged without generating sympathetic vibration (i.e., without causing charging noises).

The advantage of independently driving the charger and the photoreceptor while they are synchronized is as follows:

(1) Influences of Load Changes of One Member of a Photoreceptor and a Charger can be Decreased.

In general, one member of the photoreceptor and the charger is driven by a driving motor. The driving force is transmitted to the other member using gears provided to both the members. Thus, the other member is also rotated while driven by the member. However, if the photoreceptor or the charger has load change when repeatedly used, the other member is influenced by the member. When the photoreceptor or the charger are independently driven, such a problem does not occur, i.e., rotation of the photoreceptor or the charger can be accurately performed.

When the diameter of the photoreceptor is an integral multiple of that of the charger or vice versa, both the members can be synchronously driven. In this case, a point of the surface of the photoreceptor always contacts the same point of the surface of the charger when rotating. Therefore a uniform gap can be stably maintained. For example, by marking the side wall of one or both of the photoreceptor and the charger, timing of contact of the members can be visually observed, and therefore it can be possible to control the contact timing.

The advantages of a system in which a photoreceptor and a charger are rotated at the same speed are as follows:

(1) Stress on the Gap Forming Members can be Decreased.

When the photoreceptor has a large capacitance and the rotation speed of the charger is higher than that of the photoreceptor to increase the quantity of the charge applied from the charger to the photoreceptor, the stress on the gap forming member increases, resulting in increase of abrasion of the gap forming member, and thereby a problem occurs such that the gap cannot be stably maintained. When the photoreceptor and the charger are independently rotated and in addition the rotation speed thereof is the same, the durability of the gap forming member can be improved, and thereby the gap can be stably maintained.

(2) Atmospheric Conditions of the Gap can be Stabilized.

When the rotation speeds of the photoreceptor and the charger are different, air tends to flow randomly in the gap in proximity charging. In such a case, charging becomes unstable and thereby undesired images tend to be produced. When the photoreceptor and the charger are rotated at the same speed, airflow can be stabilized, and thereby charging can be stabilized.

In FIGS. 11, 12 and 14, a rotation transmission member is provided on the shaft 52 of the cylindrical photoreceptor land the shaft 51 of the charger 8. Such a rotation transmission member can also be provided on the shafts of a charging roller and a roller supporting a belt-shaped photoreceptor.

The charger for use in the present invention will be explained in detail referring to drawings. In the present invention, known chargers can be used and the following is an embodiment thereof. However, the charger for use in the present invention is not limited thereto.

Figure 15:
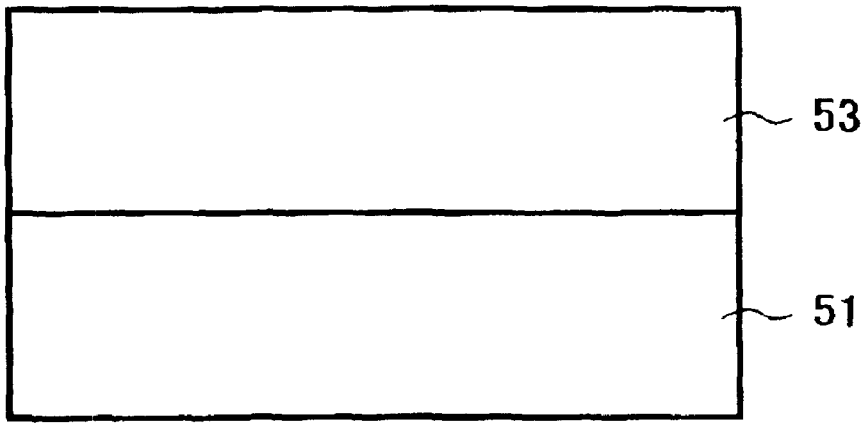
FIGS. 15 and 16 are schematic views illustrating the cross-sections of embodiments of the chargers for use in the image forming apparatus of the present invention.

FIG. 15 is a cross section of an embodiment of the charger for use in the present invention. The charger includes an electroconductive elastic layer 53 formed on a rotating shaft 51 such as metal shafts.

Figure 16:
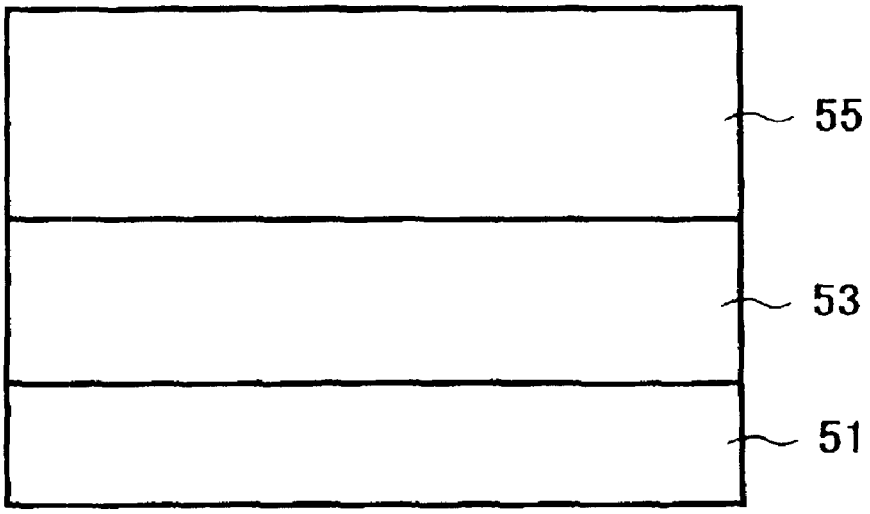

FIG. 16 a cross section of another embodiment of the charger. The charger includes an electroconductive elastic layer 53 is formed on a rotating shaft 51. In addition a resistance controlling layer 55 is formed thereon.

As the rotating shaft 51, metals such as iron, copper, brass and stainless steel, can be preferably used.

As the electroconductive elastic material for uss in the electroconductive elastic layer 53, compositions which include a synthetic rubber and an electroconductive material, such as electroconductive powders and electroconductive fibers (e.g., carbon black, metal powders and carbon fibers), dispersed in the rubber can be preferably used. When the resistance controlling layer 55 is formed as an outermost layer, the resistance of the resistance controlling layer 55 is preferably from $10^3$ to $10^8$ Ω·cm (i.e., the layer is preferably semi-conductive).

When the resistance controlling layer 55 is not formed, the resistance of the electroconductive elastic layer 53 is preferably higher than the above-mentioned resistance and is preferably from $10^4$ to $10^{10}$ Ω·cm.

The layers 53 and 55 constituting the charger are preferably formed uniformly such that the length of the layers is longer than the length of the image forming portion of the photoreceptor (i.e., such that the layers face the non-image portion). Namely, it is preferable that the layers have a length so as to contact the gap forming members. The reason is as follows. When the layers have a length so as not to contact the gap forming members, there is a possibility that the rotating shaft 51 of the charger contacts the photoreceptor 1, resulting in occurrence of electric leakage. When such leakage occurs, the area is developed with a toner, resulting in occurrence of background development.

Suitable materials for use in the resistance controlling layer 55 include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

When such a charger as mentioned above is used for charging a photoreceptor, a DC voltage overlapped with an AC voltage is preferably applied to the charger to avoid uneven charging.

Next, the photoreceptor for use in the first embodiment of the image forming apparatus of the present invention will be explained referring to drawings.

The photoreceptor of the present invention will be explained in detail.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, in which the surface of the tube is treated by cutting, super finishing, polishing and/or the like treatment. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including an electroconductive powder dispersed in a binder resin is coated on one of the supports mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin, which is used in combination with an electroconductive powder, include known thermoplastic resins, thermosetting resins and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, supports, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate 31.

Next, the photosensitive layer of the photoreceptor of the present invention will be explained.

In the present invention, the photosensitive layer may be a single-layered photosensitive layer or a multi-layered photosensitive layer.

At first, the multi-layered photosensitive layer including the CGL 35 and the CTL 37 will be explained.

The CGL 35 includes a CGM as a main component, and optionally a binder resin is also used. In the CGL 35, known inorganic and organic charge generation materials can be used.

Specific examples of the inorganic CGMs include crystal selenium, amorphous selenium, selenium-tellurium compounds, selenium-tellurium-halogen compounds, selenium-arsenic compounds, amorphous silicon, etc. With respect to amorphous silicon, compounds in which the dangling bond is terminated with a hydrogen atom or a halogen atom or in which a boron atom or a phosphorous atom is doped can be preferably used.

Suitable organic CGMs include known organic CGMs. Specific examples of the organic CGMs include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials. These CGMs can be used alone or in combination.

Specific examples of the binder resin, which is optionally used in the CGL 35, include polyamide resins, poly urethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, polyvinyl benzal resins, polyester resins, phenoxy resins, vinyl chloride-vinyl acetate copolymers, polyvinyl acetate resins, polyphenylene oxide resins, polyvinyl pyridine resins, cellulose resins, casein, polyvinyl alcohol resins, polyvinyl pyrrolidone resins, and the like resins.

The addition quantity of the binder resin is from 0 to 500 parts by weight, and preferably from 10 to 300 parts by weight, per 100 parts by weight of the CGM included in the CGL 35.

Suitable methods for forming the CGL 35 include thin film forming methods performed in vacuum, and casting methods using a coating liquid.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. The CGL 35 can be formed by one of these methods using one or more of the above-mentioned inorganic and organic materials.

The casting methods useful for forming the CGL 35 include, for example, the following steps:

(1) preparing a coating liquid by mixing one or more inorganic and organic charge generation materials mentioned above with a solvent such as tetrahydrofuran, cyclohexanone, dioxane, dichloroethane, butanone and the like, optionally together with a binder resin and an additives, and then dispersing the materials with a ball mill, an attritor, a sand mill or the like dispersing machine;

(2) coating on a substrate the coating liquid, which may be diluted as necessary, using a dip coating method, a spray coating method, a bead coating method, a nozzle coating method, a spinner coating method, a ring coating method or the like method; and (3) drying the coated liquid to form a CGL.

The thickness of the CGL 35 is preferably from about 0.01 to about 5 $\mu$m, and more preferably from about 0.1 to about 2 $\mu$m.

The CTL 37 can be formed, for example, by the following method:

(1) a CTM and a binder resin are dispersed or dissolved in a proper solvent to prepare a CTL coating liquid; and (2) the CTL coating liquid is coated on the CGL 35 and dried to form a CTL.

The CTL 37 may include additives such as plasticizers, leveling agents, antioxidants and the like, if desired.

CTMs are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, and benzoquinone.

Specific examples of the positive-hole transport materials include known materials such as poly-N-carbazole and its derivatives, poly-$\gamma$-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines derivatives, diarylamines derivatives, triarylamines derivatives, stilbene derivatives, $\alpha$-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, and enamine derivatives.

These CTMs can be used alone or in combination.

Specific examples of the binder resin for use in the CTL 37 include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, and alkyd resins.

The addition quantity of the CTM in the CTL 37 is preferably from 20 to 300 parts by weight, and more preferably from 40 to 150 parts by weight, per 100 parts by weight of the binder resin included in the CTL 37. The thickness of the CTL 37 is preferably from 5 to 100 $\mu$m.

Suitable solvents for use in the CTL coating liquid include tetrahydrofuran, dioxane, toluene, dichloromethane, monochlorobenzene, dichloroethane, cyclohexanone, methyl ethyl ketone, acetone, etc.

The CTL 37 preferably includes a charge transport polymer, which has both a binder resin function and a charge transport function. A CTL constituted of a charge transport polymer has good abrasion resistance.

Suitable charge transport polymers for use in the CTL 37 include known charge transport polymers. Among these polymers, polycarbonate resins having a triarylamine group in their main chain and/or side chain are preferably used. In particular, charge transport polymers having the following formulae of from (1) to (10) are preferably used:

(1)

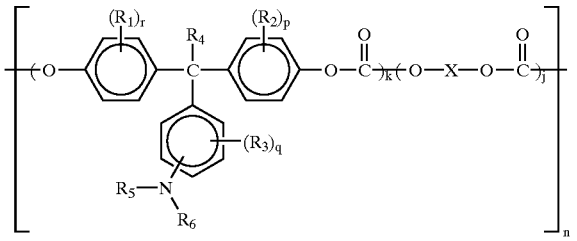

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$ and $R_6$ independently represent a substituted or unsubstituted aryl group; each of r, p and q is independently 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

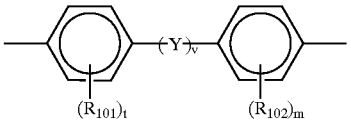

wherein $R_{101}$ and $R_{102}$ independently represent a substituted or unsubstituted alkyl group, a substituted or unsubstituted aryl group, or a halogen atom; each of t and m is independently 0 or an integer of from 1 to 4; v is 0 or 1; and Y represents a linear alkylene group, a branched alkylene group; a cyclic alkylene group, —O—, —S—, —SO—, —$SO_2$—, —CO—, —CO—O-Z-O—CO— (Z represents a divalent aliphatic group), or a group having the following formula:

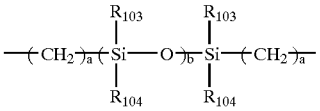

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(2)

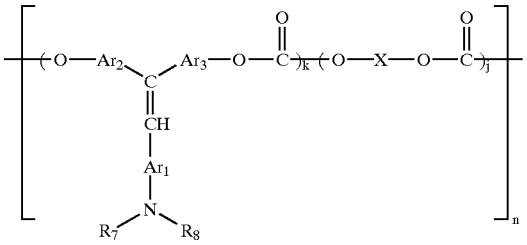

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

(3)

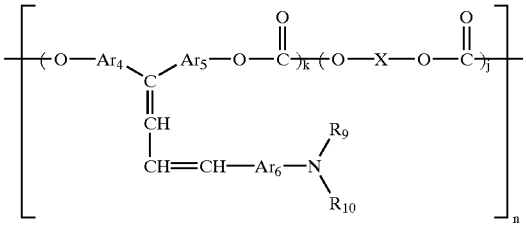

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (1).

(4)

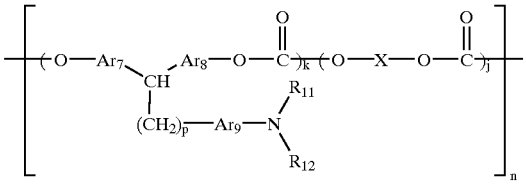

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

(5)

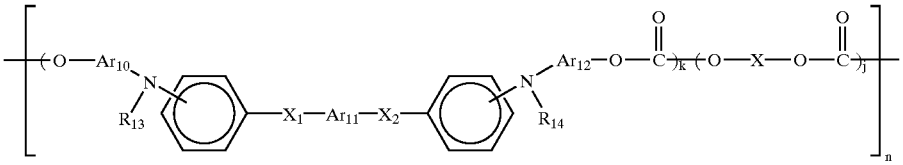

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (1).

(6)

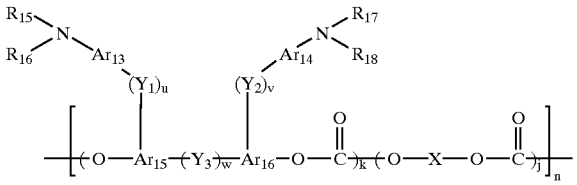

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; each of u, v and w is independently 0 or 1; and X, k, j and n are defined above in formula (1).

(7)

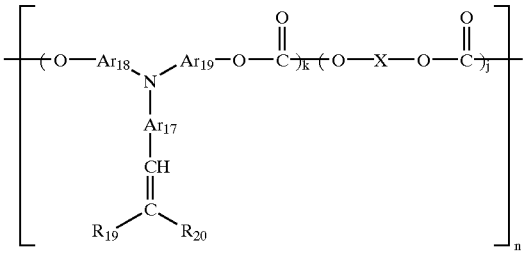

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (1).

(8)

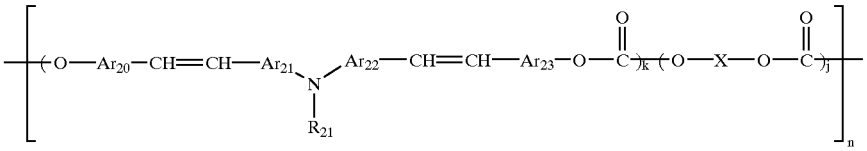

wherein $R_{21}$, represents a substituted or unsubstituted aryl group; $Ar_{20}$, $Ar_{21}$, $Ar_{22}$ and $Ar_{23}$ independently represent an arylene group; and X, k, j and n are defined above in formula (1).

(9)

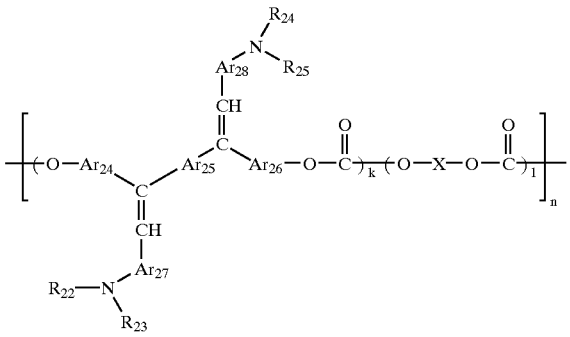

wherein $R_{22}$, $R_{23}$, $R_{24}$ and $R_{25}$ independently represent a substituted or unsubstituted aryl group; $Ar_{24}$, $Ar_25$, $Ar_{26}$, $Ar_{27}$ and $Ar_{28}$ independently represent an arylene group; and X, k, j and n are defined above in formula (1).

(10)

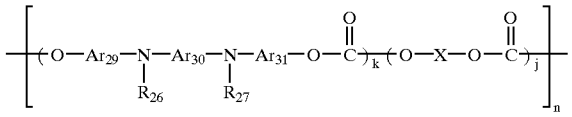

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (1).

The CTL 37 may include an additive such as plasticizers and leveling agents. Specific examples of the plasticizers include known plasticizers, which are used for plasticizing resins, such as dibutyl phthalate and dioctyl phthalate. The addition quantity of the plasticizer is 0 to 30% by weight based on the weight of the binder resin included in the CTL 37.

Specific examples of the leveling agents include silicone oils such as dimethyl silicone oils, methyl phenyl silicone oils, polymers or oligomers including a perfluoroalkyl group in their side chain; and the like materials. The addition quantity of the leveling agents is 0 to 1% by weight based on the weight of the binder resin included in the CTL 37.

Next, the single-layered photosensitive layer will be explained. The photosensitive layer can be formed by coating a coating liquid in which a CGM, a CTM and a binder resin are dissolved or dispersed in a proper solvent, and then drying the coated liquid. In addition, the photosensitive layer may include one or more of the CTMs mentioned above to form a functionally-separated photosensitive layer. The photosensitive layer may include an additive such as plasticizers, leveling agents and antioxidants, if desired.

Suitable binder resins for use in the photosensitive layer include the resins mentioned above for use in the CTL 37. The resins mentioned above for use in the CGL 35 can be added as a binder resin. In addition, the charge transport polymers mentioned above can also be used as a binder resin.

The addition amount of the CGM in the single-layered photosensitive layer is preferably from 5 to 40 parts by weight per 100 parts by weight of the binder resin included in the photosensitive layer. The addition amount of the CTM is preferably from 0 to 190 parts, and more preferably from 50 to 150 parts by weight, per 100 parts by weight of the binder resin included in the photosensitive layer.

The single-layered photosensitive layer can be formed by coating a coating liquid, in which a CGM and a binder and optionally a CTM are dissolved or dispersed in a solvent such as tetrahydrofuran, dioxane, dichloroethane and cyclohexane, using a coating method such as dip coating, spray coating or bead coating. The thickness of the single-layered photosensitive layer is preferably from 5 to 100 um.

In the photoreceptor for use in the present invention, an undercoat layer may be formed between the substrate 31 and the photosensitive layer (e.g., the photosensitive layer 33 in FIGS. 6 and 8, or the CGL 35 in FIG. 7).

The undercoat layer includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network, such as polyurethane resins, melamine resins, alkyd-melamine resins and epoxy resins.

The undercoat layer may include a fine powder of metal oxides such as titanium oxide, silica, alumina, zirconiumoxide, tin oxide and indium oxide to prevent occurrence of moiré in the recorded images and to decrease residual potential of the photoreceptor.

The undercoat layer is typically formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method can also be preferably used as the undercoat layer. Other known undercoat layers can also be used in the present invention.

The thickness of the undercoat layer is preferably 0 to 5 $\mu$m.

As illustrated in FIG. 8, the photoreceptor for use in the present invention optionally includes a protective layer 39 located overlying the photosensitive layer (e.g., the photosensitive layer 33 in FIG. 6, and the CTL 37 in FIG. 7) to protect the photosensitive layer.

Suitable materials for use in the protective layer 39 include ABS resins, ACS resins, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutylene terephthalate resins, polycarbonate resins, polyethersulfone resins, polyethylene resins, polyethylene terephthalate resins, polyimides resins, acrylic resins, polymethylpentene resins, polypropylene resins, polyphenyleneoxide resins, polysulfone resins, polystyrene resins, AS resins, butadiene-styrene copolymers, polyurethane resins, polyvinyl chloride resins, polyvinylidene chloride resins, epoxy resins and the like resins.

In addition, a filler can be included in the protective layer 39 to improve the abrasion resistance of the protective layer 39. Specific examples of the fillers include fluorine-containing resins such as polytetrafluoroethylene, silicone resins, and complex fillers in which an inorganic filler such as titanium oxide, tin oxide, potassium titanate and silica or an organic filler is dispersed in a fluorine-containing resin or a silicone resin.

The protective layer 39 may include a CTM. This is effective in preventing increase of residual potential of the photoreceptor caused by formation of the protective layer. Suitable CTMs include the CTMs mentioned above for use in the CTL 37. It is preferable that a positive hole transport material or an electron transport material is used depending on the charge polarity of the charger used in the image forming apparatus for which the photoreceptor is used, and the layer constitution of the photoreceptor.

In addition, a charge transport polymer can be preferably used in the protective layer 39. A protective layer constituted of a charge transport polymer has good abrasion resistance and hole transportability. As the charge transport polymer, known charge transport polymers can be used. Particularly, the charge transport polymers having one of formulae (1)–(10) mentioned above are preferably used.

The protective layer 39 can be formed by any known coating method. The thickness of the protective layer is preferably from 0.1 to 10 $\mu$m. In addition, a layer of amorphous carbon or amorphous silicon carbide which is formed by a vacuum evaporation method can also be used as the protective layer. The above-mentioned additives such as plasticizers, leveling agents, antioxidants, etc. can also be used in the protective layer.

The advantages of a photoreceptor having good abrasion resistance, for example, by using a charge transport material in the CTL thereof or forming a protective layer as the uppermost layer thereof, are as follows:

(1) The surface of the photoreceptor becomes harder, and therefore a uniform gap can be maintained even after repeated use.

In the proximity charging device mentioned above for use in the present invention, a gap is formed between the surface of the photoreceptor and the charger by bringing the gap forming formed on the non-image portion of the photoreceptor into contact with the charger. In this case, it is preferable that the surface of the edge portion (i.e., a portion outside the image forming portion 2) of the photoreceptor is cleaned as well as the surface of the image forming portion. This is because toner particles tend to remain at the inside edges of the gap forming members for repeated use as mentioned above. If only the image forming portion is cleaned, only the surface of the image forming portion is abraded, resulting in occurrence of a problem in that the gap between the charger 8 and the image forming portion 2 widens.

In this case, when a photoreceptor has good abrasion resistance (for example, a CTL serving as an outermost layer and including a charge transport polymer is used or a protective layer harder than the CTL is formed), the surface of the photoreceptor can resist the stress applied thereto by a cleaning member, and therefore the gap can be maintained more stably even after repeated use. In this case, it is preferable to use a protective layer including a filler and/or a charge transport polymer because the mechanical durability of the resultant photoreceptor can be further improved. When a filler is included in the protective layer, the charge transport ability of the protective layer tends to deteriorate. Therefore it is preferable to add a CTM in such a protective layer to avoid deterioration of the charge transport ability.

As mentioned above, in the proximity charging device which is typically used in the present invention, it is preferable to apply a DC voltage overlapped with an AC voltage to stably perform charging. However, when charging is performed on the surface of the photoreceptor while applying a DC voltage overlapped with an AC voltage, the photoreceptor tends to be damaged and thereby the abrasion amount of the photoreceptor is increased compared with the case in which an AC voltage is not overlapped. Namely, the life of the photoreceptor is undesirably shortened. By imparting good mechanical strength to the photoreceptor as mentioned above, this trade-off problem can be solved.

(2) The mechanical durability of the charger can be enhanced.

As mentioned above, the diameter of the photoreceptor cannot be miniaturized because an adversely effect in which the life of the photoreceptor is shortened (i.e., the mechanical durability of the photoreceptor cannot be improved) is produced. Therefore, the image forming apparatus cannot be miniaturized and in addition the ratio (P/C) in diameter of the photoreceptor (P) to the charger (C) is still large.

As a result of various investigation concerning the material and constitution of chargers to enhance the durability thereof, chargers constituted of an elastic rubber are typically used now. By using the proximity charging device of the present invention, the abrasion and the residual-toner-induced contamination of the charger after repeated use can be dramatically improved. Therefore the abrasion and contamination are no longer factors on which the life of a charger depends.

However, the deterioration of the materials themselves used for chargers due to repeated charging is hardly improved. One of the reasons is that the diameter of the photoreceptor is much larger than that of the charger. For example, the diameters of a photoreceptor and a charger, which are typically used in current image forming apparatus and process cartridges, are about 30 mm and 10 mm, respectively, to miniaturize the image forming apparatus and process cartridge. Currently, in order to effectively perform a maintenance work, a charger and a photoreceptor are typically replaced with new ones at the same time. Therefore, in this case the durability of the charger has to be three times that of the photoreceptor.

When the durability of the photoreceptor can be improved as mentioned above, the diameter of the photoreceptor can be decreased. Therefore, the ratio (P/C) in diameter of the photoreceptor (P) to the charger (C) decreases, namely the stress applied to the charger can be reduced. In other words, in the relationship between the durability of the photoreceptor and the durability of the charger, the durability of the charger can be relatively improved.

Specifically, in the current electrophotographic image forming apparatus, the ratio (P/C) is about 3/1 because various devices cannot be arranged around a photoreceptor when the photoreceptor has a small diameter. Therefore chargers have to have better durability than photoreceptors because it is preferable that a charger and a photoreceptor set in an image forming apparatus are replaced with new ones at the same time. Therefore, to decrease the diameter of a photoreceptor by improving the durability thereof while the diameter of the charger used in combination with the photoreceptor is advantageous for the life of the charger.

In addition, when a photoreceptor electrostatically deteriorates, the voltage applied to the photoreceptor by a charger is typically increased. Therefore the deterioration of the charger is also accelerated. In this case, when the durability of the photoreceptor is improved, the applied voltage is not increased. Therefore improvement of a photoreceptor is advantageous for the life of a charger used in combination with the photoreceptor.

Therefore, it is possible to provide more compact image forming apparatus and process cartridges than ever.

In the proximity charging device for use in the present invention, discharging between the charger and the photoreceptor substantially accords with Paschen's law. Namely, when the rotating photoreceptor and charger approach or separate from each other, discharging occurs therebetween if the distance therebetween is in a certain range. Provided that the area of the charger (or the photoreceptor) in which discharging is performed at a time is referred to as "charging area", the larger the curvature of the charger or the photoreceptor (i.e., the smaller the diameter of the charger or the photoreceptor), the less the charging area.

As a result of the present inventors' investigation, it is found that when the diameter of the charger or the photoreceptor becomes small, the relationship between the applied voltage and the resultant potential of the photoreceptor is not changed although the quantity of generated reaction gasses such as ozone and NOx can be reduced. Namely, it is found that by decreasing the charging area, the quantity of generated reaction gasses can be reduced without deteriorating charging efficiency.

Thus, by improving the abrasion resistance of a photoreceptor, the diameter of the photoreceptor can be decreased, and thereby the quantity of generated reaction gasses can be reduced. When the quantity of generated reaction gasses is reduced, deterioration of the charger and photoreceptor due to such reaction gasses can be decreased, resulting in dramatically increase of the durability of the charger and the photoreceptor.

When the diameter of the photoreceptor is decreased, other members arranged around the photoreceptor have to be taken into consideration. For example, when such a small photoreceptor is used for very high speed image forming system, it is preferably considered whether the developing and transfer processes can be properly performed in the image forming apparatus. Namely, in the developing section and the transfer section a certain developing or transferring area (i.e., a certain nip width) in which the photoreceptor is contacted with the developing roller or transfer roller has to be secured. When the diameter of a photoreceptor becomes too small, a desired nip width cannot be secured in the developing or transferring area. Therefore, the minimum diameter of the photoreceptor is preferably 10 mm, which is almost the same as that of the charger.

According to Paschen's law, the thinner the photosensitive layer, the more easily the photoreceptor can be charged if the composition of the photosensitive layer of a photoreceptor is the same. When a photoreceptor having good abrasion resistance is used, the photosensitive layer can be thinned and therefore the applied voltage can be decreased. Therefore, the stress repeatedly applied to a charger can be reduced, thereby decreasing chemical deterioration of the charger, resulting in improvement of the durability of the charger. In addition, when the voltage applied to a charger is reduced, the quantity of generated reaction gasses such as ozone and NOx can be decreased, resulting in decrease of deterioration of the materials constituting the charger and photoreceptor, and thereby the durability thereof can be further improved.

(3) Image qualities can be improved.

When the abrasion resistance of a photoreceptor is improved, the photosensitive layer can be thinned. Therefore, the moving distance of the photo-carriers generated at the bottom of the photosensitive layer and moving toward the surface of the photosensitive layer can be decreased. Therefore, the possibility of diffusion of the photo-carriers decreases, and thereby an electrostatic latent image faithful to the light image can be formed. Namely, high resolution images can be formed.

In addition, as mentioned above, the quantity of reaction gasses can be reduced, and therefore the quantity of low resistance materials, which are formed on or adsorbed by the surface of a photoreceptor and which cause blurred images, can be reduced. Therefore, the chance that blurred images are formed can be dramatically reduced. Therefore operational limitations to the image forming apparatus concerning environmental conditions can be dramatically reduced. In addition, it is unnecessary to use a drum heater for heating the photoreceptor. Therefore low-cost, compact and resource-saving image forming apparatus (i.e., office-environment-friendly image forming apparatus) can be provided.

In the photoreceptor for use in the image forming apparatus of the present invention, an intermediate layer may be formed between the photosensitive layer and the protective layer. The intermediate layer is mainly constituted of a binder resin. Specific examples of such a binder resin include polyamides, alcohol-soluble nylons, water-soluble polyvinyl butyrals, polyvinyl butyrals, polyvinyl alcohols, etc. The intermediate layer can be formed by any known coating method. The thickness of the intermediate layer is preferably from 0.05 to 2 $\mu$m.

In order to improve the stability to withstand environmental conditions, in particular, to prevent deterioration of photosensitivity and increase of residual potential of the photoreceptor for use in the first embodiment of the image forming apparatus, antioxidants, plasticizers, lubricants, ultraviolet absorbents, low molecular weight charge transport materials and leveling agents may be included in each layer of the photoreceptor.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like compounds.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like compounds.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like compounds.

(d) Organic Sulfur-Containing Compounds dilauryl-3,3'-thiodipropionate, distearyl-3,3'-thiodipropionate, ditetradecyl-3,3'-thiodipropionate, and the like compounds.

(e) Organic phosphorus-containing compounds triphenylphosphine, tri(nonylphenyl)phosphine, tri(dinonylphenyl)phosphine, tricresylphosphine, tri(2,4-dibutylphenoxy)phosphine and the like compounds.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like compounds.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like compounds.

(c) Aromatic Carboxylic Acid Esters trioctyl trimellitate, tri-n-octyl trimellitate, octyl oxybenzoate, and the like compounds.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like compounds.

(e) Fatty Acid Ester Derivatives butyl oleate, glycerin monooleate, methyl acetylricinolate, pentaerythritol esters, dipentaerythritol hexaesters, triacetin, tributyrin, and the like compounds.

(f) Oxyacid Esters methyl acetylricinolate, butyl acetylricinolate, butylphthalylbutyl glycolate, tributyl acetylcitrate, and the like compounds.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like compounds.

(h) Dihydric alcohol esters diethylene glycol dibenzoate, triethylene glycol di-2-ethylbutyrate, and the like compounds.

(i) Chlorine-Containing Compounds chlorinated paraffin, chlorinated diphenyl, methyl esters of chlorinated fatty acids, methyl esters of methoxychlorinated fatty acids, and the like compounds.

(j) Polyester Compounds polypropylene adipate, polypropylene sebacate, acetylated polyesters, and the like compounds.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like compounds.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like compounds.

(m) Other Compounds terphenyl, partially hydrated terphenyl, camphor, 2-nitro diphenyl, dinonyl naphthalene, methyl abietate, and the like compounds.

Suitable lubricants for use in the layers of the photoreceptor include the following compounds but are not limited thereto.

(a) Hydrocarbons liquid paraffins, paraffin waxes, micro waxes, low molecular weight polyethylenes, and the like compounds.

(b) Fatty Acids lauric acid, myristic acid, palmitic acid, stearic acid, arachidic acid, behenic acid, and the like compounds.

(c) Fatty Acid Amides

Stearic acid amide, palmitic acid amide, oleic acid amide, methylenebisstearamide, ethylenebisstearamide, and the like compounds.

(d) Ester Compounds lower alcohol esters of fatty acids, polyhydric alcohol esters of fatty acids, polyglycol esters of fatty acids, and the like compounds.

(e) Alcohols cetyl alcohol, stearyl alcohol, ethylene glycol, polyethylene glycol, polyglycerol, and the like compounds.

(f) Metallic Soaps lead stearate, cadmium stearate, barium stearate, calcium stearate, zinc stearate, magnesium stearate, and the like compounds.

(g) Natural Waxes

Carnauba wax, candelilla wax, beeswax, spermaceti, insect wax, montan wax, and the like compounds.

(h) Other Compounds silicone compounds, fluorine compounds, and the like compounds.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like compounds.

(b) Salicylate Compounds phenyl salicylate, 2,4-di-t-butylphenyl-3,5-di-t-butyl-4-hydroxybenzoate, and the like compounds.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like compounds.

(d) Cyano Acrylate Compounds ethyl-2-cyano-3,3-diphenyl acrylate, methyl-2-carbomethoxy-3-(paramethoxy) acrylate, and the like compounds.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like compounds.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like compounds.

The first embodiment of the image forming apparatus of the present invention will be explained in detail referring to drawings.

Figure 17:
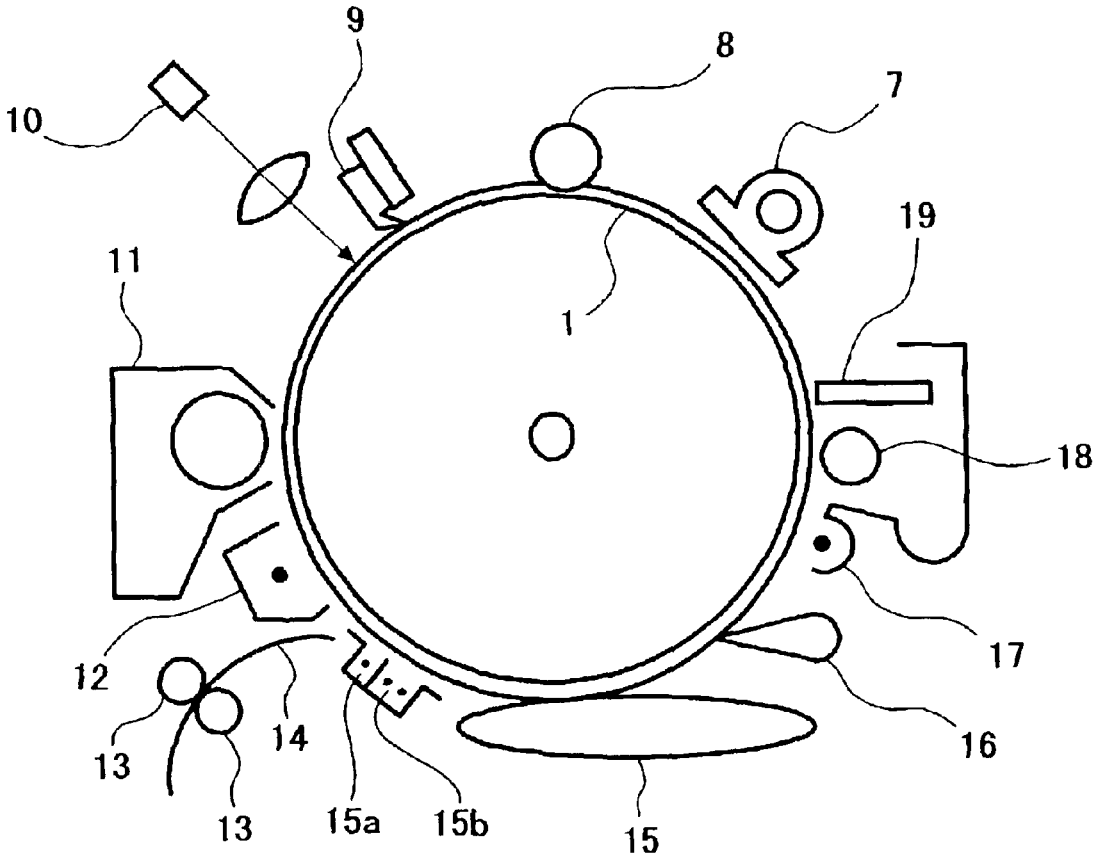
FIGS. 17 and 18 are schematic views illustrating embodiments of the main portion of the image forming apparatus of the present invention.

FIG. 17 is a schematic view for explaining the first embodiment of the image forming apparatus of the present invention. In the image forming apparatus, the charging devices as illustrated in FIGS. 15 and 16 can be used as a charger 8. The charger 8 is located closely to a photoreceptor 1 with gap forming members therebetween.

As illustrated in FIG. 17, a discharger 7, an eraser 9, an imagewise light irradiator 10, and a developing device 11 are arranged while contacting or being set closely to the photoreceptor. In addition, a cleaning unit including a pre-cleaning charger 17, a cleaning brush 18 and a cleaning blade 19 is arranged while the members contacts or are set closely to the photoreceptor 1. The toner images formed on the photoreceptor 1 by the developing device 11 are transferred on a receiving paper 14, which is fed by a pair of registration rollers, at a transfer belt 15. The receiving paper 14 having the toner images is separated from the photoreceptor 1 by a separation pick 16. A pre-transfer charger 12, a transfer charger 15*a*, a separation charger 15*b*, and a pre-cleaning charger 17 maybe arranged around the photoreceptor 1, if desired, and known charging devices such as corotrons, scorotrons, solid state chargers and charging rollers can be used therefor.

When charging the photoreceptor 1, it is preferable that a DC voltage overlapped with an AC voltage is applied to the photoreceptor 1 by the charging roller 8, to uniformly charge the photoreceptor 1.

As illustrated in FIG. 17, the photoreceptor 1 has a drum form, but sheet photoreceptors or endless belt photoreceptors can also be used as mentioned below. On both ends of the photoreceptor 1, a gap forming member is provided.

The above-mentioned chargers can be used for the transfer device. Among the chargers, a combination of the transfer charger and the separation charger, which is illustrated in FIG. 17, is preferably used for the transfer device.

Suitable light sources for use in the imagewise light irradiating device 10 and the discharger (i.e., a discharging lamp) 7 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like filters can be used.

The above-mentioned lamps can be used for not only the processes mentioned above and illustrated in FIG. 17, but also other processes using light irradiation, such as a transfer process including light irradiation, a discharging process, a cleaning process including light irradiation and a pre-exposure process.

When a toner image formed on the photoreceptor 1 by the developing unit 11 is transferred onto the receiving paper 14, all the toner image is not transferred on the receiving paper 14, and residual toner particles remain on the surface of the photoreceptor 1. The residual toner particles are removed from the photoreceptor 1 by the fur blush 18 and the cleaning blade 19. The residual toner particles remaining on the photoreceptor 1 can be removed by only a cleaning brush. Suitable cleaning blushes include known cleaning blushes such as fur blushes and mag-fur blushes.

When the photoreceptor 1 which is previously charged positively (or negatively) is exposed to imagewise light, an electrostatic latent image having a positive or negative charge is formed on the photoreceptor 1. When a latent image having a positive (or negative) charge is developed with a toner having a negative (or positive) charge, a positive image can be obtained. In contrast, when a latent image having a positive (negative) charge is developed with a toner having a positive (negative) charge, a negative image (i.e., a reversal image) can be obtained.

As the developing device 11, known developing devices can be used. In addition, as the discharger 7, known discharging devices can be used.

Figure 18:
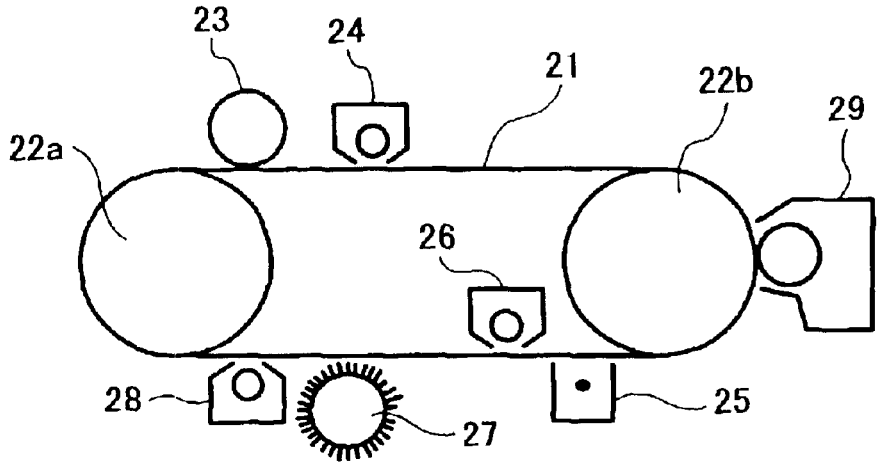

FIG. 18 is a schematic view illustrating another example of the first embodiment of the image forming apparatus of the present invention. A photoreceptor 21 includes at least an electroconductive substrate and a photosensitive layer formed thereon, and a gap forming member is formed on both ends of the photoreceptor 21. The photoreceptor 21 is rotated by driving rollers 22*a* and 22*b*, and is repeatedly subjected to a charging process using a charging roller, an imagewise irradiation process using a light source 24, a developing process using an image developer 29, a transfer process using a transfer charger 25, a pre-cleaning light irradiation process using a discharging light source 26, a cleaning process using a cleaning brush, and a discharging process using a discharging lamp 28. In FIG. 18, imagewise irradiation is performed to the photoreceptor 21 from the substrate side thereof. In this case, the substrate is light transmissive.

The above-mentioned image forming apparatuses are examples of the first embodiment of the image forming apparatus of the present invention. The first image forming apparatus of the present invention is not limited to the image forming apparatuses as shown in FIGS. 17 and 18. For example, although the pre-cleaning light irradiation operation can be performed from the substrate side of the photoreceptor 21 in FIG. 18, the operation may performed from the photosensitive layer side of the photoreceptor 21. In addition, the light irradiation in the imagewise irradiation process and the discharging process may be performed from the substrate side of the photoreceptor 21.

As the light irradiation processes, the imagewise light irradiation process, pre-cleaning light irradiation process, and discharging process are illustrated in FIG. 18. In addition, the photoreceptor 21 may also be subjected to a pre-transfer light irradiation process, which is performed before the transferring of the toner image, and a preliminary light irradiation process, which is performed before the imagewise irradiation process, and other light irradiation processes.

The above-mentioned image forming units may be fixedly set in a copier, a facsimile or a printer. However, the image forming units may be set therein as a process cartridge. The process cartridge is an image forming unit (or device) which includes a photoreceptor, and at least one of a charger, an imagewise light irradiator, an image developer, an image transferer, a cleaner, and a discharger.

Figure 19:
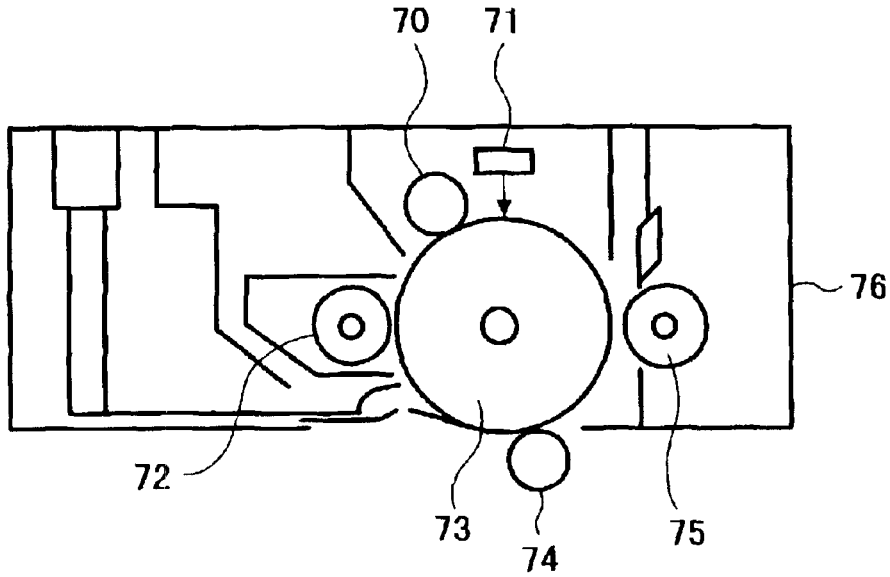
FIG. 19 is a schematic view illustrating an embodiment of the process cartridge of the present invention.

Various types of process cartridges can be used in the present invention. FIG. 19 is a schematic view illustrating an embodiment of the process cartridge of the present invention. In FIG. 19, the process cartridge includes a photoreceptor 73, and a charger 70, an imagewise light irradiator 71, a developing roller 75, a transfer roller 74, and a cleaning brush 72, which are arranged around the photoreceptor 73. Numerals 76 and 77 denote a housing and a discharger. In this case, the photoreceptor 73 serves as the image bearing device. The photoreceptor 73 has at least an electroconductive substrate, a photosensitive layer formed on the electroconductive substrate, and a gap forming member on both ends thereof.

Second Embodiment of the Image Forming Apparatus of the Present Invention

Next, the second embodiment of the image forming apparatus of the present invention will be explained in detail referring to the drawings.

The photoreceptor for use in the second image forming apparatus can be prepared by using materials similar to the materials mentioned above for use in the first image forming apparatus of the present invention. For example, the photoreceptor has a constitution such that a single-layered photosensitive layer is overlaid overlying an electroconductive substrate, a constitution such that a CGL including a CGM as a main component and a CTL including a CTM as a main component are overlaid overlying an electroconductive substrate, or a constitution such that a CGL, a CTL and a protective layer are overlaid overlying an electroconductive substrate. In the second embodiment, the surface portion of the image forming portion of the outermost layer of the photoreceptor is cut to form a gap between the surface of the image forming portion and the charger used. Therefore when the outermost layer is formed, the thickness thereof is preferably made to be greater than the desired thickness because the image forming portion of the outermost layer is cut thereafter.

Cutting of the outermost layer of the thus prepared photoreceptor is performed by a mechanical cutting means except for the non-image portions of the outermost layer. Namely, thickness difference is made between the image forming portion and non-image portions. Specific examples of the cutting means include cutting means using a bite; polishing means using a grinder, an emery paper or the like; surface polishing means using an abrasive; etc.

Figure 20:
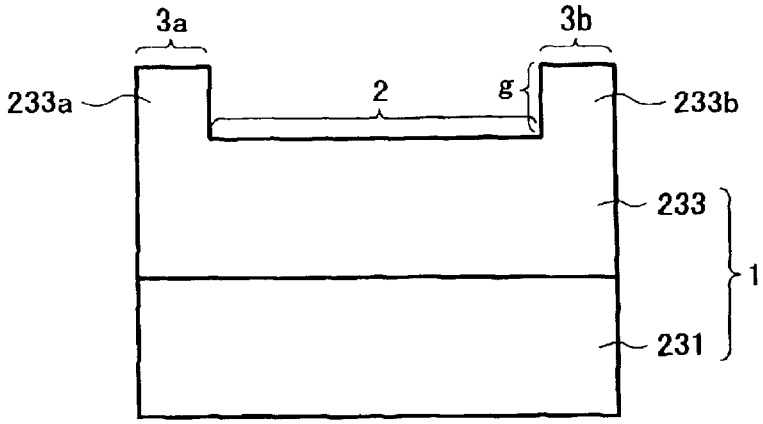
FIGS. 20 to 22 are schematic views illustrating cross-sections of other embodiments of the photoreceptor for use in the image forming apparatus of the present invention.

FIG. 20 illustrates the cross-section of an example of the photoreceptor for use in the second embodiment of the image forming apparatus. In FIG. 20, a single-layered photosensitive layer 233 including a CGM and a CTM as main components is formed on an electroconductive substrate 231. The non-image portions 3*a* and 3*b* of the photosensitive layer 233 are thicker than that of the central portion (i.e., the image forming portion 2) of the photosensitive layer 233 to form gap forming members 233*a* and 233*b*.

Figure 21:
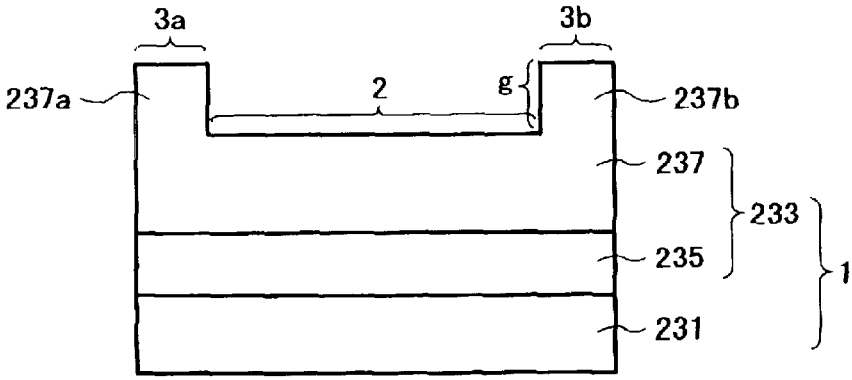

FIG. 21 illustrates the cross-section of another example of the photoreceptor for use in the second embodiment of the image forming apparatus. In FIG. 21, a CGL 235 including a CGM as a main component and a CTL 237 including a CTM as a main component are overlaid on an electroconductive substrate 231.

The location of the CGL 235 and CTL 237 may be reversed. The thickness of non-image portions 3*a* and 3*b* of the CTL 237 (i.e., the outermost layer) are thicker than that of the central portion (i.e., the image forming portion 2) of the CTL 237, to form gap forming members 237*a* and 237*b*.

Figure 22:
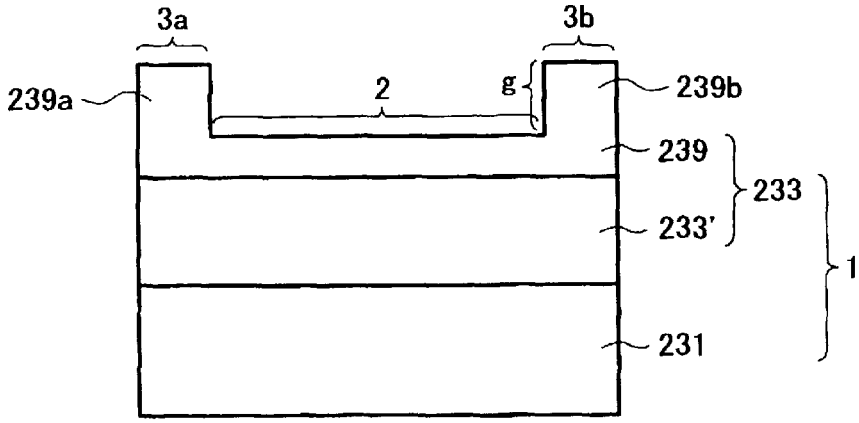

FIG. 22 illustrates the cross-section of yet another example of the photoreceptor for use in the second embodiment of the image forming apparatus. In FIG. 22, a photosensitive layer 233 and a protective layer 239 are overlaid on an electroconductive substrate 231. The photosensitive layer 233 may be a single-layered photosensitive layer or a layered photosensitive layer. The non-image portions 3*a* and 3*b* of the protective layer 239 (i.e., the outermost layer) are thicker than the central portion (i.e., the image forming portion 2) of the protective layer 239 to form gap forming members 239*a* and 239*b*.

Figure 23:
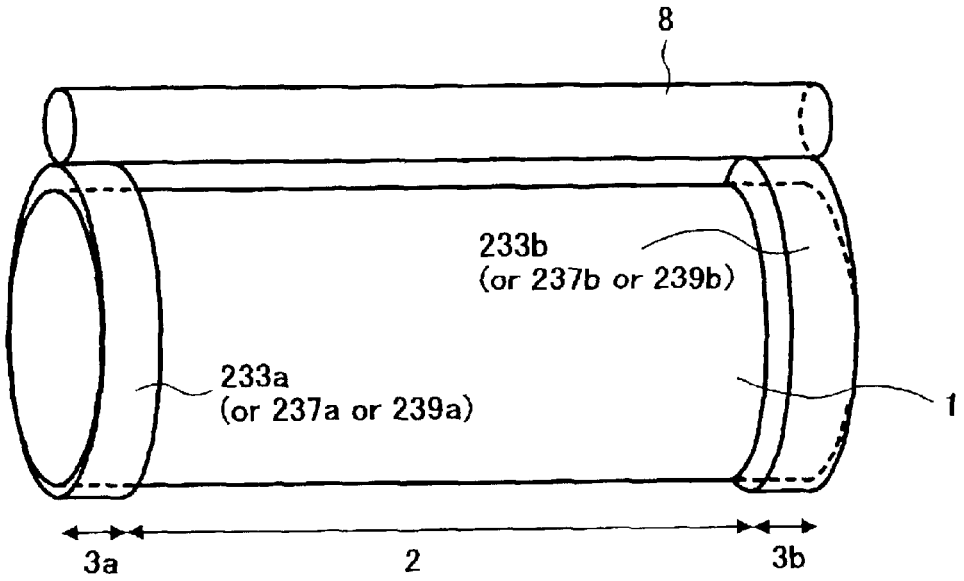
FIG. 23 is a schematic view illustrating another embodiment of the configuration of the charging roller and the photoreceptor in the image forming apparatus of the present invention.

FIG. 23 illustrates the positional relationship between the photoreceptor having the gap forming members and the charger in the second embodiment. As illustrated in FIG. 23, the thickness of non-image portions (233*a* and 233*b*, 237*a* and 237*b*, or 239*a* and 239*b*) of the photoreceptor 1 is thicker than that of the central portion (i.e., the image forming portion 2) of the photoreceptor 1. Therefore the charger contacts only the non-image portions, and a gap is formed between the image forming portion 2 of the photoreceptor and the periphery surface of the charger 8. Thus, proximity charging can be performed on the image forming portion 2 of the photoreceptor.

Figure 24:
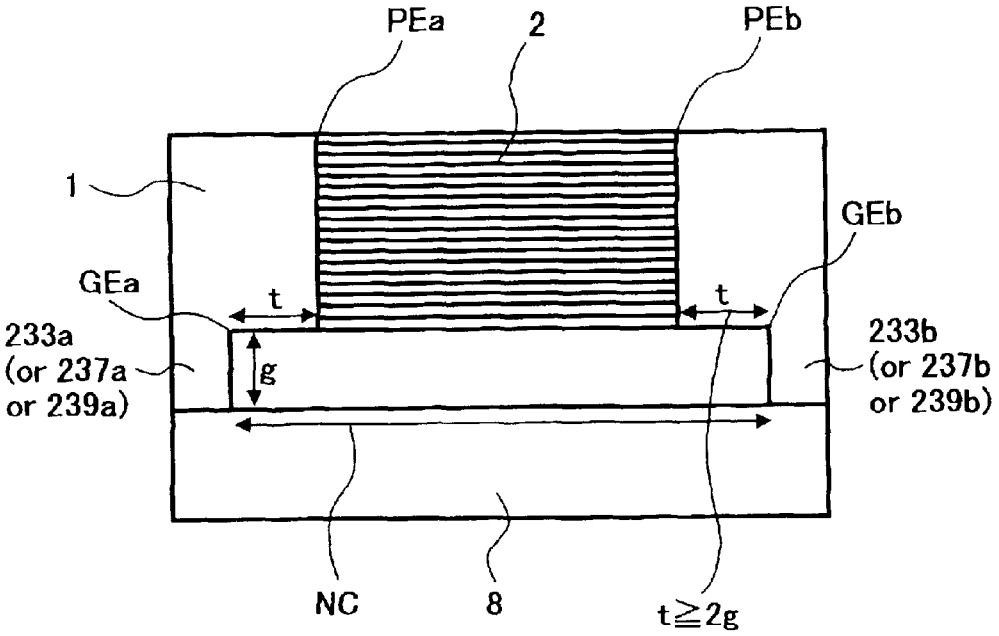
FIG. 24 is a schematic view illustrating the positional relationship between the charging roller and the photoreceptor, which are shown in FIG. 23.

FIG. 24 is a schematic view fully illustrating the positional relationship between the image forming portion 2 of the photoreceptor 1 and the gap forming members formed on the non-image portions of the photoreceptor 1. In the present invention, this relationship is very important. Namely, it is important that, as shown in FIG. 24, an inside edge GEa (or GEb) of the gap forming member 233*a* (or 233*b*) is located outside an end PEa (or PEb) of the image forming portion 2 of the photoreceptor 1. In addition, a distance t between the inside edge GEa (or GEb) of the gap forming member 233*a* (or 233*b*) and the end PEa (PEb) of the image forming portion 2 is preferably not less than twice a gap g between the photoreceptor 1 and the charger 8. When the distance t is too short, the above-mentioned problems tend to occur. To the contrary, when the distance t is too long, the photoreceptor and charger need to be lengthen, and thereby the image forming apparatus becomes large in size. Therefore, it is preferable that the distance t is not greater than 100 times the gap g or not greater than 10 mm.

Figure 25:
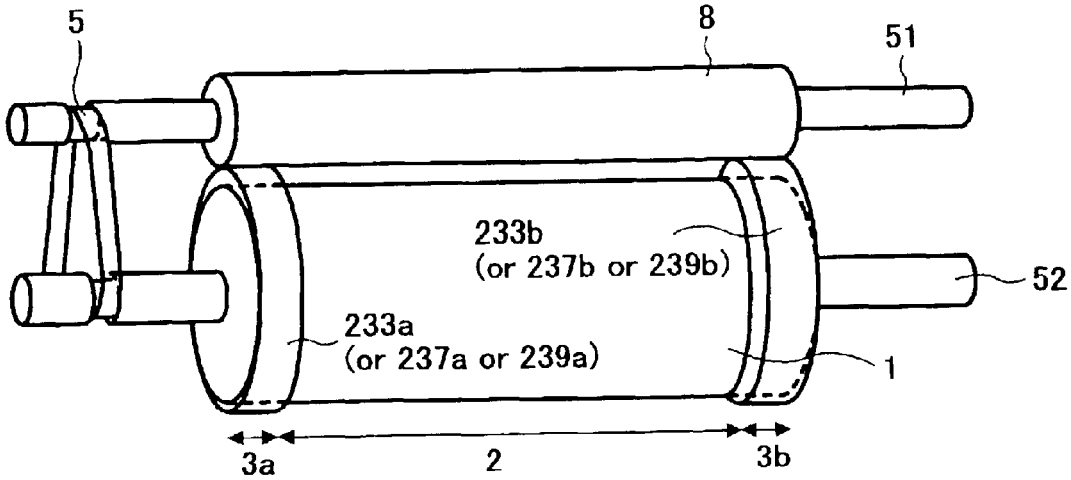
FIGS. 25 and 26 are an elevatoinal view and a side view illustrating another embodiment of the combination of the charging roller and the photoreceptor, which are illustrated in FIG. 23 and which are connected by a ring member.
Figure 26:
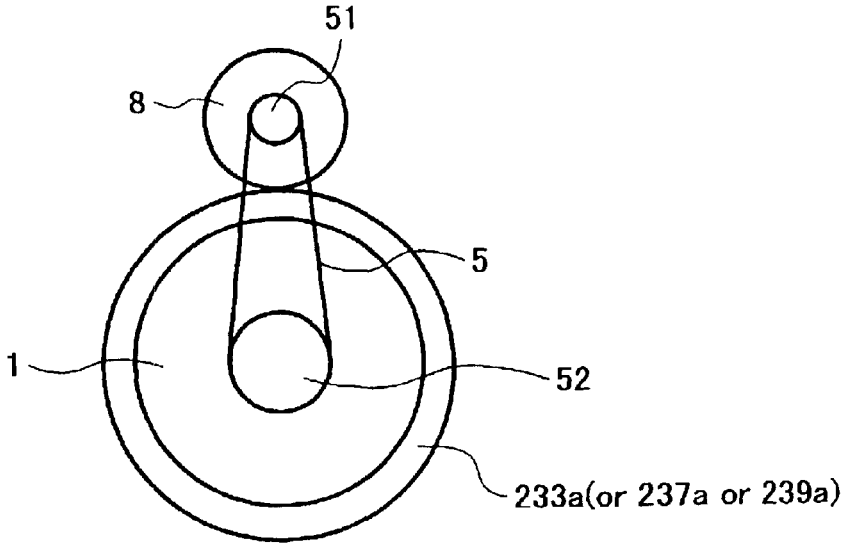
Figure 27:
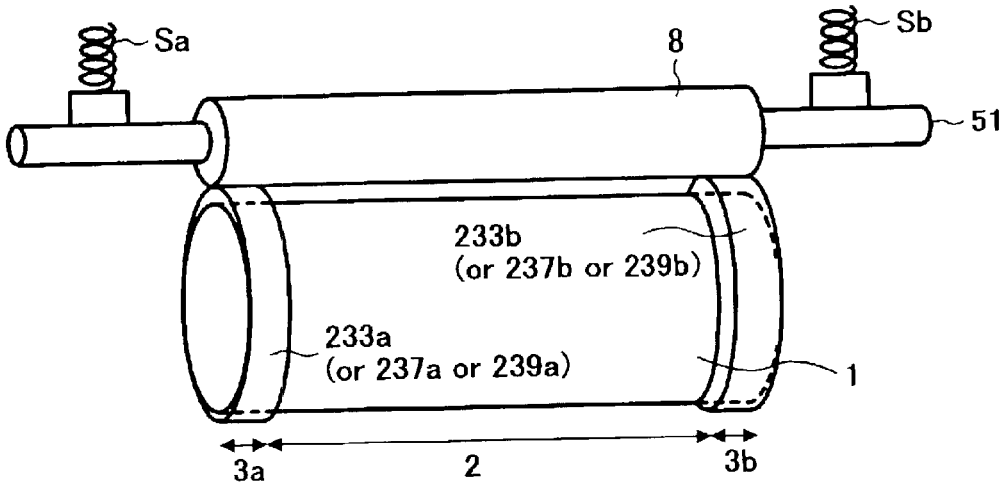
FIGS. 27 and 28 are schematic views illustrating other embodiments of the configuration of the charging roller and the photoreceptor.
Figure 28:
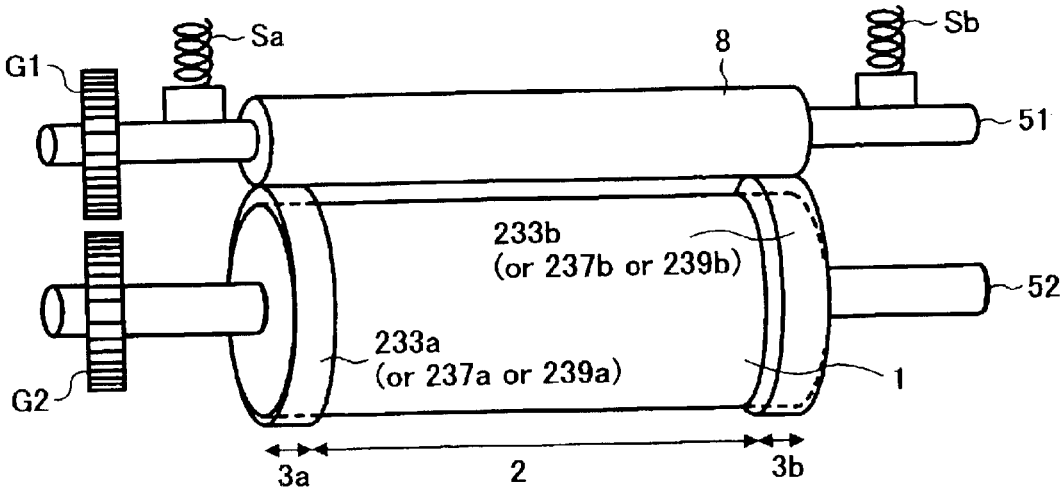

In order that the photoreceptor is not excessively separated from the charger, the charger and the photoreceptor are preferably fixed at a state in which they contact each other via the gap forming members, similarly to the first embodiment. Specifically, the rotating shafts 51 and 52 of a charger 8 and a photoreceptor 1 can be fixed using a ring member 5 as illustrated in FIGS. 25 and 26. In addition, as illustrated in FIG. 27, the charger may be pressed to the photoreceptor 1 using a pressing member such as the springs Sa and Sb. Further, as illustrated in FIG. 28, gears G1 and G2 (or a coupling or a belt) may be provided on the rotating shafts of the charger and photoreceptor, respectively, to independently impart a driving force to each of the charger and photoreceptor.

The chargers for use in the first embodiment can also be used in the second embodiment.

In addition, the image forming methods and apparatuses mentioned above in the first embodiment can also be used in the second embodiment. Similarly to the first embodiment, the image forming units can be used while fixedly set in a copier, a facsimile machine, or a printer, or can be used while set therein as a process cartridge.

Third Embodiment of the Image Forming Apparatus of the Present Invention

Next, the third embodiment of the image forming apparatus of the present invention will be explained in detail referring to drawings.

The photoreceptor for use in the third image forming apparatus can be prepared by using materials and methods similar to the materials and methods mentioned above for use in the first image forming apparatus of the present invention. For example, the photoreceptor has a constitution such that a single-layered photosensitive layer is formed overlying an electroconductive substrate, a constitution such that a CGL including a CGM as a main component and a CTL including a CTM as a main component are overlaid overlying an electroconductive substrate, or a constitution such that a CGL, a CTL and a protective layer are overlaid overlying an electroconductive substrate.

In the third embodiment, the surface of the substrate corresponding to the image forming portion of the photoreceptor is cut to form a gap between the surface of the image forming portion and the peripheral surface of the charger used in the third embodiment. Therefore when the substrate is prepared, the thickness (or diameter) thereof is preferably made to be greater than the desired thickness because the portion of the substrate corresponding to the image forming portion is cut thereafter as mentioned below.

Figure 29:
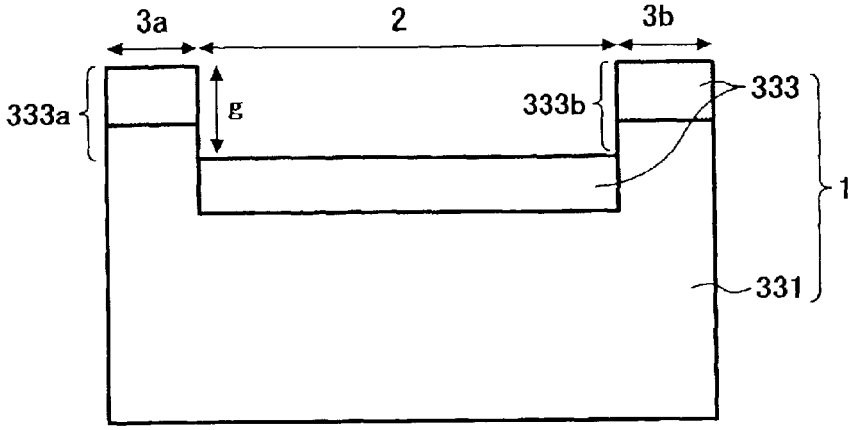
FIGS. 29 to 31 are schematic views illustrating cross-sections of other embodiments of the photoreceptor for use in the image forming apparatus of the present invention.

FIG. 29 illustrates the cross-section of an example of the photoreceptor for use in the third embodiment of the image forming apparatus. In FIG. 29, a single-layered photosensitive layer 333 including a CGM and a CTM as main components is formed on an electroconductive substrate 331 in which the central portion corresponding to the image forming portion is recessed. Since the substrate at both ends thereof is thicker than the central portion of the substrate, non-image portions 3*a* and 3*b* of the photoreceptor 1 are thicker than the central portion (i.e., the image forming portion 2) of the photoreceptor 1. Thus gap forming members 333*a* and 333*b* are formed.

Figure 30:
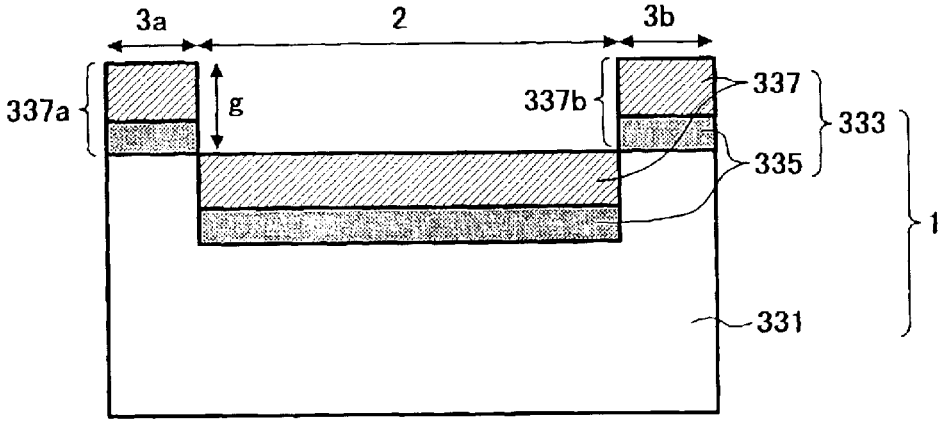

FIG. 30 illustrates the cross-section of another example of the photoreceptor for use in the third embodiment of the image forming apparatus. In FIG. 30, a CGL 335 including a CGM as a main component and a CTL 337 including a CTM as a main component are overlaid on an electroconductive substrate 331 in which the central portion corresponding to the image forming portion is recessed. The location of the CGL 335 and CTL 337 may be reversed. Similarly to the photoreceptor illustrated in FIG. 29, non-image portions 3*a* and 3*b* of the photoreceptor 1 are thicker than the central portion (i.e., the image forming portion 2) of the photoreceptor 1 to form gap forming members 337*a* and 337*b*.

Figure 31:
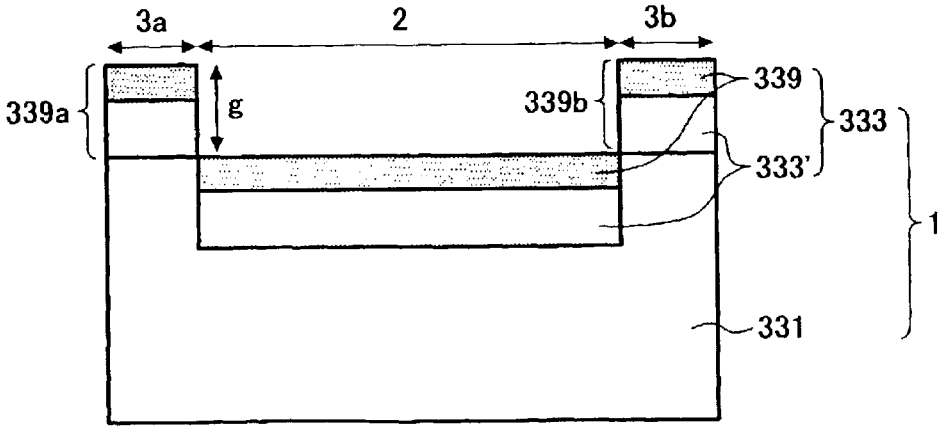

FIG. 31 illustrates the cross-section of yet another example of the photoreceptor for use in the third embodiment of the image forming apparatus. In FIG. 31, a photosensitive layer 333 and a protective layer 339 are overlaid on an electroconductive substrate 331 in which the central portion corresponding to the image forming portion is recessed. The photosensitive layer 333 may be a single-layered photosensitive layer or a layered photosensitive layer. Similarly to the photoreceptors illustrated in FIGS. 29 and 30, non-image portions of the photoreceptor 1 is thicker than the central portion (i.e., the image forming portion 2) of the photoreceptor 1 to form gap forming members 339*a* and 339*b*.

Figure 32:
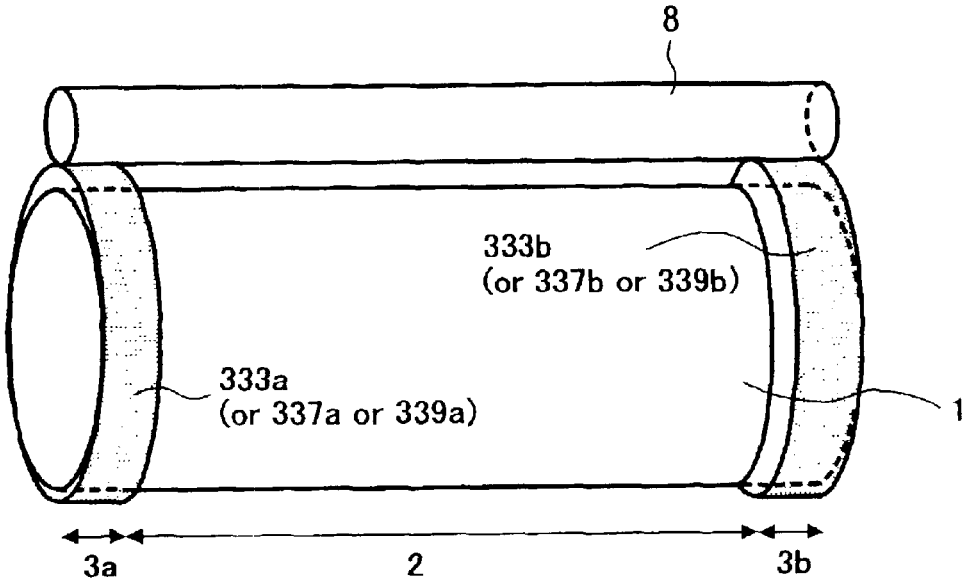
FIG. 32 is a schematic view illustrating another embodiment of the configuration of the charging roller and the photoreceptor in the image forming apparatus of the present invention.

FIG. 32 illustrates the positional relationship between the photoreceptor having the gap forming members and the charger in the third embodiment. As illustrated in FIG. 32, the thickness of non-image portions 3*a* and 3*b* of the photoreceptor 1 is thicker than that of the central portion (i.e., the image forming portion 2) of the photoreceptor 1. Therefore the charger contacts only the non-image portions, and a gap is formed between the image forming portion 2 of the photoreceptor 1 and the periphery surface of the charger 8. Thus, proximity charging can be performed on the image forming portion 2 of the photoreceptor.

In the photoreceptor for use in the third embodiment, the central portion of electroconductive substrate 331 corresponding to the image forming portion is recessed to form a gap between the peripheral surface of the charger used and the image forming portion of the photoreceptor. The width of the recessed portion of the substrate may be slightly longer than the width of the image forming portion. However, in such a case, it is preferable to take a measure to prevent the developing unit from contacting the non-image portion of the photoreceptor.

Figure 33:
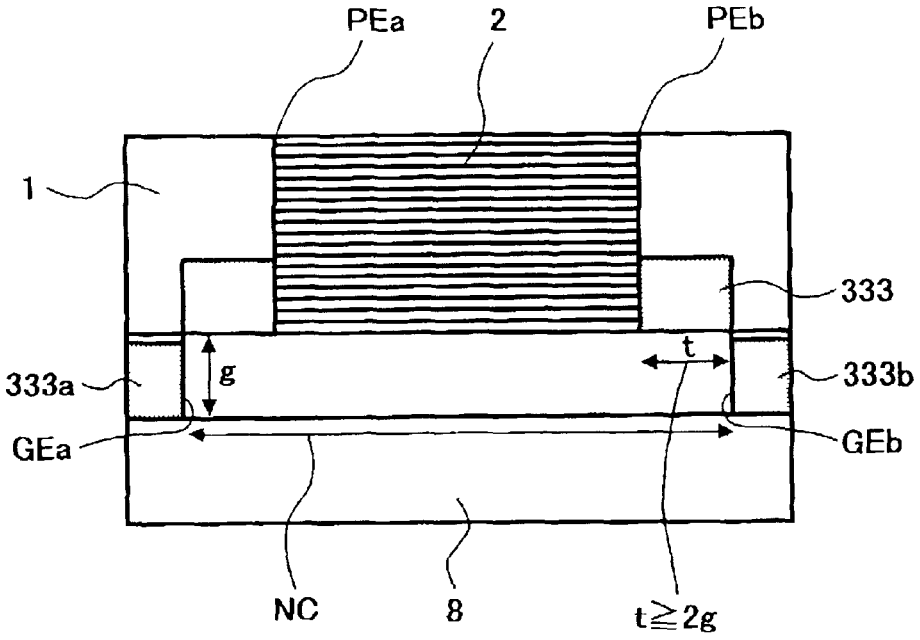
FIG. 33 is a schematic view illustrating the positional relationship between the charging roller and the photoreceptor, which are shown in FIG. 32.

FIG. 33 is a schematic view illustrating the positional relationship between the image forming portion 2 of the photoreceptor 1 and the gap forming members formed on the non-image portions of the photoreceptor 1. In the present invention, this relationship is very important. Namely, it is important that, as shown in FIG. 33, an inside edge GEa (or GEb) of the gap forming member 333*a* (or 333*b*) is located outside an end PEa (or PEb) of the image forming portion 2 of the photoreceptor 1. In addition, a distance t between the inside edge GEa (or GEb) of the gap forming member 333*a* (or 333*b*) and the end PEa (PEb) of the image forming portion 2 is preferably not less than twice a gap g between the photoreceptor 1 and the charger 8. When the distance t is too short, the above-mentioned problems tend to occur. To the contrary, when the distance t is too long, the photoreceptor and charger need to be lengthen, and thereby the image forming apparatus becomes large in size. Therefore, it is preferable that the distance t is not greater than 100 times the gap g or not greater than 10 mm.

Figure 34:
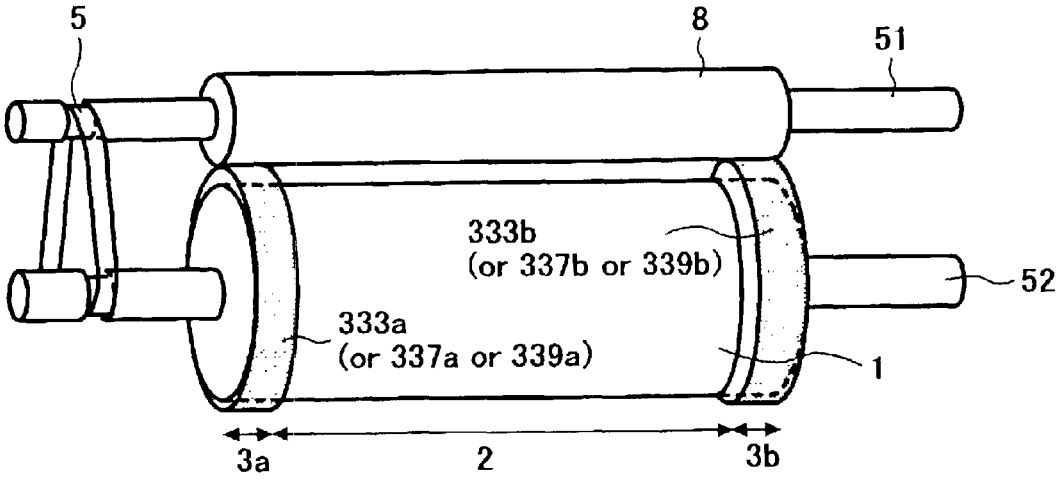
FIGS. 34 and 35 are an elevational view and a side view illustrating another embodiment of the combination of the charging roller and the photoreceptor, which are connected by a ring member.
Figure 35:
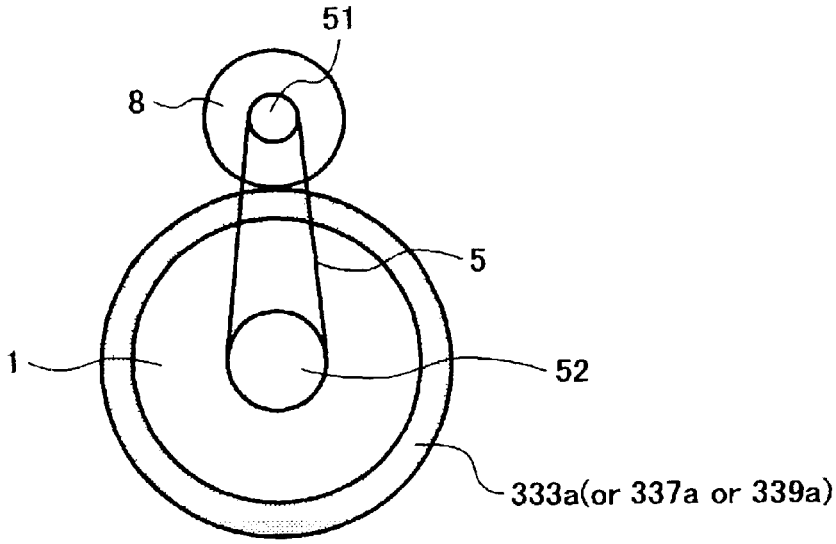
Figure 36:
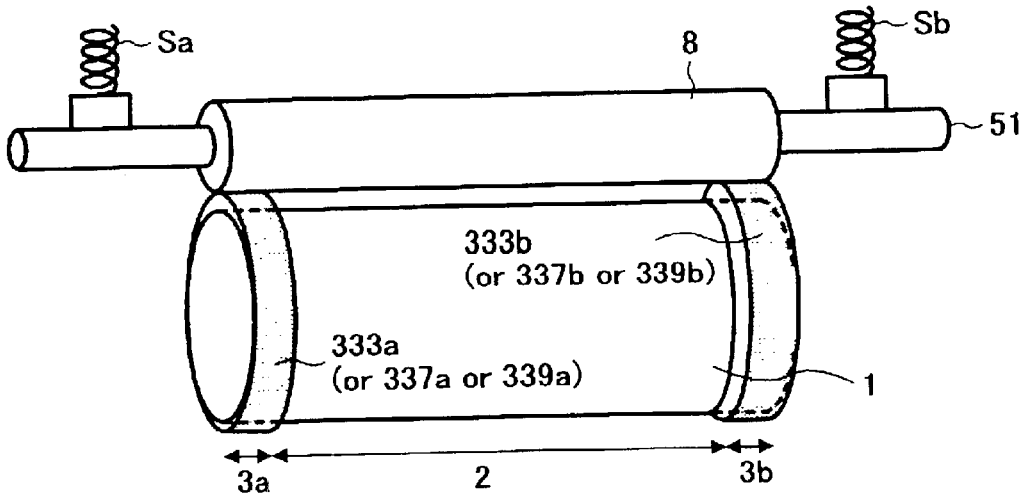
FIGS. 36 and 37 are schematic views illustrating other embodiments of the configuration of the charging roller and the photoreceptor.
Figure 37:
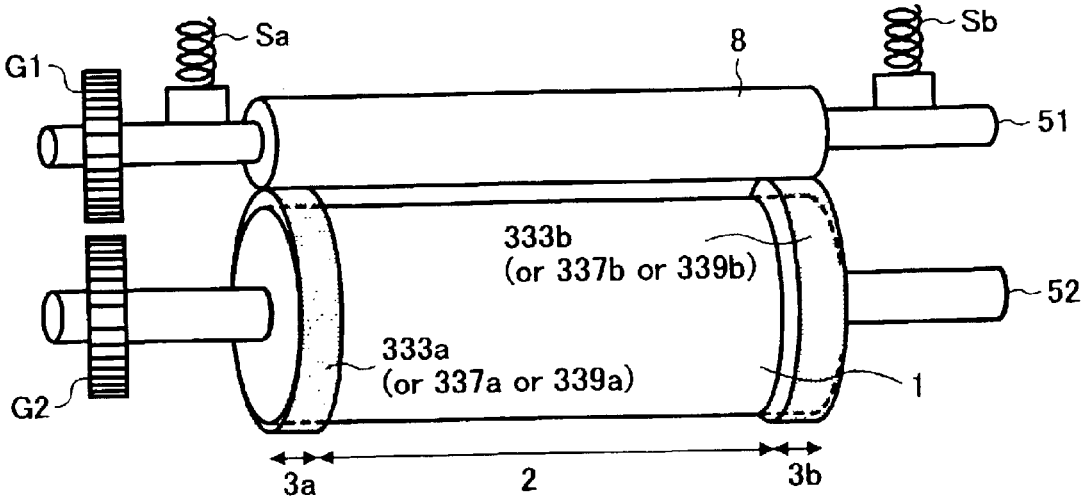

In order that the photoreceptor is not excessively separated from the charger, the charger and the photoreceptor are preferably fixed at a state in which they contact each other via the gap forming members, similarly to the first embodiment. Specifically, the rotating shafts 51 and 52 of the charger and the photoreceptor can be fixed using a ring member 5 as illustrated in FIGS. 34 and 35. In addition, as illustrated in FIG. 36, the charger may be pressed to the photoreceptor 1 using a pressing member such as the springs Sa and Sb. Further, as illustrated in FIG. 37, gears G1 and G2 (or a coupling or a belt) may be provided on the rotating shafts of the charger and photoreceptor, respectively, to independently impart a driving force to each of the charger and photoreceptor.

The photosensitive layer 333, CGL 335, CTL 337 and protective layer 339 can be prepared using the materials and the methods mentioned above for use in the first embodiment. In this case, these layers are preferably formed by a spray coating method because the layers can be formed while the thickness difference between the edge portions of the substrate and the central portion thereof is maintained.

The preferable thickness ranges of the layers are the same as those mentioned above in the first embodiment.

The method of preparing the photoreceptor having a constitution as illustrated in FIGS. 29 to 31 is, for example, as follows.

A cylinder is prepared by one of the tubing methods mentioned above for use in the first embodiment, such as extrusion or drawing, and then the central portion of the cylinder is subjected to a treatment such as cutting, super finishing, polishing and the like treatments to form a recessed portion on the central portion of the cylinder (i.e., the electroconductive substrate).

The chargers mentioned above for use in the first and second embodiments can also be used as the charger for use in the third embodiment.

In addition, the image forming method and apparatuses mentioned above for use in the first embodiment of the image forming apparatus of the present invention can also be used in the third embodiment. Similarly to the first embodiment, the image forming unit can be fixedly set in a copier, a facsimile machine or a printer, or may be set therein as a process cartridge.

Fourth Embodiment of the Image Forming Apparatus of the Present Invention

The fourth embodiment of the image forming apparatus of the present invention will be explained in detail referring to drawings.

As the photoreceptor for use in the fourth embodiment, photoreceptors similar to those mentioned above for use in the first to third embodiments can be used.

Figure 38:
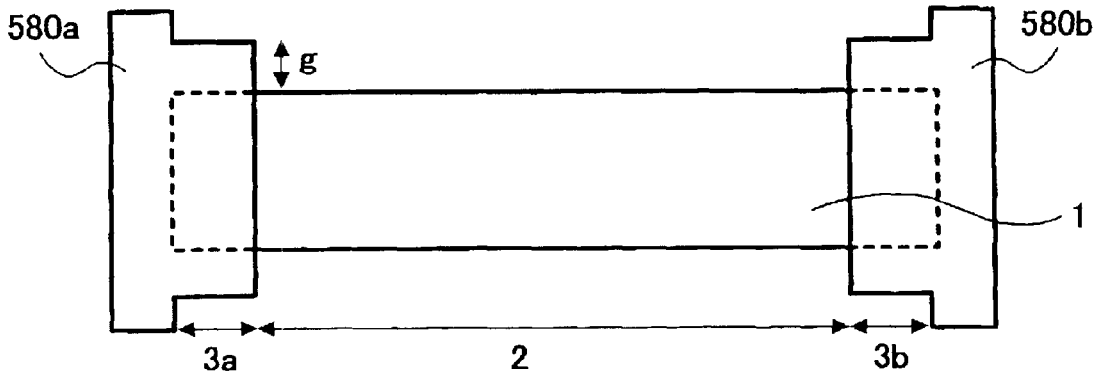
FIG. 38 is a schematic view illustrating the cross section of another embodiment of the photoreceptor for use in the image forming apparatus of the present invention.

FIG. 38 illustrates the cross section of an embodiment of the photoreceptor for use in the fourth embodiment. As illustrated in FIG. 38, flanges 580*a* and 580*b* are provided on both ends of the photoreceptor 1 so as to cover the non-image portions 3*a* and 3*b* of the photoreceptor 1.

Figure 39:
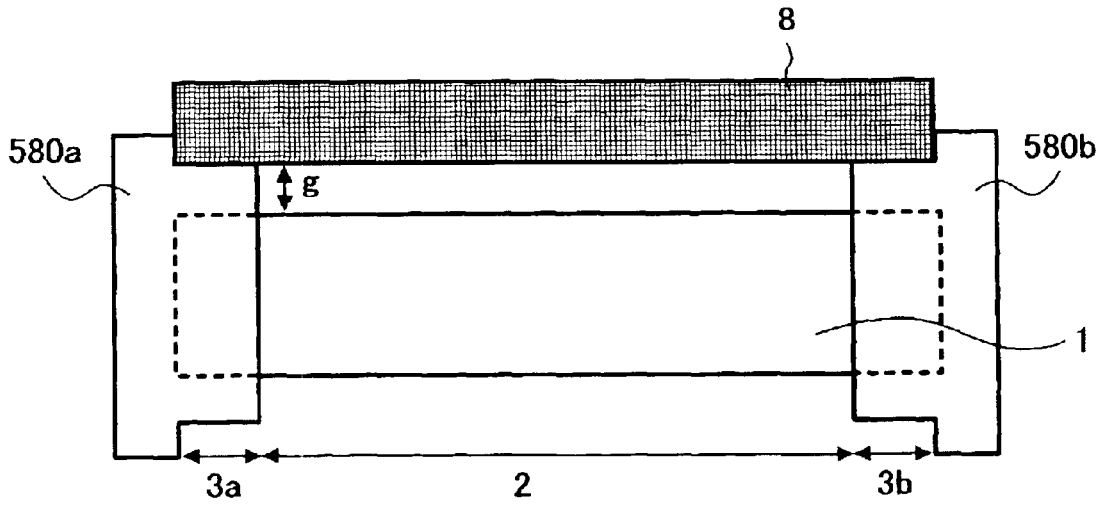
FIG. 39 is a schematic view illustrating another embodiment of the configuration of the charging roller and the photoreceptor.

The shape of the flanges is not limited to the shape illustrated in FIG. 38, and any shapes can be available if the charger does not contact the image forming portion 2 of the photoreceptor 1 and a gap g is formed between the peripheral surface of the charger 8 and the image forming portion 2 of the photoreceptor 1, as illustrated in FIG. 39. For example, flanges may be inserted to the insides of both ends of the photoreceptor 1.

FIG. 39 illustrates the positional relationship between the charger 8 and the photoreceptor 1. As shown in FIG. 39, the charger 8 is provided so as to cover the image forming portion 2 of the photoreceptor 1 and a gap (from 10 to 200 μm) is formed between the image forming portion 2 and the periphery surface of the charger 8.

Any known materials can be used for the flanges 580*a* and 580*b*, but it is preferable to use materials having high abrasion resistance and/or low friction coefficient because the flanges rotate while contacting the charger 8. The configuration (i.e., the contacting condition) of the charger and the flanges is not particularly limited, and they are arranged such that a desired gap is formed between the image forming portion 2 and the peripheral surface of the charger 8. In FIG. 39, the flat portions of the peripheral surface of the flanges 580*a* and 580*b* contact the surface of the charger 8, however a gap forming method in which a gear is provided on both ends of the charger to be engaged with a flange gear provided on both ends of the photoreceptor to form a gap between the charger and the image forming portion and to drive the charger and photoreceptor can also be used.

Figure 40:
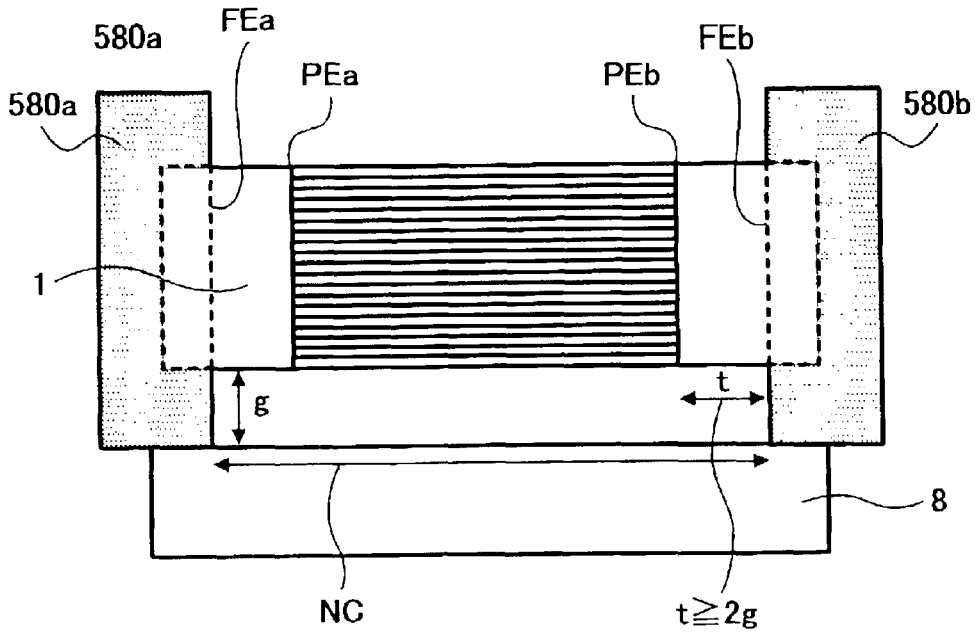
FIG. 40 is a schematic view illustrating the positional relationship between the charging roller and the photoreceptor, which are shown in FIG. 39.

FIG. 40 illustrates the positional relationship between the image forming portion of the photoreceptor and the gap formed by the flanges (i.e., the gap forming members) provided on both ends of the photoreceptor in the fourth embodiment. In the present invention, this positional relationship is very important.

Namely, it is important that as shown in FIG. 40 an inside end FEa (FEb) of the flange 580*a* (580*b*) forming the gap is located outside an end PEa (PEb) of the image forming portion 2 of the photoreceptor 1. A distance t between the inside edge FEa (FEb) of the flange 580*a* (580*b*) and the end PEa (PEb) of the image forming portion 2 is preferably not less than twice a gap g formed between the photoreceptor 1 and the charger 8. It is preferable that the distance t is not greater than 100 times the gap g or not greater than 10 mm for the reasons mentioned above in the first embodiment. Character NC denotes a non-contacting portion of the charger 8 which charges the photoreceptor 1 while not contacting the photoreceptor 1.

Figure 41:
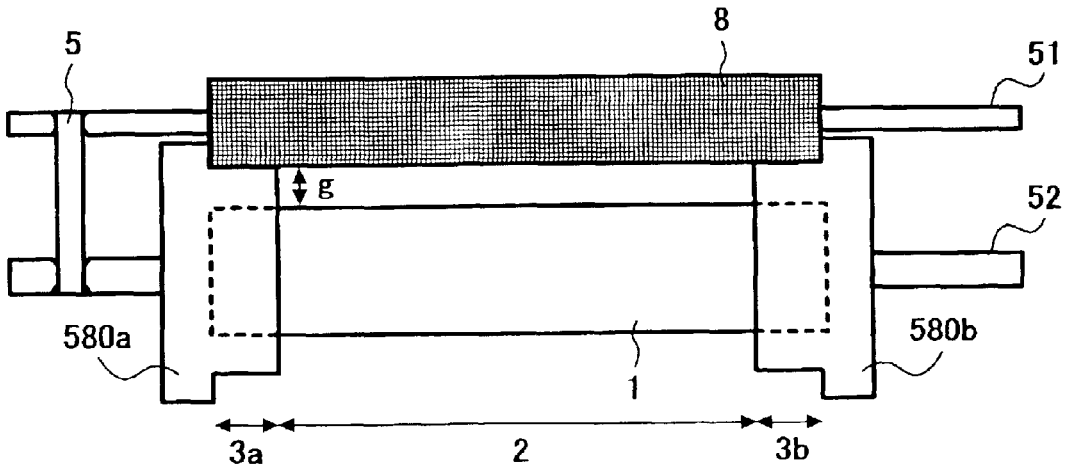
FIGS. 41 and 42 are an elevational view and a side view illustrating another embodiment of the combination of the charging roller and the photoreceptor, which are connected by a ring member.
Figure 42:
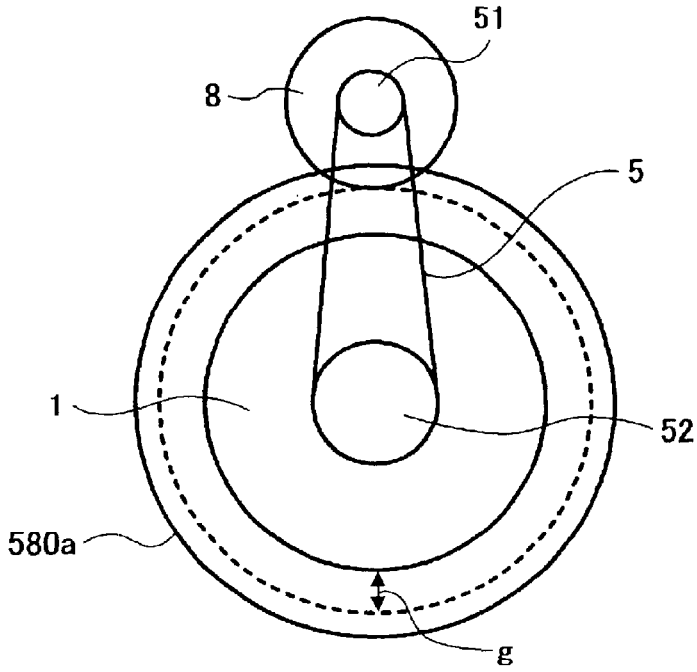
Figure 43:
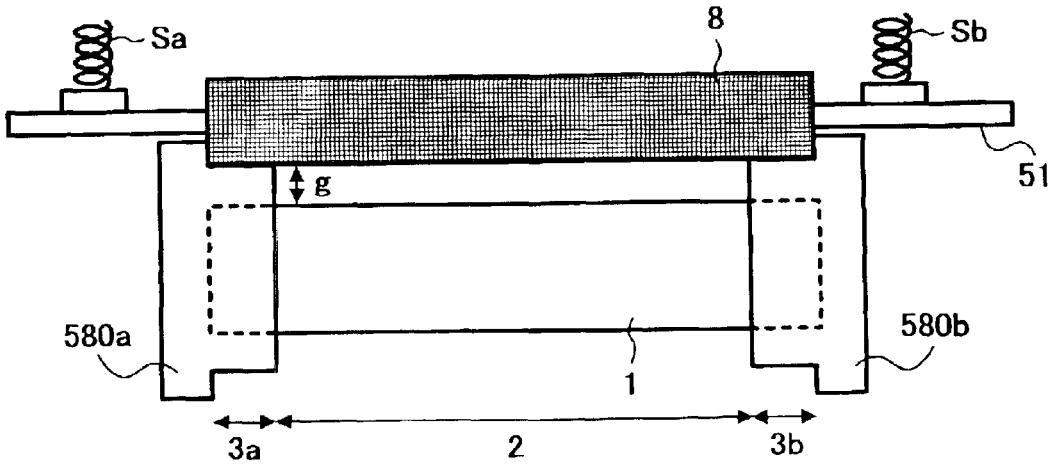
FIGS. 43 and 44 are schematic views illustrating other embodiments of the configuration of the charging roller and the photoreceptor.
Figure 44:
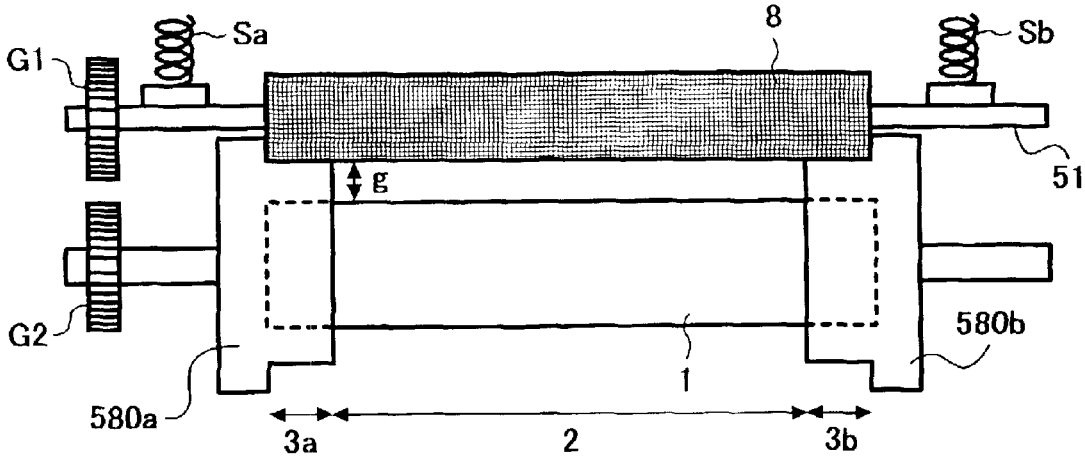

In order that the photoreceptor is not excessively separated from the charger, the charger and the photoreceptor are fixed at a state in which they contact each other via the gap forming members, similarly to the first embodiment. Specifically, the rotating shafts 51 and 52 of the charger and the photoreceptor can be fixed using a ring member 5 as illustrated in FIGS. 41 and 42. In addition, as illustrated in FIG. 43, the charger may be pressed to the photoreceptor 1 using a pressing member such as the springs Sa and Sb. Further, as illustrated in FIG. 44, gears G1 and G2 (or a coupling or a belt) may be provided on the rotating shafts of the charger and photoreceptor, respectively, to independently impart a driving force to each of the charger and photoreceptor.

The coating (i.e., layers) formed on the substrate of the photoreceptor for use in the fourth embodiment of the present invention will be explained referring to drawings. The coating include a photosensitive layer and optionally includes an undercoat layer, an intermediate layer and a protective layer.

Figure 45:
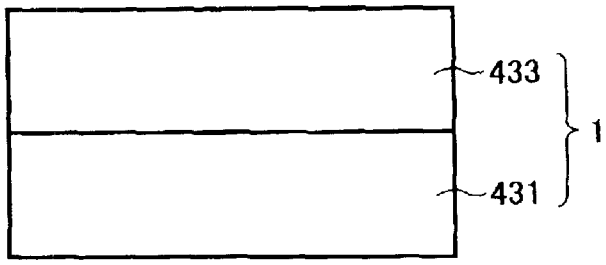
FIGS. 45 to 50 are schematic views illustrating the cross-sections of embodiments of the photoreceptor for use in the image forming apparatus of the present invention.

FIG. 45 illustrates the cross-section of an example of the photoreceptor for use in the fourth embodiment of the image forming apparatus. In FIG. 45, a single-layered photosensitive layer 433 including a CGM and a CTM as main components is formed on an electroconductive substrate 431.

Figure 46:
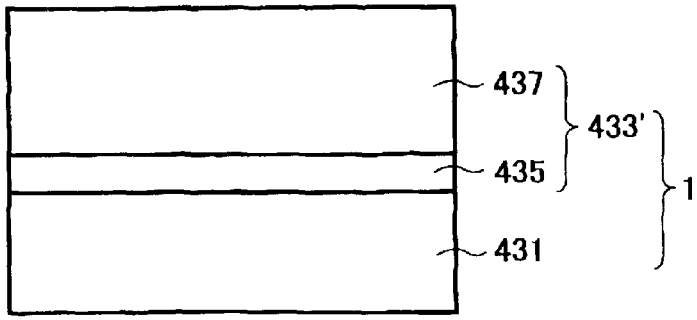
Figure 47:
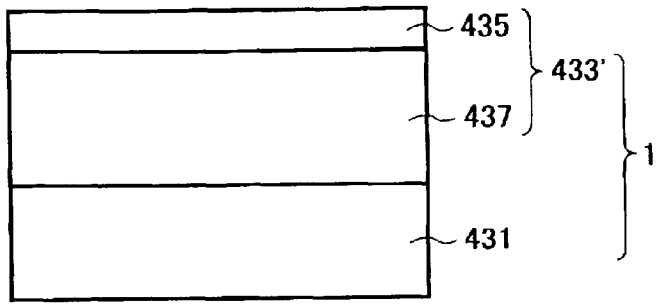

FIGS. 46 and 47 illustrate the cross-sections of other examples of the photoreceptor for use in the fourth embodiment of the image forming apparatus. In FIGS. 46 and 47, a photosensitive layer 433' (or 433") including a CGL 435 including a CGM as a main component and a CTL 437 including a CTM as a main component is formed on an electroconductive substrate 431.

Figure 48:
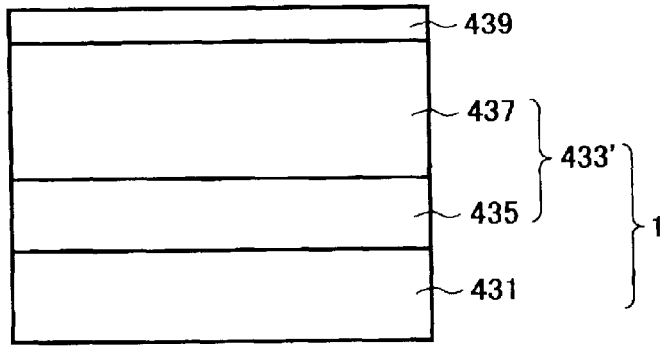

FIG. 48 illustrates another embodiment of the photoreceptor for use in the fourth embodiment of the image forming apparatus of the present invention. As shown in FIG. 48, a photosensitive layer 433' including a CGL 435 including a CGM as a main component and a CTL 437 including a CTM as a main component and a protective layer 439 is formed on an electroconductive substrate 431.

The photoreceptor for use in the fourth embodiment can be prepared using the materials and methods mentioned above for use in the first to third embodiment. On both ends of the thus prepared photoreceptor, a flange is provided as mentioned above.

In addition, the chargers for use in the first to third embodiments can also be used for the fourth embodiment of the image forming apparatus.

Further, the image forming method and apparatuses mentioned above for use in the first embodiment of the image forming apparatus of the present invention can also be used in the fourth embodiment. Similarly to the first embodiment, the image forming unit can be fixedly set in a copier, a facsimile machine or a printer, or may be set therein as a process cartridge.

Fifth Embodiment of the Image Forming Apparatus of the Present Invention

The charger for use in the fifth embodiment of the image forming apparatus of the invention will be explained referring to drawings. Known chargers can be used in the fifth embodiment and examples of the chargers are explained below. However, the charger is not limited thereto.

Figure 49:
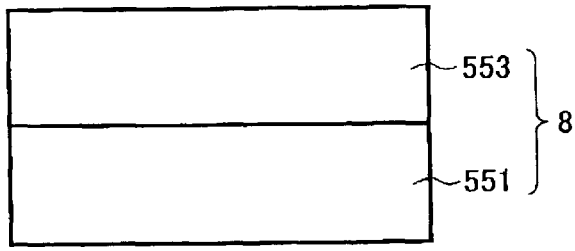

FIG. 49 illustrates the cross section of an embodiment of the charger for use in the fifth embodiment. As illustrated in FIG. 49, a layer made of an electroconductive elastic material 553 is formed on a rotating shaft 551 such as metal shafts.

Figure 50:
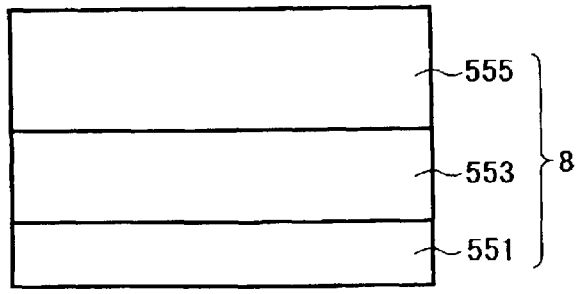

FIG. 50 illustrates the cross section of another embodiment of the charger for use in the fifth embodiment. As illustrated in FIG. 50, a layer made of an electroconductive elastic material 553 and a resistance controlling layer 555 are overlaid on a rotating shaft 551 such as metal shafts.

Suitable materials for use as the rotating shaft of the charger 8 include metals such as iron, copper, brass and stainless steals. Suitable materials for use as the electroconductive elastic materials of the charger 8 include compositions in which an electroconductive powder or an electroconductive fiber (e.g., carbon black, metal powders, carbon fibers, etc.) is dispersed in a synthetic rubber. When a resistance controlling layer is formed on the surface of the charger 8, the resistance controlling layer 555 preferably has a resistance of from $10^3$ to $10^8$ Ω·cm. When the resistance controlling layer is not formed, the resistance of the electroconductive elastic material (i.e., the outermost layer of the charger) preferably has a resistance of from about $10^4$ to about $10^{10}$ Ω·cm.

Suitable materials for use in the resistance controlling layer 555 of the charger 8 include synthetic resins such as polyethylene, polyesters and epoxy resins; synthetic rubbers such as ethylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

When the photoreceptor is charged with the charger mentioned above, a DC voltage overlapped with an AC voltage is preferably applied to the photoreceptor to reduce the chance that the photoreceptor is unevenly charged.

Figure 51:
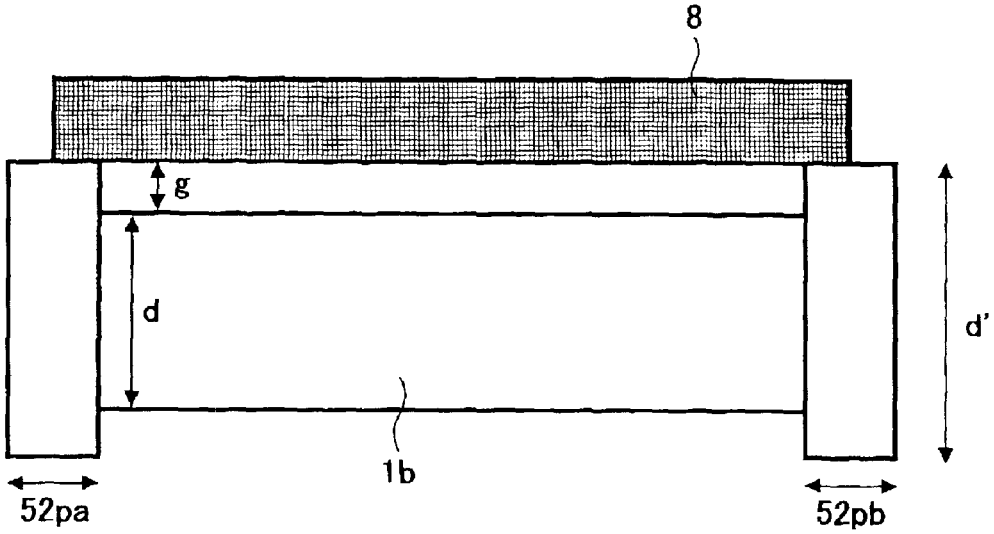
FIG. 51 is a schematic view illustrating an embodiment of the configuration of the charging roller and the belt photoreceptor for use in the present invention.

FIG. 51 is an elevational view illustrating the positional relationship among a belt-form photoreceptor, a driving roller (or a driven roller, hereinafter referred to as a driving/driven roller) and a charger in the fifth embodiment. As shown in FIG. 51, the length of the driving/driven roller supporting the belt photoreceptor 1*b* is longer than the width of the belt photoreceptor and therefore both ends of the driving/driven roller projects from the both edges of the photoreceptor. The outside diameter of the projected portions (i.e., the portions do not contact the photoreceptor) of the driving/driven roller is larger than that of the central portion of the driving/driven roller contacting the photoreceptor. By bringing the projected portions into contact with the charger, a gap is formed between the photoreceptor and the charger. Therefore, the proximity charging is performed on the photoreceptor.

Figure 52:
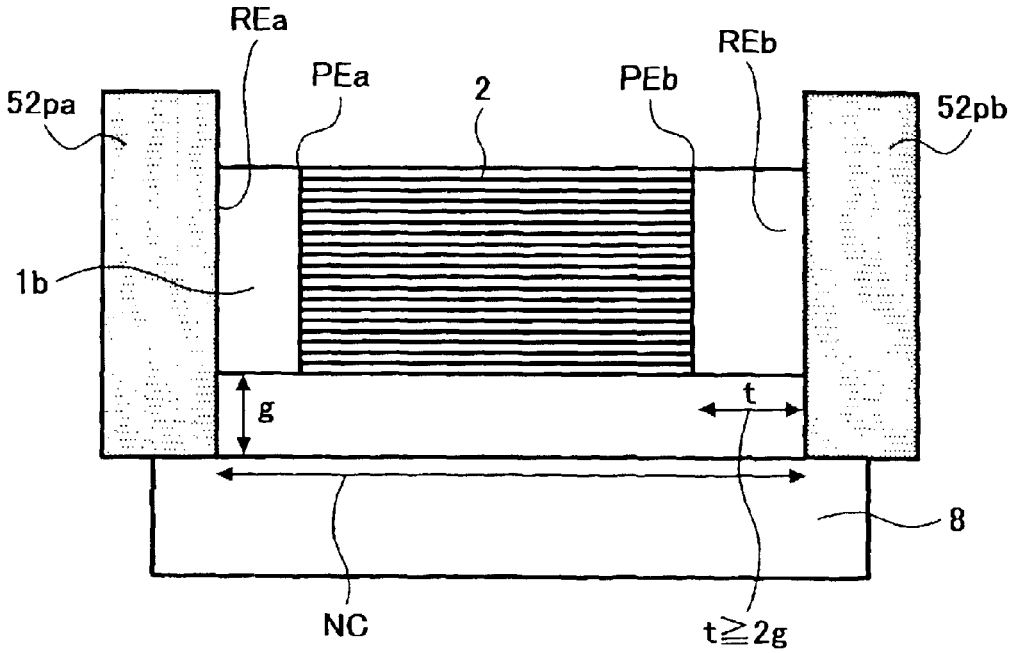
FIG. 52 is a schematic view illustrating the positional relationship between the charging roller and the belt photoreceptor, which are shown in FIG. 51.

FIG. 52 illustrates the positional relationship between the image forming portion of the belt-form photoreceptor and the gap formed by the projected portions of the driving/driven roller in the fifth embodiment. In the present invention, this positional relationship is very important.

Namely, it is important that as shown in FIG. 52 an inside end REa (REb) of projected portions 52*pa* (or 52*pb*) of the driving/driven roller is located outside an end PEa (PEb) of an image forming portion 2 of a photoreceptor 1*b*. A distance t between the inside edge REa (REb) of the projected portions 52*pa* (52*pb*) and the end PEa (PEb) of the image forming portion 2 is preferably not less than twice a gap g formed between the photoreceptor 1*b* and the charger 8. It is preferable that the distance t is not greater than 100 times the gap g or not greater than 10 mm for the reasons mentioned above in the first embodiment. A character NC denotes a non-contacting portion of the charger 8 which charges the photoreceptor 1*b* while not contacting the photoreceptor 1*b*.

Figure 53:
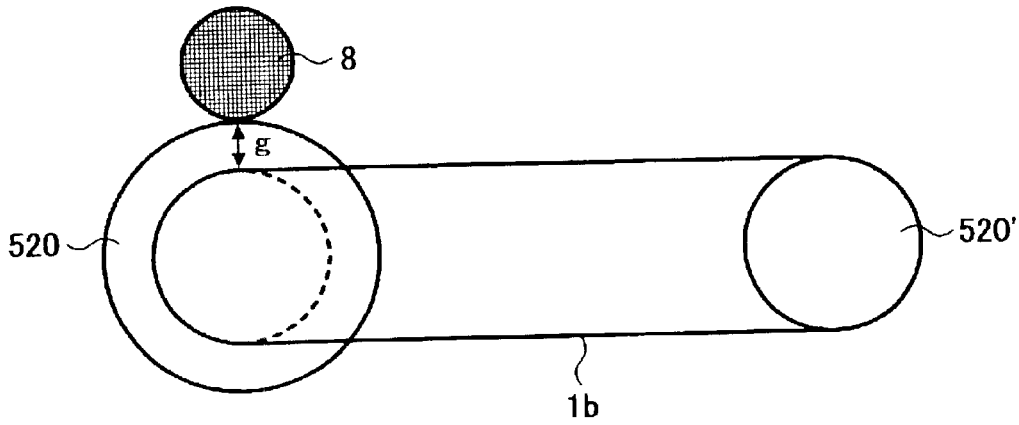
FIG. 53 is a side view of the charging roller and the belt photoreceptor as illustrated in FIG. 51.

FIG. 53 is a side view illustrating the positional relationship among the photoreceptor, the driving/driven rollers, and the charger.

The projected portions of one of the driving/driven rollers can be formed of any known material. However, since the projected portions rotate while contacting the chargers, materials having good abrasion resistance and/or a low friction coefficient are preferably used therefor. The configuration (i.e., contacting state) of the projected portions and the charger is not particularly limited, and any configuration can be available if a desired gap is formed between the image forming portion of the photoreceptor and the peripheral surface of the charger. Namely, in FIGS. 51 to 53, the flat surface of the periphery of the projected portions contacts the surface of the charger, but a gap forming method in which a gear is provided on both ends of the charger to be engaged with a gear provided on both the projected portions of the driving/driven rollers to form a gap between the charger and the image forming portion and to drive the charger and photoreceptor can also be used. Needless to say, in this case the length of the charger is longer than the width of the image forming portion of the photoreceptor.

The gap formed between the charger and the image forming portion is preferably from 10 to 200 μm, and more preferably from 20 to 100 μm. When the gap is too narrow, there is a possibility that the charger 8 contacts the photoreceptor 1. In addition, the toner remaining on the surface of the photoreceptor 1 tends to adhere to the charger 8. Therefore, it is not preferable. When the gap is too wide, the voltage applied to the charger has to be increased, resulting in increase of electric power consumption. In addition, the photoreceptor tends to be unevenly charged, and therefore it is not preferable.

In the fifth embodiment, it is very important to control the gap between the belt photoreceptor and charger. It is possible to control the gap such that the gap is excessively shortened. However, a measure is needed to control the gap such that the gap is excessively widened.

As the measure, various methods can be available. In the present invention, the following two methods can be preferably used.

One of the methods is to regulate the distance between the charger and the belt photoreceptor. Specifically, the charger and the photoreceptor are fixed at a state in which the charger contacts the photoreceptor with the gap forming members therebetween. More specifically, the rotating shafts 51 and 52 of the charger 8 and one of the driving/driven rollers supporting the endless belt photoreceptor 1*b* are preferably fixed with a ring member 5 as illustrated in FIGS. 54 and 55. 6/4

Figure 54:
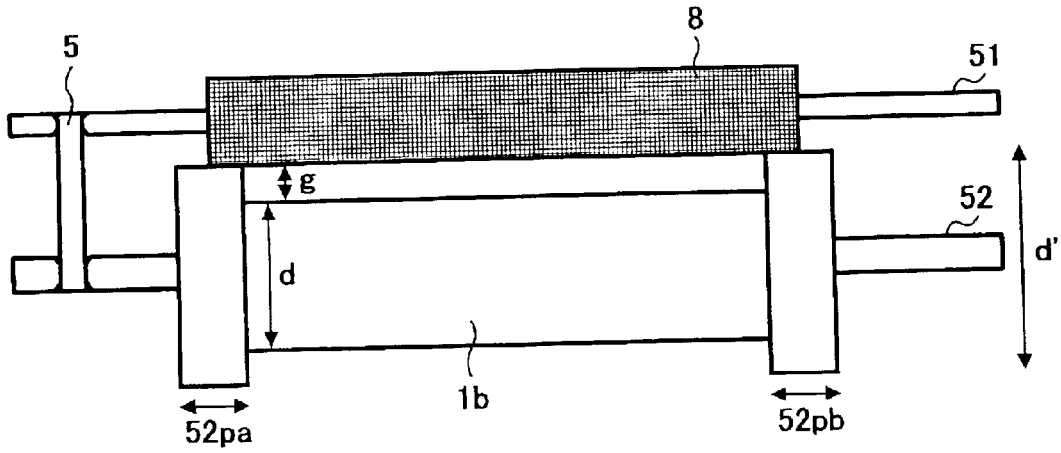
FIGS. 54 and 55 are an elevational view and a side view illustrating an embodiment of the combination of the charging roller and the belt photoreceptor, which are connected by a ring member.
Figure 55:
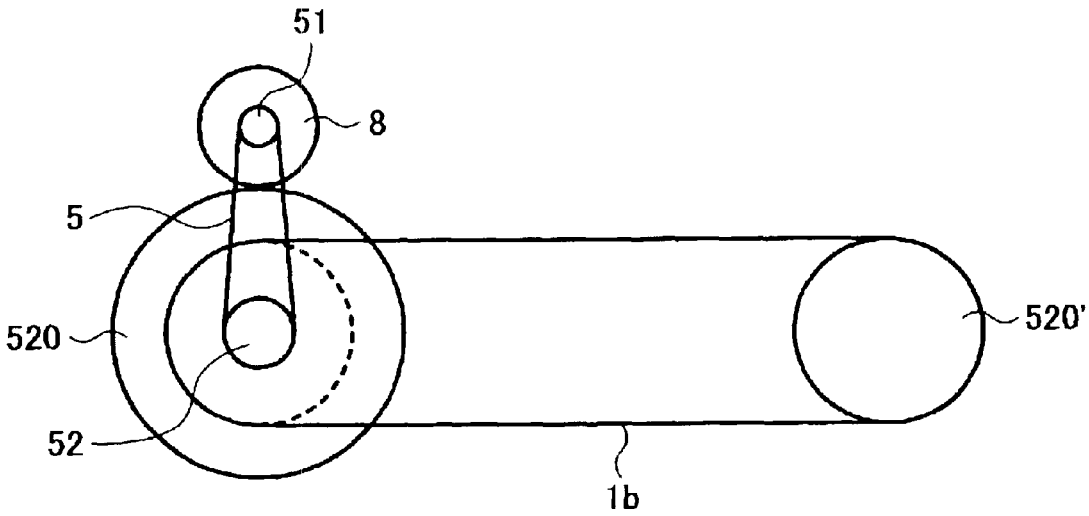

As illustrated in FIGS. 54 and 55, the rotating shafts 51 and 52 are fixed with the ring member 5 and therefore the gap between the charger 8 and endless belt photoreceptor is controlled so as to be fall in a predetermined range.

Specific examples of such a ring member include flexible rings, and belt-form rings. In particular, seamless belt metals and plastic films are preferably used as the ring-form member.

Figure 56:
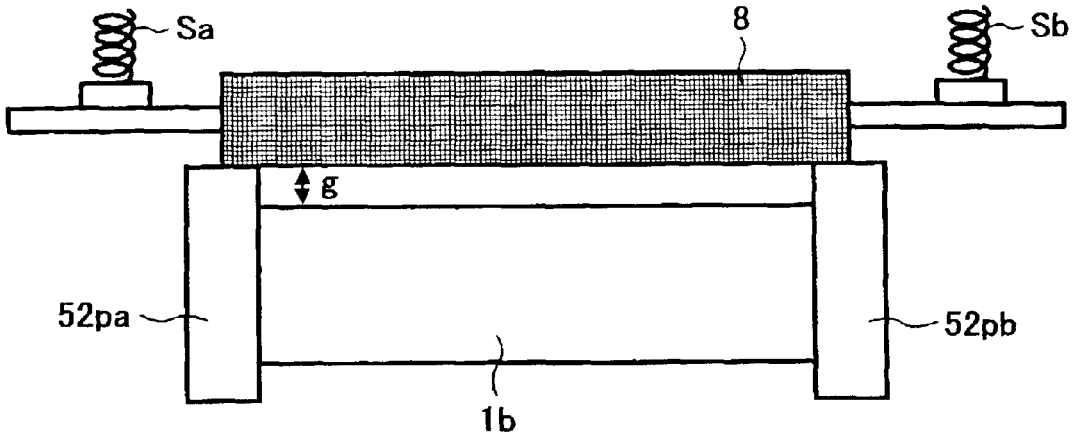
FIGS. 56 and 57 are schematic views illustrating other embodiments of the configuration of the charging roller and the belt photoreceptor.

The other method is a method in which the charger is pressed toward the driving/driven roller using a mechanical pressing member such as springs such that the charger contacts the photoreceptor supported by the driving/driven roller with the gap forming members 52*pa* and 52*pb* therebetween as shown in FIG. 56. In FIG. 56, the rotating shaft of the charger is pressed by springs Sa and Sb, however the main body of the charger may be pressed instead of the rotating shaft.

In addition, it is possible to press the driving/driven roller to bring the driving/driven roller into contact with the charger. However, since this configuration adversely affects other members contacting the belt photoreceptor, the method in which the charger is pressed toward the driving roller is preferable.

Figure 57:
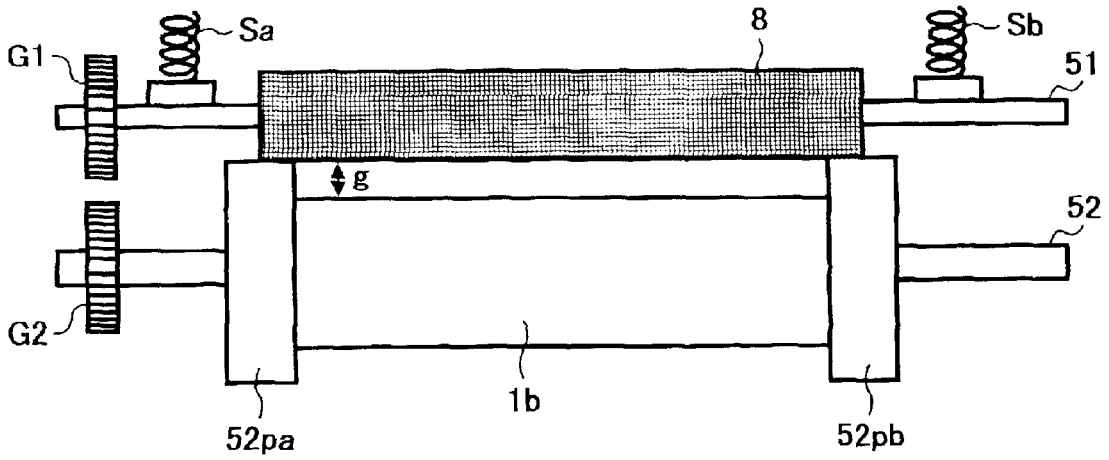

In this method, it is preferable to independently apply a driving force to each of the charger and endless belt photoreceptor by providing a gear, a coupling, a belt or the like on the rotating shafts of the charger and driving (or driven) roller supporting the endless belt photoreceptor as shown in FIG. 57. In addition, it is possible that a driving gear is provided on one side of the rotating shaft of one of the charger and driving/driven roller to frictionally rotate the charger and driving/driven roller. In this case, the contact pressure of the charger with the driving/driven roller has to be increased, and therefore the mechanical durability of the charger tends to deteriorate. The rotating speeds of the surfaces of the charge and driving/driven roller can be freely set. However, in view of abrasion of the gap forming members and charger at the contact point, it is preferable that the rotating speeds of the surfaces of the charge and driving/driven roller are the same.

Suitable materials for use in the driving/driven rollers in the fifth embodiment include known materials if the materials fulfill the requirements of the rollers of the fifth embodiment. Specific examples of the rollers include metal rollers and plastic rollers. When it is needed to impart an insulating property to the driving/driven roller to be contacted with the charger, rollers having a surface treated with an insulating material and rollers in which a portion to be contacted with the charger is made of a plastic can be preferably used.

Next, the photoreceptor for use in the fifth embodiment will be explained in detail referring to drawings.

Figure 58:
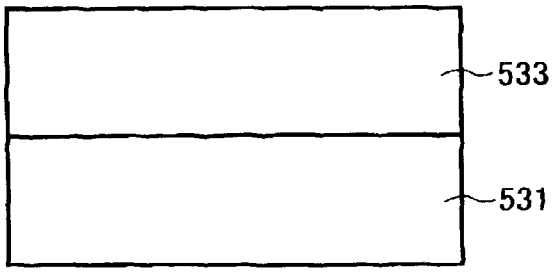
FIGS. 58 to 61 are schematic views illustrating the cross section of other embodiments of the photoreceptor for use in the image forming apparatus of the present invention.

FIG. 58 is a cross section of an embodiment of the photoreceptor for use in the fifth embodiment. As shown in FIG. 58, a single-layered photosensitive layer 533 including a CGM and a CTM as main components is formed on a belt electroconductive substrate 531.

Figure 59:
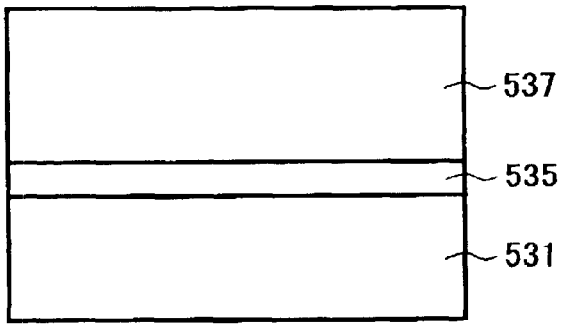
Figure 60:
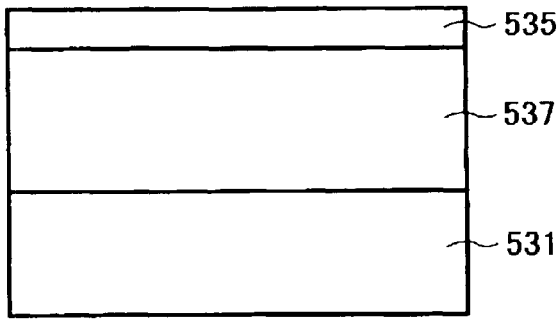
Figure 61:
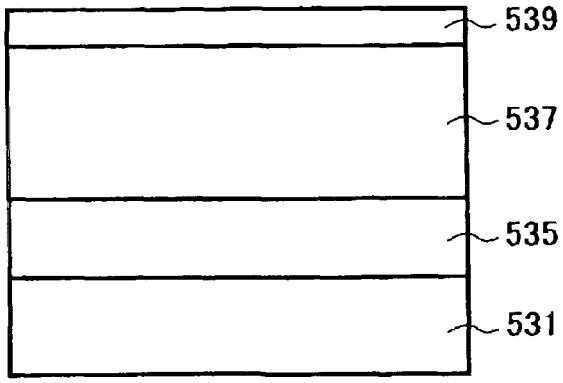

FIGS. 59 and 60 are cross sections of other embodiments of the photoreceptor for use in the fifth embodiment. As shown in FIGS. 59 and 60, a CGL 535 including a CGM as a main component and a CTL including a CTM as a main component are overlaid on a belt electroconductive substrate 531. FIG. 61 is a cross section of another embodiment of the photoreceptor for use in the fifth embodiment. As shown in FIG. 61, a CGL 535 including a CGM as a main component, a CTL including a CTM as a main component and a protective layer 539 are overlaid on a belt electroconductive substrate 531.

Suitable materials for use as the electroconductive substrate 531 of the belt photoreceptor include materials having a volume resistance not greater than $10^{10}$ Ω·cm. Specific examples of such materials include plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, endless belts of a metal such as nickel, stainless steel and the like, which have been disclosed, for example, in Japanese Laid-Open Patent Publication No. 52-36016, can also be used as the substrate.

Furthermore, supports, in which a coating liquid including an electroconductive powder dispersed in a binder resin is coated on the supporters mentioned above, can be used as the substrate. Specific examples of such an electroconductive powder and the binder resin include the materials mentioned above for use in the electroconductive substrate 31 mentioned above in the first embodiment.

Such an electroconductive layer can be also formed by the coating method mentioned above for use in formation of the electroconductive substrate.

In addition, belt-form supports, in which an electroconductive resin film is formed on a surface of a belt substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate of the photoreceptor.

Next, the photosensitive layer of the photoreceptor for use in the fifth embodiment will be explained. The photosensitive layer may be a single-layered photosensitive layer or a multi-layered photosensitive layer.

At first, the multi-layered photosensitive layer including a charge generation layer and the charge transport layer will be explained.

The CGL includes a CGM as a main component, and optionally a binder resin can also be used. In the CGL, known inorganic and organic CGMs can be used.

Specific examples of the inorganic and organic CGMs include the inorganic and organic CGMs mentioned above for use in the photoreceptor of the first embodiment.

These CGMs can be used alone or in combination.

Specific examples of the binder resin, which is optionally used in the CGL, include the resins mentioned above for use in the CGL for use in the photoreceptor of the first embodiment. The addition quantity of the binder resin is from 0 to 500 parts by weight, and preferably from 10 to 300 parts by weight, per 100 parts by weight of the CGM included in the CGL.

Suitable methods for forming the CGL include the thin film forming methods in a vacuum and the casting methods using a coating liquid, which are mentioned above for use in the photoreceptor in the first embodiment.

The thickness of the CGL is preferably from about 0.01 to about 5 μm, and more preferably from about 0.1 to about 2 μm.

The CTL 537 can be formed, for example, by the method mentioned above for use in the formation of the CTL 37 for use in the photoreceptor of the first embodiment.

The CTL 537 may include additives such as plasticizers, leveling agents, antioxidants and the like, if desired.

Suitable CTMs include the electron transport materials and positive-hole transport materials mentioned above for use in the CTL 37.

These CTMs can be used alone or in combination.

Specific examples of the binder resin for use in the CTL 537 include the resins mentioned above for use in the CTL 37.

The content of the CTM included in the CTL is preferably from 20 to 300 parts by weight, and more preferably from 40 to 150 parts by weight, per 100 parts by weight of the binder resin included in the CTL 537. The thickness of the CTL 537 is preferably from 5 to 100 μm.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The CTL 537 preferably includes a charge transport polymer, which has both a binder resin function and a charge transport function. The CTL 537 constituted of a charge transport polymer has good abrasion resistance.

Suitable charge transport polymers include known charge transport polymers. Among these polymers, polycarbonate resins having a triarylamine group in their main chain and/or side chain are preferably used. In particular, the charge transport polymers having one of formulae (1) to (10) mentioned above are preferably used.

The CTL 537 may include additives such as plasticizers and leveling agents. Specific examples of the plasticizers and the leveling agents include the plasticizers and the leveling agents mentioned above for use in the CTL 37. The addition quantity of the plasticizer is 0 to 30% by weight based on the binder resin included in the CTL 537. The addition quantity of the leveling agents is 0 to 1% by weight of the binder resin included in the CTL 537.

Next, the single-layered photosensitive 533 layer will be explained. Similarly to the photosensitive layer 33 in the first embodiment, the photosensitive layer can be formed by coating a coating liquid in which a CGM, a CTM and a binder resin are dissolved or dispersed in a proper solvent, and then drying the coated liquid. In addition, the photosensitive layer may include one or more of the CTMs mentioned above to form a functionally-separated photosensitive layer. The photosensitive layer may include additives such as plasticizers, leveling agents and antioxidants.

Suitable binder resins for use in the photosensitive layer include the resins mentioned above for use in the CTL 37. The resins mentioned above for use in the CGL 35 can be added as a binder resin. In addition, the charge transport polymers mentioned above can also be used as a binder resin.

The content of the CGM included in the photosensitive layer is preferably from 5 to 40 parts by weight per 100 parts by weight of the binder resin included in the photosensitive layer. The content of the CTM in the photosensitive layer is preferably from 0 to 190 parts, and more preferably from 50 to 150 parts by weight, per 100 parts by weight of the binder resin included in the photosensitive layer.

The single-layered photosensitive layer can be formed by the method for use in the formation of the photosensitive layer 33 in the first embodiment. The thickness of the photosensitive layer is preferably from 5 to 100 $\mu$m.

Similarly to the photoreceptor for use in the first embodiment, the photoreceptor for use in the fifth embodiment may include an undercoat layer between the substrate and the photosensitive layer.

The undercoat layer can be formed using the methods and materials mentioned above for use in the undercoat layer of the photoreceptor in the first embodiment.

In the photoreceptor for use in the fifth embodiment, a protective layer 539 is optionally formed on the photosensitive layer to protect the photosensitive layer.

The protective layer 539 can be formed using the methods and materials mentioned above for use in the protective layer 39 in the first embodiment.

When a charge transport polymer is used in the CTL 537 and/or the protective layer 539 in the fifth embodiment, the resultant photoreceptor has the following advantages.

(1) the mechanical durability of the photoreceptor can be enhanced and therefore a uniform gap can be stably maintained.

This is mentioned in detail in the first embodiment.

(2) The ratio (Dp/Dc) of the diameter (Dp) of the endless belt photoreceptor to the diameter (Dc) of the charger can be decreased.

As mentioned above, there is a limit for miniaturization in diameter of the photoreceptor because the life of the photoreceptor cannot be prolonged (in particular, the mechanical durability of the photoreceptor cannot be enhanced) Therefore there is a limit for miniaturization of the image forming apparatus and in addition, the ratio Dp/Dc is large.

Although the material and construction of the charger have been investigated to enhance the durability thereof, the charger is typically constituted of an elastic rubber now. By using the proximity charging device of the present invention, the abrasion and the residual-toner-induced contamination of the charger after repeated use can be dramatically improved. Therefore the abrasion and contamination are no longer a factor on which the life of a charger depends.

However, the deterioration of the materials themselves used for chargers due to repeated charging is hardly improved. One of the reasons is that the diameter of the photoreceptor is much larger than that of the charger. For example, the diameters of a belt-form photoreceptor and a charger, which are typically used in current image forming apparatus and process cartridge, are about 100 mm and from about 10 to 20 mm, respectively, to miniaturize the image forming apparatus and process cartridge. In order to effectively perform a maintenance work, both a charger and a photoreceptor are typically replaced with new ones at the same time. Therefore, in this case the durability of the charger has to be 5 to 10 times that of the photoreceptor.

When the durability of the belt-shaped photoreceptor can be improved as mentioned above, the diameter (i.e., the length) of the photoreceptor can be decreased. Therefore, the ratio (P/C) of the diameter (P) of the photoreceptor to the diameter (C) of the charger decreases. As mentioned above, when the diameter of the photoreceptor decreases, the charging area decreases as mentioned below, and thereby deterioration of the charger due to discharging can be controlled. Therefore, it is possible to provide further miniaturized image forming apparatus and process cartridges.

In the proximity charging device of the present invention, discharging between the charger and the photoreceptor substantially accords with Paschen's law. Namely, when the rotating photoreceptor and charger approach or separate from each other, discharging occurs therebetween if the distance thereof is in a certain range. When the area of the charger (or the photoreceptor) in which discharging is performed at a time is referred to as "charging area", the larger the curvature of the charger (or the photoreceptor), i.e., the smaller the diameter of the charger (or the photoreceptor), the less the charging area.

As a result of the present inventors' investigation, it is found that when the diameter of the charger (or the photoreceptor) becomes small, the relationship between the applied voltage and the resultant potential of the photoreceptor is not changed although the quantity of generated reaction gasses such as ozone and NOx can be reduced.

Namely, it is found that by decreasing the charging area, the quantity of generated reaction gasses can be reduced without deteriorating charging efficiency.

Thus, by improving the abrasion resistance of a photoreceptor, the diameter of the driving roller (or the driven roller) can be decreased, and thereby the quantity of generated reaction gasses can be reduced. When the quantity of generated reaction gasses is reduced, deterioration of the charger and photoreceptor due to such reaction gasses can be decreased, resulting in dramatically increase of the durability of the charger and the photoreceptor.

According to Paschen's law, if the composition of the photosensitive layer of a photoreceptor is constant, the thinner the photosensitive layer, the more easily the photoreceptor can be charged. When a photoreceptor having good abrasion resistance is used, the photosensitive layer can be thinned and therefore the applied voltage can be decreased. Therefore, the stress to a charger can be reduced in repeated use, thereby decreasing chemical deterioration of the charger, resulting in improvement of durability of the charger. In addition, the voltage applied to a charger can be reduced, the quantity of generated reaction gasses such as ozone and NOx can be decreased, resulting in prevention of deterioration of the charger and the photoreceptor, and thereby the durability thereof can be improved.

(3) Image qualities can be improved.

This is also mentioned above in detail in the first embodiment.

The photoreceptor for use in the fifth embodiment may include an intermediate layer between the photosensitive layer and the protective layer. The intermediate layer can be formed by using such materials and methods as mentioned above for use in the photoreceptor of the first embodiment. The thickness of the intermediate layer is preferably from 0.05 to 2 μm.

In order to improve the stability of the photoreceptor to withstand environmental conditions, in particular, to prevent deterioration of photosensitivity and increase of residual potential of the photoreceptor for use in the fifth embodiment of the image forming apparatus, antioxidants, plasticizers, lubricants, ultraviolet absorbents, low molecular weight charge transport materials and leveling agents may be included in each layer of the photoreceptor.

Specific examples thereof include the materials mentioned above for use in the photoreceptor in the first embodiment.

The image forming apparatus of the fifth embodiment is explained referring to drawings.

Figure 62:
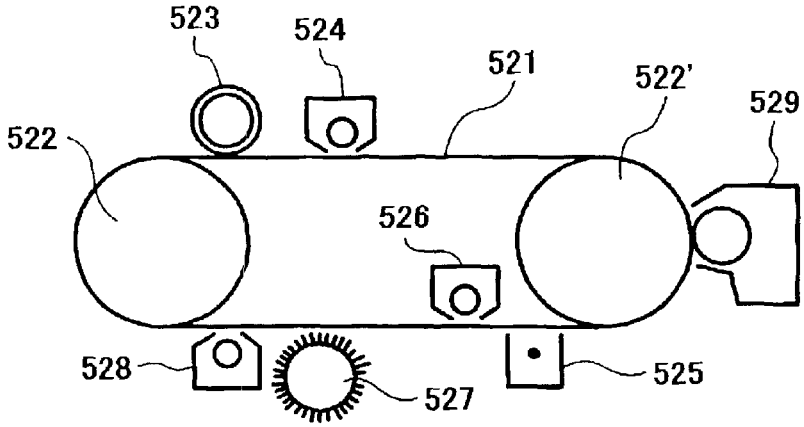
FIG. 62 is a schematic views illustrating another embodiment of the image forming apparatus of the present invention.

FIG. 62 is a schematic view illustrating an example of the fifth embodiment of the image forming apparatus of the present invention. Since the image forming apparatus are mentioned above in detail in the first embodiment while referring to FIG. 18, the image forming apparatus is explained briefly in this embodiment.

Numerals 521, 522, 522', 523, 524, 525, 526, 527, 528, and 529 denote a belt photoreceptor, a driving roller, a driven roller, a charging roller, an imagewise light irradiator, a transfer charger, a pre-cleaning light irradiator, a cleaning brush, a discharging lamp and a developing unit.

The image forming unit as shown in FIG. 62 may be fixedly set in a copier, a facsimile or a printer. However, the image forming unit may be set therein as a process cartridge. The process cartridge is an image forming unit (or device) which includes at least a photoreceptor, and at least one of a charger, an imagewise light irradiator, an image developer, an image transfer device, a cleaner and a discharger. In addition, the process cartridge may include an imagewise light irradiator, an image developer, an image transferer, a cleaner, and/or a discharger.

Figure 63:
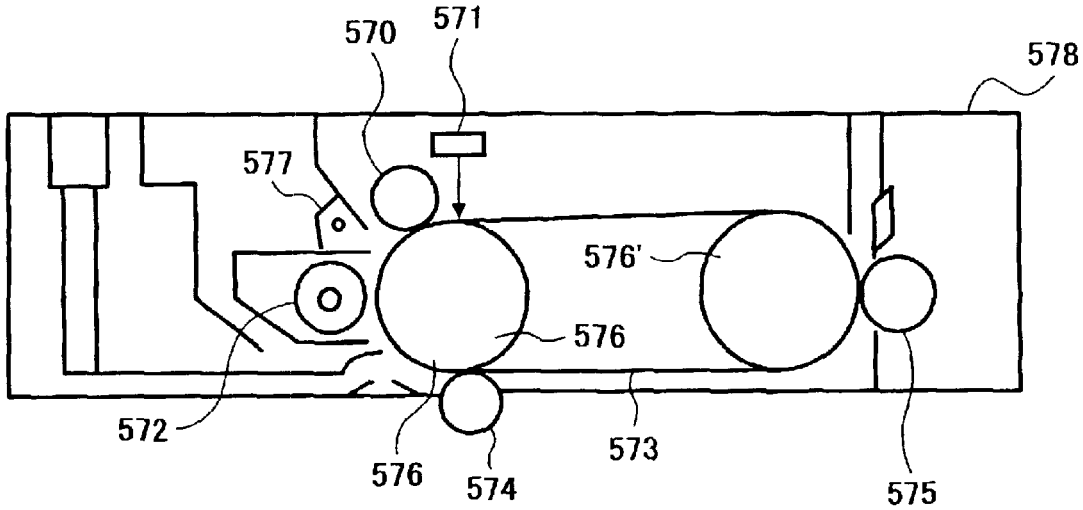
FIG. 63 is a schematic views illustrating another embodiment of the process cartridge of the present invention.

Various process cartridges can be used in the present invention. FIG. 63 is a schematic view illustrating an embodiment of the process cartridge of the present invention. In FIG. 63, the process cartridge includes a photoreceptor 573 supported and driven by driving and driven rollers 576 and 576', and a charger 570, an imagewise light irradiator 571, a developing roller 575, a transfer roller 574, and a cleaning brush 572, which are arranged around the photoreceptor 573. Numerals 577 and 578 denote a discharger and a housing. In this case, the photoreceptor 573 and the driving and driven rollers 576 and 576' serve as the image bearing device. The photoreceptor 573 has at least a photosensitive layer formed on an electroconductive substrate as mentioned above.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples of the First Embodiment

Example 1

Preparation of Charger

An electroconductive elastic layer made of an epichlorohydrin rubber and having a resistivity of $2\times10^8$ •·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 50 μm was formed thereon. Thus, a charging roller was prepared.

Preparation of Photoreceptor A

Each of the following charge generation layer coating liquid and charge transport layer coating liquid was coated on an aluminum layer deposited on a polyethylene terephthalate film (hereinafter referred to as a PET film) and then dried one by one to overlay a CGL having a thickness of 0.3 μm and a CTL having a thickness of 25 μm on the aluminum layer of the PET film. On both the edge portions of the photoreceptor, the following gap forming layer coating liquid was coated by a nozzle coating method and then dried to form gap layers having a thickness of 50 μm.

| Charge generation layer coating liquid | |
|---|---|
| Titanyl phthalocyanine | 3 |
| Polyvinyl butyral | 2 |
| n-butyl acetate | 100 |

-continued

| Charge transport layer coating liquid | |
|---|---|
| A-form polycarbonate | 10 |
| Charge transport material having the following formula (a) | 8 |

(a)

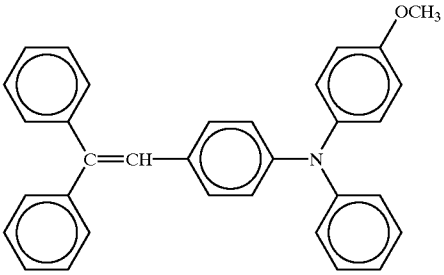

| | |
|---|---|
| Methylene chloride | 80 |
| Gap forming layer coating liquid | |
| Z-form polycarbonate | 10 |
| Toluene | 90 |

Thus, a photoreceptor A was prepared.

Example 2

The procedures for preparation of the charger and the photoreceptor in Example 1 were repeated except that the thickness of the gap forming layers was changed to 100 $\mu$m.

Example 3

The procedures for preparation of the charger and the photoreceptor in Example 1 were repeated except that the thickness of the gap forming layers was changed to 150 $\mu$m.

Example 4

The procedures for preparation of the charger and the photoreceptor in Example 1 were repeated except that the thickness of the gap forming layers was changed to 250 $\mu$m.

Example 5

The procedures for preparation of the charger and the photoreceptor in Example 1 were repeated except that the composition of the gap forming layers was changed to a Z-form polycarbonate resin in which an electroconductive carbon black is dispersed and which has a resistivity of $2\times10^3$ Ω·cm.

Comparative Example 1

The procedures for preparation of the charger and the photoreceptor in Example 1 were repeated except that the gap forming layers was not formed on the photoreceptor.

Evaluation Method

Each combination of the charger and the photoreceptor in Examples 1 to 5 and Comparative Example 1 was evaluated as follows.

The both ends of the photoreceptor were joined to each other to form an endless belt photoreceptor to be mounted in an image forming apparatus having the configuration as shown in FIG. 18. Then, the rotating shaft of a driving roller supporting and driving the endless belt photoreceptor and the rotating shaft of a charger were fixed using a ring member. The charger and the endless belt photoreceptor of Examples 1, 2, 3, 4 or 5 contacted only at the gap forming layers formed on the non-image portions of the photoreceptor as illustrated in FIG. 4.

In this case, the photoreceptor and the charger were set such that as illustrated in FIG. 5 the inside end GEa (GEb) of the gap forming layer 41*a* (41*b*) is located outside the end PEa (PEb) of the image forming portion 2 of the photoreceptor 1. The distance t between the inside end GEa (GEb) of the gap forming layer 41*a* (41*b*) and the end PEa (PEb) of the image forming portion 2 was 1 mm, which is greater than twice the gap g (i.e., the gap is from 50 to 250 $\mu$m in these examples) formed between the photoreceptor and the charger.

With respect to the photoreceptor of Comparative Example 1, the entire peripheral surface of the photoreceptor contacted the charger.

A running test in which 30,000 copies were continuously produced was performed using a laser diode emitting light having a wavelength of 780 nm and a polygon mirror. The charging conditions are as follows.

DC bias: −900V

AC bias: 2.0 kV (peak to peak voltage)
1.8 kHz (frequency)

The results are shown in Table 1.

Example 6

The procedures for preparation and evaluation of the charger and photoreceptor in Example 1 were repeated except that the rotating shafts of the charger and the driving roller were not fixed by the ring member and the charger and the photoreceptor were set in an image forming apparatus having the configuration as illustrated in FIG. 18.

Comparative Example 2

The procedures for preparation and evaluation of the charger and the photoreceptor in Example 2 were repeated except that the distance t between the inside edge GEa (GEb) of the gap forming layer 41*a* (41*b*) and the end PEa (PEb) of the image forming portion 2 was changed to 0 mm.

Example 7

The procedures for preparation and evaluation of the charger and the photoreceptor in Example 2 were repeated except that the distance t between the inside edge GEa (GEb) of the gap forming layer 41*a* (41*b*) and the end PEa (PEb) of the image forming portion 2 was changed to 0.3 mm.

Example 8

The procedures for preparation and evaluation of the charger and photoreceptor in Example 2 were repeated except that the distance t between the inside edge GEa (GEb) of the gap forming layer 41*a* (41*b*) and the end PEa (PEb) of the image forming portion 2 was changed to 0.5 mm.

Examples 9–13 and Comparative Example 3

The procedures for preparation and evaluation of the chargers and the photoreceptors in Examples 1 to 5 and Comparative Example 1 were repeated except that the photoreceptor A was replaced with the following photoreceptor B.

Preparation of Photoreceptor B

The procedure for preparation of the photoreceptor A was repeated except that a seamless nickel belt was used as the electroconductive substrate and an undercoat layer having a thickness of 3.5 $\mu$m was formed between the substrate and the CGL by coating and drying the following undercoat layer coating liquid.

| Undercoat layer coating liquid | |
|---|---|
| Titanium oxide powder | 400 |
| Melamine resin | 65 |
| Alkyd resin | 120 |
| 2-butanone | 400 |

The procedure for evaluation in Example 1 was repeated to evaluate the combination of the charger and the photoreceptor of each of Examples 9 to 13 and Comparative Example 3.

The results are also shown in Table 1.

Example 14

The procedures for preparation and evaluation of the charger and the photoreceptor in Example 9 were repeated except that the ring member was not used in the image forming apparatus.

The results are also shown in Table 1.

TABLE 1

| | Initial image qualities | Image qualities of the 30,000$^{th}$ image |
|---|---|---|
| Ex. 1 | Good | Good |
| Ex. 2 | Good | Good |
| Ex. 3 | Good | Good |
| Ex. 4 | Good | Slightly uneven density image was formed. |
| Ex. 5 | Good | Slightly undesired image due to abnormal discharging was formed. |
| Comp. Ex. 1 | Good | Slightly undesired images due to toner filming were formed. |
| Ex. 6 | Good | Slightly density image due to partially uneven discharging was formed. |
| Comp. Ex. 2 | Good | Uneven images were formed on both sides of the copy sheet. In addition, background fouling was observed. |
| Ex. 7 | Good | Good |
| Ex. 8 | Good | Good |
| Ex. 9 | Good | Good |
| Ex. 10 | Good | Good |
| Ex. 11 | Good | Good |
| Ex. 12 | Good | Slightly uneven density image due to uneven discharging was formed. |
| Ex. 13 | Good | Slightly undesired image due to abnormal discharging was formed. |
| Ex. 14 | Good | Slightly density image due to partially uneven discharging was formed. |
| Comp. Ex. 3 | Good | Undesired image due to toner filming was formed. |

Example 15

The procedures for preparation and evaluation of the charger and the photoreceptor in Example 1 were repeated except that the AC bias was not applied in the charging operation.

As a result of the running test, the 30,000$^{th}$ image was good. However, when half tone images were reproduced after the running test, the half tone images had slightly uneven image density due to uneven charging although the half tone images were still acceptable.

Example 16

Preparation of Charger

An electroconductive roller was prepared by the following method described in Japanese Patent No. 2,632,578.

The following components were mixed to prepare a rubber composition having a hardness of 20 Hs for use as the electroconductive elastic layer.

| | |
|---|---|
| Polynorbornene rubber | 100 |
| Ketjen Black | 50 |
| Naphthenic oil | 400 |

The following components were mixed to prepare a composition for use as a migration preventing layer.

| | |
|---|---|
| N-methoxymethylated nylon | 100 |
| Carbon black | 15 |

The following components were mixed to prepare a composition for use as a resistance controlling layer.

| | |
|---|---|
| Epichlorohydrin-ethyleneoxide rubber | 100 |
| $Pb_3O_4$ | 5 |
| Ethylene urea | 1.2 |
| Additive | 1 |
| Hard clay | 40 |

The composition was kneaded using a roll mill, and then dissolved in a mixture solvent of methyl ethyl ketone and methyl isobutyl ketone (the mixing ratio is 3:1) to prepare a resistance controlling layer coating liquid. The viscosity of the coating liquid was 300 cps.

On a periphery surface of a metal shaft having a diameter of 8 mm, an adhesive was coated and then an electroconductive elastic layer was formed using a molding method. In this case, the electroconductive elastic layer was vulcanized. The diameter of the shaft having the electroconductive elastic layer was 15 mm.

Then a coating liquid including the migration preventing layer composition was coated thereon by a spray coating method and then dried to form a migration preventing layer having a thickness of from 6 to 10 $\mu$m.

Next, the above-prepared resistance controlling layer coating liquid was dip-coated thereon to form a resistance controlling layer and then dried. The thus formed resistance controlling layer was then heated so as to be crosslinked.

Thus, an electroconductive roller was prepared.

Preparation of Photoreceptor C

On an aluminum cylinder, the following undercoat layer coating liquid, charge generation layer coating liquid and charge transport layer coating liquid were coated and dried one by one to form an undercoat layer having a thickness of 4.0 μm, a CGL having a thickness of 0.2 μm and a CTL having a thickness of 27 μm on the aluminum cylinder.

In addition, the gap forming layer coating liquid mentioned below was coated on both ends of the photoreceptor by a spray coating method while the image forming portion of the photoreceptor was masked. Thus, a gap forming layer having a thickness of 80 μm was formed on both ends of the photoreceptor. In this case the distance t was 1 mm.

| Undercoat layer coating liquid | |
|---|---|
| Titanium oxide powder | 400 |
| Melamine resin | 65 |
| Alkyd resin | 120 |
| 2-butanone | 400 |
| Charge generation layer coating liquid | |
| Trisazo pigment having the following formula (b) | 10 |

(b)

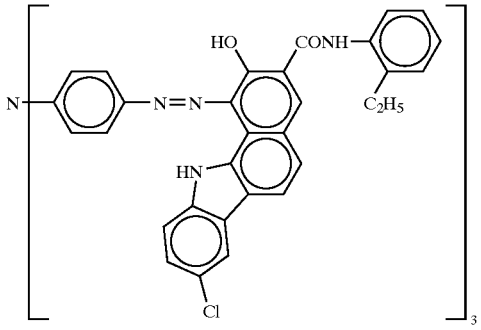

-continued

| | |
|---|---|
| Polyvinyl butyral | 4 |
| 2-butanone | 200 |
| Cyclohexanone | 400 |
| Charge transport layer coating liquid | |
| Polycarbonate | 10 |
| Charge transport material having the following formula (c) | 8 |

(c)

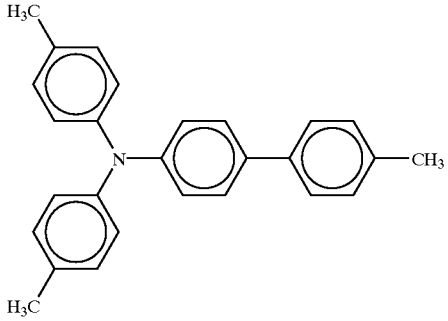

| | |
|---|---|
| Methylene chloride | 30 |

Example 17

The procedures for preparation of the charger and the photoreceptor in Example 16 were repeated except that the charge transport layer coating liquid was replaced with the following.

| Charge transport layer coating liquid | |
|---|---|
| Charge transport polymer having the following formula (d) | 8 |

(d)

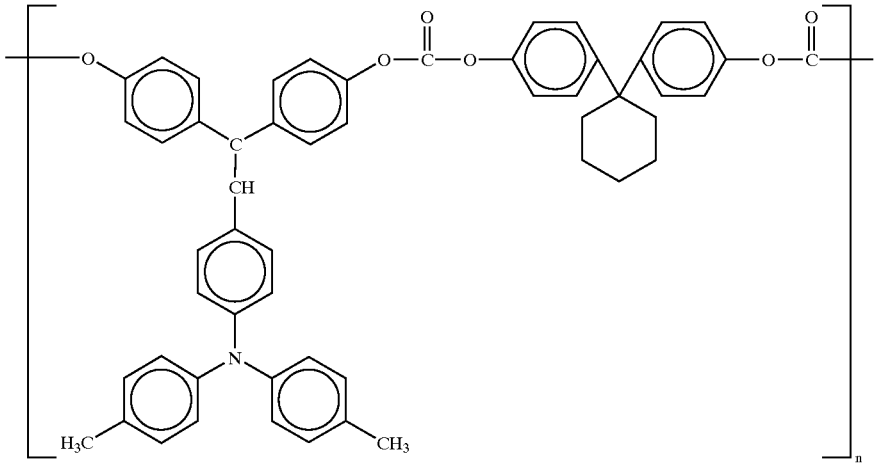

| | |
|---|---|
| Methylene chloride | 80 |

Example 18

The procedures for preparation of the charger and the photoreceptor in Example 16 were repeated except that the following protective layer coating liquid was coated on the CTL and dried to form a protective layer having a thickness of 2 μm.

| Protective layer coating liquid | |
|---|---|
| Charge transport polymer having formula (d) | 4 |
| Z-form polycarbonate | 4 |
| Methylene chloride | 80 |

Example 19

The procedures for preparation of the charger and the photoreceptor C in Example 16 were repeated except that the following protective layer coating liquid was coated on the charge transport layer and dried to form a protective layer having a thickness of 2 μm.

| Protective layer coating liquid | |
|---|---|
| Charge transport polymer having formula (d) | 4 |
| Z-form polycarbonate | 4 |
| Titanium oxide | 1 |
| Methylene chloride | 80 |

Comparative Example 4

The procedures for preparation of the charger and the photoreceptor in Example 16 were repeated except that the gap forming layers were not formed on the photoreceptor.

Comparative Example 5

The procedures for preparation of the charger and the photoreceptor in Example 17 were repeated except that the gap forming layers were not formed on the photoreceptor.

Comparative Example 6

The procedures for preparation of the charger and the photoreceptor in Example 18 were repeated except that the gap forming layers were not formed on the photoreceptor.

Comparative Example 7

The procedures for preparation of the charger and the photoreceptor in Example 19 were repeated except that the gap forming layers were not formed on the photoreceptor.

Evaluation Method

Each combination of the charger and the photoreceptor in Examples 16 to 19 and Comparative Examples 4 to 7 was evaluated using an image forming apparatus having the configuration as illustrated in FIG. 17, in which as shown in FIGS. 13 and 14 gears were arranged on the rotating shafts of the cylindrical photoreceptor and the charger and springs were provided on the rotating shaft of the charger to press the charger toward the photoreceptor.

In this case, the photoreceptor and the charger were set such that as illustrated in FIG. 5 the inside edge GEa (GEb) of the gap forming layer 41*a* (41*b*) is located outside the end PEa (PEb) of the image forming portion 2 of the photoreceptor. The distance t between the inside end GEa (GEb) of the gap forming layer 41*a* (41*b*) and the end PEa (PEb) of the image forming portion 2 was 1 mm, which is greater than twice the gap g (i.e., 80 μm) formed between the photoreceptor and the charger.

With respect to the photoreceptors of Comparative Examples 4 to 7, the entire peripheral surface of the photoreceptors contacted the charger.

A running test in which 50,000 copies were continuously produced was performed using a laser diode emitting light having a wavelength of 780 nm and a polygon mirror. The image qualities of the initial images and $50{,}000^{th}$ image were evaluated. In addition, the abrasion quantity of the surface of the photoreceptor was also measured. The charging conditions are as follows.

DC bias: −850V

AC bias: 1.8 kV (peak to peak voltage)

2.2 kHz (frequency)

The results are shown in Table 2.

Example 20

The procedures for preparation and evaluation of the charger and the photoreceptor in Example 16 were repeated except that the springs pressing the charger were not used.

The results are shown in Table 2.

Example 21

The procedures for preparation and evaluation of the charger and the photoreceptor in Example 16 were repeated except that as shown in FIG. 13 the photoreceptor was frictionally driven by the charger without using the gears.

The results are shown in Table 2.

Example 22

The procedures for preparation and evaluation of the charger and the photoreceptor in Example 16 were repeated except that the charger rotated faster than the photoreceptor whereas the charger and photoreceptor rotated at the same speed in Example 16.

The results are shown in Table 2.

Examples 23 to 26 and Comparative Examples 8 to 11

The procedures for preparation of the photoreceptors and the chargers in Examples 16 to 19 and Comparative Examples 4 to 7 were repeated except that the substrate of the photoreceptor was changed from the aluminum cylinder to a nickel seamless belt to prepare endless photoreceptors of Examples 23 to 26 and Comparative Examples 8 to 11.

Evaluation

Each combination of the charging roller and the photoreceptor was set in an image forming apparatus having the configuration as illustrated in FIG. 18, in which gears were provided on the rotating shafts of the driving roller supporting the endless photoreceptor and the charger, and in addition springs were provided on the rotating shaft of the charger to press the charger toward the photoreceptor.

In this case, the photoreceptor and the charger were set such that as illustrated in FIG. 5 the inside edge GEa (GEb)

of the gap forming layer 41*a* (41*b*) is located outside the end PEa (PEb) of the image forming portion 2 of the photoreceptor 1. The distance t between the inside end GEa (GEb) of the gap forming layer 41*a* (41*b*) and the end PEa (PEb) of the image forming portion 2 was 1 mm, which is greater than twice the gap g (i.e., the gap is 80 μm in these examples) formed between the photoreceptor and the charger.

With respect to the chargers of Comparative Examples 8 to 11, the entire peripheral surface of the endless photoreceptor contacted the chargers.

A running test in which 50,000 copies were continuously produced was performed using a laser diode emitting light having a wavelength of 780 nm and a polygon mirror. The image qualities of the initial images and 50,000$^{th}$ image were evaluated. In addition, the abrasion quantity of the surface of the photoreceptor was also measured after the running test. The charging conditions are as follows.

DC bias: −850V

AC bias: 1.8 kV (peak to peak voltage)
2.2 kHz (frequency)

The results are also shown in Table 2.

Example 27

The procedures for preparation and evaluation of the charger and the photoreceptor in Example 23 were repeated except that the springs pressing the charger were not used.

The results are shown in Table 2.

Example 28

The procedures for preparation and evaluation of the charger and the photoreceptor in Example 23 were repeated except that as illustrated in FIG. 13 the photoreceptor was frictionally driven by the charger without using the gears.

The results are shown in Table 2.

Example 29

The procedures for preparation and evaluation of the charger and the photoreceptor in Example 23 were repeated except that the charger rotated faster than the photoreceptor whereas the charger and photoreceptor rotated at the same speed in Example 23.

The results are shown in Table 2.

TABLE 2

| | Image qualities of the initial images | Image qualities of the 50,000$^{th}$ image | Abrasion quantity (μm) |
|---|---|---|---|
| Ex. 16 | Good | Faint black streaks were formed but the image was still acceptable. | 4.2 |
| Ex. 17 | Good | Good | 1.7 |
| Ex. 18 | Good | Good | 1.3 |
| Ex. 19 | Good | Good | 0.6 |
| Ex. 20 | Good | Slightly uneven density due to partially uneven charging image was formed. | 3.9 |

TABLE 2-continued

| | Image qualities of the initial images | Image qualities of the 50,000$^{th}$ image | Abrasion quantity (μm) |
|---|---|---|---|
| Ex. 21 | Good | Good. However, since it was needed to increase the pressure applied to the charger, the abrasion quantity of the gap layers was large. | 4.5 |
| Ex. 22 | Good | Good. However, the abrasion quantity of the gap layers was large. | 4.7 |
| Comp. Ex. 4 | Good | Undesired image due to toner filming was produced. | 4.0 |
| Comp. Ex. 5 | Good | Undesired image due to toner filming was produced. | 1.6 |
| Comp. Ex. 6 | Good | Undesired image due to toner filming was produced. | 1.2 |
| Comp. Ex. 7 | Good | Undesired image due to toner filming was produced. | 0.5 |
| Ex. 23 | Good | Faint black streaks were formed but the image was still acceptable. | 1.7 |
| Ex. 24 | Good | Good | 0.7 |
| Ex. 25 | Good | Good | 0.5 |
| Ex. 26 | Good | Good | 0.3 |
| Ex. 27 | Good | Slightly uneven density image due to partially uneven charging was formed. | 1.6 |
| Ex. 28 | Good | Good. However, since it was needed to increase the pressure applied to the charger, the abrasion quantity of the gap layers was large. | 1.9 |
| Ex. 29 | Good | Good. However, the abrasion quantity of the gap layers was large. | 2.0 |
| Comp. Ex. 8 | Good | Undesired image due to toner filming was produced. | 1.6 |
| Comp. Ex. 9 | Good | Undesired image due to toner filming was produced. | 0.7 |
| Comp. Ex. 10 | Good | Undesired image due to toner filming was produced. | 0.5 |
| Comp. Ex. 11 | Good | Undesired image due to toner filming was produced. | 0.2 |

Example 30

The procedures for preparation and evaluation of the charger and the photoreceptor in Example 16 were repeated except that the AC bias was not applied in the charging operation.

As a result of the running test, the 50,000$^{th}$ image was good. However, when half tone images were reproduced after the running test, the half tone images had slightly uneven image density due to uneven charging although the images were still acceptable.

Example 31

Preparation of Charger

An electroconductive roller was prepared by the following method mentioned in Example 4 of Japanese Laid-Open Patent Publication No. 5-341627.

A urethane rubber layer was formed on a shaft having a diameter of 6 mm to form a roller having an elastic layer and a diameter of 12 mm. The resistance of the elastic layer was $8\times10^9$ Ω·cm.

Then the following resistance controlling layer coating liquid was coated thereon and then dried to form a resistance controlling layer having a thickness of 40 um and a resistance of $2\times10^9$ Ω·cm.

| | |
|---|---|
| Urethane rubber solution (solid content of 2.5% by weight) | 100 |
| Silicone resin solution (solid content of 7.5% by weight) | 50 |
| Carbon black | 2 |

Thus an electroconductive roller was prepared.

A high density polyethylene film having a thickness of 60 μm was adhered on the edge portions of the photoreceptor using an adhesive. The thickness of the overlapped portions of the polyethylene film was decreased to form a gap forming material having an even thickness.

Thus a photoreceptor having gap forming materials having a thickness of 60 μm was prepared. In this photoreceptor, the distance t was 2 mm.

Preparation of Photoreceptor D

The surface of an aluminum cylinder was anodized and then sealed. On the thus anodized aluminum cylinder, the following charge generation layer coating liquid and charge transport layer coating liquid were coated and dried one by one to form a CGL having a thickness of 0.2 μm and a CTL having a thickness of 23 μm.

Charge generation layer coating liquid

Charge generation material having the following formula (e) 1

(e)

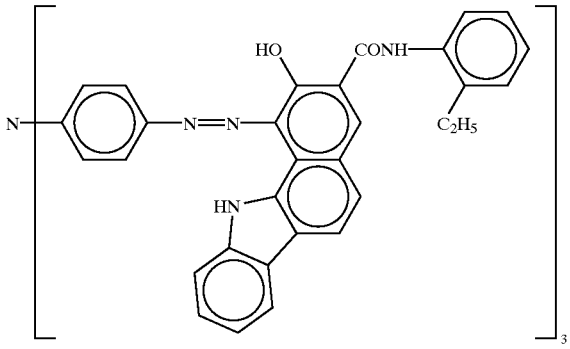

Charge generation material having the following formula (f) 1

(f)

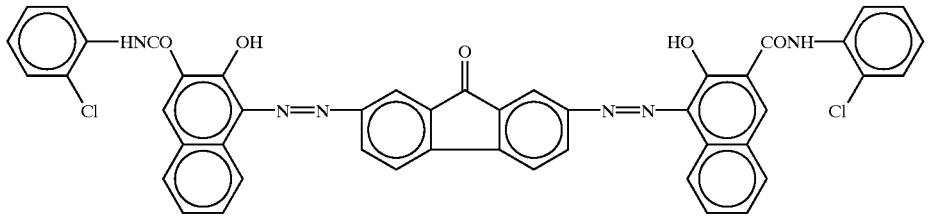

| | |
|---|---|
| Polyvinyl butyral | 1 |
| Cyclohexanone | 70 |
| Cyclohexane | 30 |

Charge transport layer coating liquid

Charge transport material having the following formula (g) 7

(g)

-continued

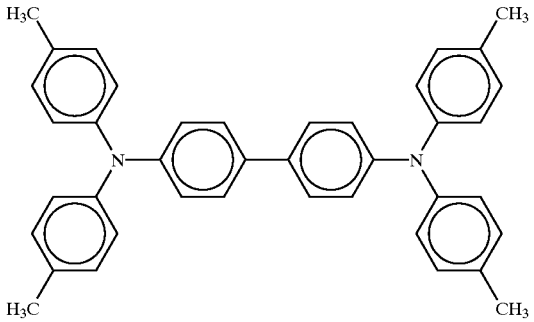

| | |
|---|---|
| Polycarbonate | 10 |
| Tetrahydrofuran | 100 |

Example 32

The procedures for preparation of the charger and the photoreceptor in Example 31 were repeated except that the seam of the gap forming materials made of the high molecular weight polyethylene film was changed to a slant seam as illustrated in FIG. 10A.

Example 33

The procedures for preparation of the charger and the photoreceptor in Example 31 were repeated except that the gap forming materials were changed to gap forming materials which was prepared by winding a nylon fishing gut including a fluorine-containing resin and having a diameter of 100 μm around both the edge portions of the roller such that the gut was not overlapped, and then fixing the wound gut with an adhesive.

Example 34

The procedures for preparation of the charger and the photoreceptor in Example 31 were repeated except that a seamless nickel belt was used as the gap forming materials without using the polyethylene film.

Comparative Example 12

The procedures for preparation of the charger and the photoreceptor in Example 31 were repeated except that the gap forming materials were not formed.

Evaluation Method

Each combination of the photoreceptor and the charger in Example 31 to 34 and Comparative Example 12 was set in a process cartridge having the construction as shown in FIG. 19 such that as illustrated in FIG. 14 gears were provided on the rotating shaft of the photoreceptor and the charger and springs were provided on the rotating shaft of the charger to press the charger toward the photoreceptor.

In this case, the photoreceptor and the charger were set such that as illustrated in FIG. 5 the inside edge GEa (GEb) of the gap forming material is located outside the end PEa (PEb) of the image forming portion 2 of the photoreceptor 1. The distance t between the inside edge GEa (GEb) of the gap forming material and the end PEa (PEb) of the image forming portion 2 was 2 mm, which is greater than twice the gap g (i.e., 60–100 μm) formed between the photoreceptor and the charger.

With respect to the chargers of Comparative Example 12, the entire peripheral surface of the photoreceptor contacted the charger.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: μ850V

AC bias: 1.8 kV (peak to peak voltage)
2.2 kHz (frequency)

The results are also shown in Table 3.

Example 35

The procedures for preparation and evaluation of the charger and the photoreceptor in Example 31 were repeated except that the springs pressing the rotating shaft of the charger were not used.

The results are also shown in Table 3.

Example 36

The procedures for preparation and evaluation of the charger and the photoreceptor in Example 31 were repeated except that the photoreceptor was frictionally driven by the charger without using the gears.

The results are also shown in Table 3.

Example 37

The procedures for preparation and evaluation of the charger and the photoreceptor in Example 31 were repeated except that the charger rotated faster than the photoreceptor whereas the charger and photoreceptor rotated at the same speed in Example 31

The results are also shown in Table 3.

TABLE 3

| | Potential (At the beginning of the running test) (V) | Potential (At the end of the 20000-sheet running test) (V) | Image qualities of the half tone images |
|---|---|---|---|
| Ex. 31 | −842 | −837 | Good |
| Ex. 32 | −838 | −835 | Good |
| Ex. 33 | −840 | −830 | Good |
| Ex. 34 | −818 | −802 | Slightly undesired image due to slightly abnormal charging was produced. |
| Ex. 35 | −832 | −828 | Slightly uneven density image was formed. |
| Ex. 36 | −828 | −827 | Slightly uneven density image was formed. |
| Ex. 37 | −830 | −829 | Good. However, the abrasion quantity of the gap forming materials was large. |
| Comp. Ex. 12 | −843 | −798 | Uneven density image was formed. |

Example 38

The procedures for preparation and evaluation of the charger and the photoreceptor in Example 31 was repeated except that the AC bias was not applied.

As a result of the running test, the 20,000$^{th}$ image was good. When half tone images were produced after the running test, the half tone images had slightly uneven density due to uneven charging although the half tone images were still acceptable.

Examples of the Second Embodiment

Example 39

Preparation of Photoreceptor E

On the surface of an aluminum cylinder, the following charge generation layer coating liquid and charge transport layer coating liquid were coated and dried one by one to form a CGL having a thickness of 0.3 μm and a CTL having a thickness of 50 μm. Then the central portion of the CTL of the photoreceptor was ground by a grinder such that the depth of the recessed portion was 25 μm and the width thereof was longer than the image forming portion by 1 mm at each end of the image forming portion. Namely, the distance t in FIG. 24 was 1 mm. Thus a photoreceptor having gap forming members on both ends thereof was prepared.

| Charge generation layer coating liquid | |
|---|---|
| Titanyl phthalocyanine | 3 |
| Polyvinyl butyral | 2 |
| n-butyl acetate | 100 |

-continued

| Charge transport layer coating liquid | |
|---|---|
| A-form polycarbonate | 10 |
| Charge transport material having the following formula (h) | 8 |
| Methylene chloride | 80 |

(h)

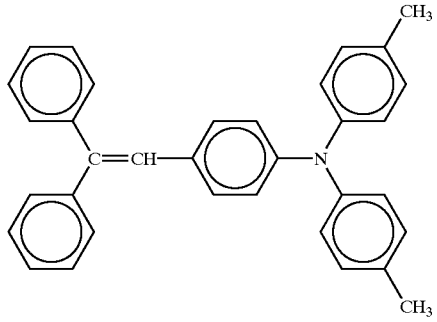

Example 40

The procedure for preparation of the photoreceptor in Example 39 was repeated except that the thickness of the CTL was changed to 75 μm and the CTL was ground by 50 μm (i.e., the depth of the recessed portion was 50 μm).

Example 41

The procedure for preparation of the photoreceptor in Example 39 was repeated except that the thickness of the CTL was changed to 100 μm and the CTL was ground by 75 μm (i.e., the depth of the recessed portion was 75 μm).

Example 42

The procedure for preparation of the photoreceptor in Example 39 was repeated except that the thickness of the CTL was changed to 125 μm and the CTL was ground by 100 μm (i.e., the depth of the recessed portion was 100 μm).

Comparative Example 13

The procedure for preparation of the photoreceptor in Example 39 was repeated except that the thickness of the CTL was changed to 25 μm and the CTL was not ground.

Evaluation Method

Each of the drum-form photoreceptors of Examples 39 to 42 and Comparative Example 13 was set in an image forming apparatus in which the rotating shafts of the photoreceptor and charger were fixed with a ring member as illustrated in FIGS. 25 and 26.

In this case, the photoreceptor and the charger were set such that as illustrated in FIG. 24 the inside edge GEa (GEb) of the gap forming material 237*a* (237*b*) is located outside the end PEa (PEb) of the image forming portion 2 of the photoreceptor 1. The distance t between the inside edge GEa (GEb) of the gap forming layer 237*a* (237*b*) and the end PEa (PEb) of the image forming portion 2 was 1 mm, which is greater than twice the gap g (i.e., 25 μm) formed between the photoreceptor and the charger.

With respect to the charger of Comparative Example 13, the entire peripheral surface of the photoreceptor contacted the charger.

A running test in which 30,000 copies were continuously produced was performed using a laser diode emitting light having a wavelength of 780 nm and a polygon mirror. The image qualities were checked at the beginning and end of the running test. In addition, abrasion quantity of the photosensitive layer was also measured. The charging conditions are as follows.

DC bias: −900V

AC bias: 2.0 kv (peak to peak voltage)
1.8 kHz (frequency)

The results are also shown in Table 4.

Example 43

The procedures for preparation and evaluation of the photoreceptor in Example 39 were repeated except that the configuration of the image forming apparatus illustrated in FIGS. 25 and 26 was changed to the configuration as illustrated in FIG. 17 in which the charger and photoreceptor were not fixed by the ring member.

The results are also shown in Table 4.

Comparative Example 14

The procedures for preparation and evaluation of the photoreceptor in Example 39 were repeated except that the location of the inside edge GEa (GEb) of the gap forming member 237*a* (237*b*) and the end PEa (PEb) of the image forming portion 2 was the same (i.e., the distance t was 0 mm).

The results are also shown in Table 4.

Example 44

The procedures for preparation and evaluation of the photoreceptor in Example 39 were repeated except that the distance t was 0.3 mm.

The results are also shown in Table 4.

Example 45

The procedures for preparation and evaluation of the photoreceptor in Example 39 were repeated except that the distance t was 0.5 mm.

The results are also shown in Table 4.

TABLE 4

| | Image qualities (at the beginning of the running test) | Image qualities (at the end of the 30000-sheet running test) |
|---|---|---|
| Ex. 39 | Good | Good |
| Ex. 40 | Good | Good |
| Ex. 41 | Good | Good |
| Ex. 42 | Good | Good |
| Ex. 43 | Good | Slightly uneven density image due to partially uneven charging was formed. |
| Ex. 44 | Good | Good |
| Ex. 45 | Good | Good |
| Comp. Ex. 13 | Good | Undesired images were produced due to formation of toner film. |
| Comp. Ex. 14 | Good | Uneven images were observed at both edges of the copy. |

TABLE 4-continued

| | Image qualities (at the beginning of the running test) | Image qualities (at the end of the 30000-sheet running test) |
|---|---|---|
| | | In addition, background fouling was observed. |

As clearly understood from Table 4, images having good image qualities can be produced by the photoreceptors of Examples 39 to 42 and 44 and 45 even after repeated use.

Example 46

The procedures for preparation and evaluation of the photoreceptor in Example 39 were repeated except that the charging was performed without applying an AC bias in the image forming apparatus as illustrated in FIG. 17.

As a result of the running test, the 30,000$^{th}$ image was good. When half tone images were produced after the running test, the half tone images had slightly uneven density due to uneven charging although the half tone images were still acceptable.

Example 47

Preparation of Photoreceptor F

On the surface of an aluminum cylinder, the following undercoat layer coating liquid, charge generation layer coating liquid and charge transport layer coating liquid were coated and dried one by one to form an undercoat layer having a thickness of 4.0 μm, a CGL having a thickness of 0.2 μm and a CTL having a thickness of 107 μm. Then the central portion of the CTL of the photoreceptor was cut by a turning tool such that the depth of the recessed portion was 80 μm and the width thereof was longer than the image forming portion by 2 mm at each end of the image forming portion. Namely, the distance t in FIG. 24 was 2 mm. Thus, a photoreceptor F having gap forming members on both ends thereof was prepared.

| | |
|---|---|
| Undercoat layer coating liquid | |
| Titanium oxide powder | 400 |
| Melamine resin | 65 |
| Alkyd resin | 120 |
| 2-butanone | 400 |
| Charge generation layer coating liquid | |
| Trisazo pigment having formula (b) | 10 |
| Polyvinyl butyral | 4 |
| 2-butanone | 200 |
| Cyclohexanone | 400 |

-continued

| Charge transport layer coating liquid | |
|---|---|
| Polycarbonate | 10 |
| Charge transport material having the following formula (J) | 8 |
| Methylene chloride | 70 |

(J)

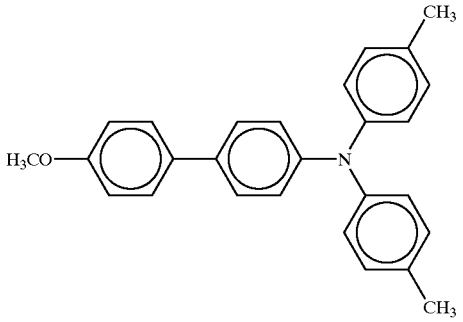

Example 48

The procedure for preparation of the photoreceptor in Example 47 was repeated except that the charge transport layer coating liquid was replaced with the following.

| Charge transport layer coating liquid | |
|---|---|
| Charge transport material having formula (d) | 8 |
| Methylene chloride | 70 |

Example 49

The procedure for preparation of the photoreceptor in Example 47 was repeated except that the thickness of the CTL was changed to 27 μm and a protective layer having a thickness of 82 μm was formed on the CTL, and then the central portion of the protective layer was cut by a turning tool by 80 μm.

| Protective layer coating liquid | |
|---|---|
| Charge transport polymer having formula (d) | 4 |
| Z-form polycarbonate | 4 |
| Methylene chloride | 70 |

Example 50

The procedure for preparation of the photoreceptor in Example 47 was repeated except that the thickness of the CTL was changed to 27 μm and a protective layer having a thickness of 82 μm was formed on the CTL, and then the central portion of the protective layer was cut by a turning tool by 80 μm.

| Protective layer coating liquid | |
|---|---|
| Charge transport polymer having formula (d) | 4 |
| Z-form polycarbonate | 4 |
| Titanium oxide | 1 |
| Methylene chloride | 70 |

Comparative Example 15

The procedure for preparation of the photoreceptor in Example 47 was repeated except that the thickness of the CTL was changed to 27 μm and the cutting operation on the surface of the CTL was not performed.

Comparative Example 16

The procedure for preparation of the photoreceptor in Example 48 was repeated except that the thickness of the CTL was changed to 27 μm and the cutting operation on the surface of the CTL was not performed.

Comparative Example 17

The procedure for preparation of the photoreceptor in Example 49 was repeated except that the thickness of the protective layer was changed to 2 μm and the cutting operation on the surface of the protective layer was not performed.

Comparative Example 18

The procedure for preparation of the photoreceptor in Example 50 was repeated except that the thickness of the protective layer was changed to 2 μm and the cutting operation on the surface of the protective layer was not performed.

Evaluation

Each of the photoreceptors of Examples 47 to 50 and Comparative Examples 15 to 18 was set in an image forming apparatus having the configuration as illustrated in FIG. 28, in which gears were provided on the rotating shafts of the photoreceptor and the charger, and in addition springs were provided on the rotating shaft of the charger to press the charger toward the photoreceptor.

The photoreceptors of Comparative Examples 15 to 18 contacted the peripheral surface of the charger because the gap forming members were not provided.

A running test in which 50,000 copies were continuously produced was performed using a laser diode emitting light having a wavelength of 780 nm and a polygon mirror. The image qualities of the initial images and $50{,}000^{th}$ image were evaluated. In addition, the abrasion quantity of the surface of the photoreceptor was also measured. The charging conditions are as follows.

DC bias: −850V

AC bias: 1.8 kV (peak to peak voltage)
2.2 kHz (frequency)

The results are shown in Table 5.

Example 51

The procedures for preparation and evaluation of the photoreceptor in Example 47 were repeated except that the springs pressing the charger were not used.

The results are shown in Table 5.

Example 52

The procedures for preparation and evaluation of the photoreceptor in Example 47 were repeated except that as illustrated in FIG. 27 the photoreceptor was frictionally driven by the charger without using the gears.

The results are shown in Table 5.

Example 53

The procedures for preparation and evaluation of the photoreceptor in Example 47 were repeated except that the charger rotated faster than the photoreceptor whereas the charger and photoreceptor rotated at the same speed in Example 47.

The results are shown in Table 5.

TABLE 5

| | Image qualities (at the beginning of the running test) | Image qualities (at the end of the 50000-sheet running test) | Abrasion ($\mu$m) |
|---|---|---|---|
| Ex. 47 | Good | Faint black streaks were formed but the image was still acceptable. | 4.3 |
| Ex. 48 | Good | Good | 1.8 |
| Ex. 49 | Good | Good | 1.4 |
| Ex. 50 | Good | Good | 0.6 |
| Ex. 51 | Good | Slightly uneven density image due to partially uneven charging was formed. | 4.0 |
| Ex. 52 | Good | Good. However, since it was needed to increase the pressure applied to the charger, the abrasion quantity of the gap forming members was large. | 4.6 |
| Ex. 53 | Good | Good. However, the abrasion quantity of the gap forming members was large. | 4.7 |
| Comp. Ex. 15 | Good | Undesired image due to toner filming was produced. | 4.1 |
| Comp. Ex. 16 | Good | Undesired image due to toner filming was produced. | 1.7 |
| Comp. Ex. 17 | Good | Undesired image due to toner filming was produced. | 1.3 |
| Comp. Ex. 18 | Good | Undesired image due to toner filming was produced. | 0.5 |

Example 54

The procedures for preparation and evaluation of the charger and the photoreceptor in Example 47 were repeated except that the AC bias was not applied in the charging operation.

As a result of the running test, the 50,000$^{th}$ image was good. However, when half tone images were reproduced after the running test, the half tone images had slightly uneven image density due to uneven charging although the images were still acceptable.

Example 55

Preparation of Photoreceptor G

The surface of an aluminum cylinder was anodized and then sealed. On the thus anodized aluminum cylinder, the following charge generation layer coating liquid and charge transport layer coating liquid were coated and dried one by one to form a CGL having a thickness of 0.2 $\mu$m and a CTL having a thickness of 83 $\mu$m.

Then the central portion of the CTL of the photoreceptor was cut by a turning tool such that the depth of the recessed portion was 60 $\mu$m and the width thereof was longer than the image forming portion by 1 mm at each end. Namely, the distance t in FIG. 24 was 1 mm. Thus a photoreceptor G having gap forming members on both ends thereof was prepared.

| Charge generation layer coating liquid | |
|---|---|
| Charge generation material formula (e) | 1 |
| Charge generation material having formula (f) | 1 |
| Polyvinyl butyral | 1 |
| Cyclohexanone | 70 |
| Cyclohexane | 30 |
| Charge transport layer coating liquid | |
| Charge transport material having formula (a) | 7 |
| Polycarbonate | 10 |
| Tetrahydrofuran | 100 |

Example 56

The procedure for preparation of the photoreceptor in Example 55 was repeated except that the charge transport layer coating liquid was replaced with the following.

| Charge transport layer coating liquid | |
|---|---|
| Charge transport polymer having formula (d) | 8 |
| Methylene chloride | 70 |

Example 57

The procedure for preparation of the photoreceptor in Example 55 was repeated except that the thickness of the CTL was changed to 21 $\mu$m and a protective layer having a thickness of 62 $\mu$m was formed on the CTL and then the central portion of the protective layer was cut by a turning tool by 60 $\mu$m.

| Protective layer coating liquid | |
|---|---|
| Charge transport polymer having formula (d) | 4 |
| Z-form polycarbonate | 4 |
| Methylene chloride | 70 |

Example 58

The procedure for preparation of the photoreceptor in Example 55 was repeated except that the thickness of the CTL was changed to 21 μm and a protective layer having a thickness of 62 μm was formed on the CTL, and then the central portion of the protective layer was cut by a turning tool by 60 μm.

| Protective layer coating liquid | |
|---|---|
| Charge transport polymer having formula (d) | 4 |
| Z-form polycarbonate | 4 |
| Titanium oxide | 1 |
| Methylene chloride | 70 |

Comparative Example 19

The procedure for preparation of the photoreceptor in Example 55 was repeated except that the thickness of the CTL was changed to 23 μm and the cutting operation on the surface of the CTL was not performed.

Evaluation Method

Each of the photoreceptor in Example 55 to 58 and Comparative Example 19 was set in a process cartridge having the configuration as illustrated in FIG. 19 such that gears were provided on the rotating shaft of the photoreceptor and the charger and springs were provided on the rotating shaft of the charger to press the charger toward the photoreceptor.

The entire peripheral surface of the photoreceptor of Comparative Example 19 contacted the charger.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −850V

AC bias: 1.8 kV (peak to peak voltage)
2.2 kHz (frequency)

The results are also shown in Table 6.

Example 59

The procedures for preparation and evaluation of the photoreceptor in Example 55 were repeated except that the springs pressing the rotating shaft of the charger were not used.

The results are also shown in Table 6.

Example 60

The procedures for preparation and evaluation of the photoreceptor in Example 55 were repeated except that the photoreceptor was frictionally driven by the charger without using the gears.

The results are also shown in Table 6.

Example 61

The procedures for preparation and evaluation of the photoreceptor in Example 55 were repeated except that the charger rotated faster than the photoreceptor whereas the charger and photoreceptor rotated at the same speed in Example 55.

The results are also shown in Table 6.

TABLE 6

| | Potential (At the beginning of the running test) (V) | Potential (At the end of the 20000-sheet running test) (V) | Image qualities of the half tone images |
|---|---|---|---|
| Ex. 55 | −850 | −845 | Good |
| Ex. 56 | −845 | −840 | Good |
| Ex. 57 | −845 | −845 | Good |
| Ex. 58 | −845 | −840 | Good |
| Ex. 59 | −840 | −835 | Good |
| Ex. 60 | −835 | −830 | Good |
| Ex. 61 | −835 | −830 | Good |
| Comp. Ex. 19 | −850 | −810 | Uneven density image was formed. |

Example 62

The procedures for preparation and evaluation of the charger and the photoreceptor in Example 55 were repeated except that the AC bias was not applied in the charging operation. As a result of the running test, the $20{,}000^{th}$ image was good. However, when half tone images were reproduced after the running test, the half tone images had slightly uneven image density due to uneven charging although the images were still acceptable.

Examples of the Third Embodiment

Example 63

On an polyethylene terephthalate film (i.e., a PET film) in which both the end portions thereof corresponding to the non-image portion is thicker than the central portion corresponding to the image forming portion by 30 μm, a aluminum layer was deposited. Then the following charge generation layer coating liquid and charge transport layer coating liquid were coated thereon by a spray coating method and then dried one by one to form a CGL having a thickness of 0.3 μm and a CTL having a thickness of 25 μm.

Thus, a photoreceptor of the present invention was prepared.

| Charge generation layer coating liquid | |
|---|---|
| Titanyl phthalocyanine | 3 |
| Polyvinyl butyral | 2 |
| n-butyl acetate | 200 |
| Charge transport layer coating liquid | |
| C-form polycarbonate | 10 |
| Charge transport material having formula (h) | 8 |
| Tetrahydrofuran | 400 |
| Cyclohexanone | 200 |

Example 64

The procedure for preparation of the photoreceptor in Example 63 was repeated except that the thickness difference between the end portions and central portion of the PET film was changed from 30 μm to 50 μm.

Example 65

The procedure for preparation of the photoreceptor in Example 63 was repeated except that the thickness difference between the end portions and central portion of the PET film was changed from 30 μm to 80 μm.

Example 66

The procedure for preparation of the photoreceptor in Example 63 was repeated except that the thickness difference between the end portions and central portion of the PET film was changed from 30 μm to 100 μm.

Comparative Example 20

The procedure for preparation of the photoreceptor in Example 63 was repeated except that the thickness of the end portions was the same as that of the central portion of the PET film (i.e., the thickness difference was changed from 30 μm to 0 μm).

Evaluation Method

Each of the photoreceptors in Examples 63 to 66 and Comparative Example 20 was evaluated as follows.

The both ends of the photoreceptor were joined to each other to form an endless belt photoreceptor to be mounted in an image forming apparatus having the configuration as shown in FIGS. 34 and 35 (although the photoreceptor illustrated in FIGS. 34 and 35 is a drum photoreceptor, the photoreceptor in this case is a belt photoreceptor). Namely, the rotating shaft of a driving roller supporting and driving the endless belt photoreceptor and the rotating shaft of a charger were fixed using a ring member.

In this case, the photoreceptor and the charger were set such that as illustrated in FIG. 33 the inside end GEa (GEb) of the gap forming member 333*a* (333*b*) is located outside the end PEa (PEb) of the image forming portion 2 of the photoreceptor 1. The distance t between the inside end GEa (GEb) of the gap forming member 333*a* (333*b*) and the end PEa (PEb) of the image forming portion 2 was 1 mm, which is greater than twice the gap g (i.e., the gap is from 30 to 100 μm in these examples) formed between the photoreceptor and the charger.

With respect to the photoreceptor of Comparative Example 20, the entire peripheral surface of the photoreceptor contacted the charger.

A running test in which 30,000 copies were continuously produced was performed using a laser diode emitting light having a wavelength of 780 nm and a polygon mirror. The charging conditions are as follows.

DC bias: −900V

AC bias: 2.0 kV (peak to peak voltage)
2.0 kHz (frequency)

The results are shown in Table 7.

Example 67

The procedures for preparation and evaluation of the photoreceptor in Example 63 were repeated except that the rotating shafts of the charger and the driving roller were not fixed by the ring member and the charger and the photoreceptor were set in an image forming apparatus having the configuration as illustrated in FIG. 18.

The results are shown in Table 7.

Comparative Example 21

The procedures for preparation and evaluation of the photoreceptor in Example 63 were repeated except that the distance t between the inside edge GEa (GEb) of the gap forming member 333*a* (333*b*) and the end PEa (PEb) of the image forming portion 2 was changed to 0 mm.

The results are shown in Table 7.

Example 68

The procedures for preparation and evaluation of the photoreceptor in Example 63 were repeated except that the distance t between the inside edge GEa (GEb) of the gap forming member 333*a* (333*b*) and the end PEa (PEb) of the image forming portion 2 was changed to 0.3 mm.

The results are shown in Table 7.

Example 69

The procedures for preparation and evaluation of the photoreceptor in Example 63 were repeated except that the distance t between the inside edge GEa (GEb) of the gap forming member 333*a* (333*b*) and the end PEa (PEb) of the image forming portion 2 was changed to 0.5 mm.

The results are shown in Table 7.

TABLE 7

| | Initial image qualities | Image qualities of the 30,000th image |
|---|---|---|
| Ex. 63 | Good | Good |
| Ex. 64 | Good | Good |
| Ex. 65 | Good | Good |
| Ex. 66 | Good | Good |
| Ex. 67 | Good | Slightly undesired image due to partial uneven discharging was formed. |
| Ex. 68 | Good | Good |
| Ex. 69 | Good | Good |

TABLE 7-continued

| | Initial image qualities | Image qualities of the 30,000th image |
|---|---|---|
| Comp. Ex. 20 | Good | Undesired image due to toner filming was formed. |
| Comp. Ex. 21 | Good | Uneven images were formed on both sides of the copy sheet. In addition, background fouling was observed. |

As can be understood from Table 7, when the photoreceptors of Examples 63 to 66, 68 and 69 are used, images having good image qualities can be produced even after repeated use.

Example 70

The procedures for preparation and evaluation of the charger and the photoreceptor in Example 63 were repeated except that the AC bias was not applied in the charging operation.

As a result of the running test, the 30,000$^{th}$ image was good. However, when half tone images were reproduced after the running test, the half tone images had slightly uneven image density due to uneven charging although the half tone images were still acceptable.

Example 71

On an aluminum cylinder in which the central portion corresponding to the image forming portion was cut by a turning tool such that the central portion is thinner than the edge portions corresponding to the non-image portion by 50 μm, the following undercoat layer coating liquid, charge generation layer coating liquid and charge transport layer coating liquid were coated thereon by a spray coating method and then dried one by one to form an undercoat layer having a thickness of 4.0 μm, a CGL having a thickness of 0.2 μm and a CTL having a thickness of 27 μm.

Thus, a photoreceptor of the present invention was prepared.

| Undercoat layer coating liquid | |
|---|---|
| Titanium oxide powder | 400 |
| Melamine resin | 65 |
| Alkyd resin | 120 |
| 2-butanone | 1200 |
| Charge generation layer coating liquid | |
| Trisazo pigment having formula (b) | 5 |
| Polyvinyl butyral | 2 |
| 2-butanon | 200 |
| Cyclohexanone | 400 |
| Charge transport layer coating liquid | |
| Polycarbonate | 10 |
| Charge transport material having formula (J) | 8 |
| Tetrahydrofuran | 400 |
| Cyclohexanone | 200 |

Example 72

The procedure for preparation of the photoreceptor in Example 71 was repeated except that the charge transport layer coating liquid was replaced with the following.

| Charge transport layer coating liquid | |
|---|---|
| Charge transport polymer having formula (d) | 8 |
| Tetrahydrofuran | 400 |
| Cyclohexanone | 200 |

Example 73

The procedure for preparation of the photoreceptor in Example 71 was repeated except that the following protective layer coating liquid was coated on the CTL and dried to form a protective layer having a thickness of 2 μm.

| Protective layer coating liquid | |
|---|---|
| Charge transport polymer having formula (d) | 4 |
| Z-form polycarbonate | 4 |
| Tetrahydrofuran | 400 |
| Cyclohexanone | 200 |

Example 74

The procedure for preparation of the photoreceptor in Example 71 was repeated except that the following protective layer coating liquid was coated on the CTL and dried to form a protective layer having a thickness of 2 μm.

| Protective layer coating liquid | |
|---|---|
| Charge transport polymer having formula (d) | 4 |
| Z-form polycarbonate | 4 |
| Titanium oxide | 1 |
| Tetrahydrofuran | 400 |
| Cyclohexanone | 200 |

Comparative Example 22

The procedure for preparation of the photoreceptor in Example 71 was repeated except that the cutting operation was performed on the aluminum cylinder, i.e., gap forming members were not formed on both ends of the photoreceptor.

Comparative Example 23

The procedure for preparation of the photoreceptor in Example 72 was repeated except that the cutting operation was performed on the aluminum cylinder, i.e., gap forming members were not formed on both ends of the photoreceptor.

Comparative Example 24

The procedure for preparation of the photoreceptor in Example 73 were repeated except that the cutting operation was performed on the aluminum cylinder, i.e., gap forming members were not formed on both ends of the photoreceptor.

Comparative Example 25

The procedure for preparation of the photoreceptor in Example 74 were repeated except that the cutting operation was performed on the aluminum cylinder, i.e., gap forming members were not formed on both ends of the photoreceptor.

Evaluation Method

Each of the photoreceptor in Examples 71 to 74 and Comparative Examples 22 to 25 was evaluated using an image forming apparatus having the configuration as illustrated in FIG. 37, in which gears were arranged on the rotating shafts of the cylindrical photoreceptor and the charger and springs were provided on the rotating shaft of the charger to press the charger toward the photoreceptor.

In this case, the photoreceptor and the charger were set such that as shown in FIG. 33 the inside edge GEa (GEb) of the gap forming member 333*a* (333*b*) is located outside the end PEa (PEb) of the image forming portion 2 of the photoreceptor 1. The distance t between the inside end GEa (GEb) of the gap forming member 333*a* (333*b*) and the end PEa (PEb) of the image forming portion 2 was 1 mm, which is greater than twice the gap g (i.e., 50 $\mu$m) formed between the photoreceptor and the charger.

With respect to the photoreceptors of Comparative Examples 22 to 25, the entire peripheral surface of the photoreceptors contacted the charger.

A running test in which 50,000 copies were continuously produced was performed using a laser diode emitting light having a wavelength of 780 nm and a polygon mirror. The image qualities of the initial images and 50,000$^{th}$ image were evaluated. In addition, the abrasion quantity of the surface of the photoreceptor was also measured. The charging conditions are as follows.

DC bias: −880V

AC bias: 2.0 kV (peak to peak voltage)
2.2 kHz (frequency)

The results are shown in Table 8.

Example 75

The procedures for preparation and evaluation of the photoreceptor in Example 71 were repeated except that the springs pressing the rotating shaft of the charger were not used.

The results are also shown in Table 8.

Example 76

The procedures for preparation and evaluation of the photoreceptor in Example 71 were repeated except that as illustrated in FIG. 36 the photoreceptor was frictionally driven by the charger without using the gears.

The results are also shown in Table 8.

Example 77

The procedures for preparation and evaluation of the photoreceptor in Example 71 were repeated except that the charger rotated faster than the photoreceptor whereas the charger and photoreceptor rotated at the same speed in Example 71.

The results are also shown in Table 8.

TABLE 8

| | Image qualities (at the beginning of the running test) | Image qualities (at the end of the 50000-sheet running test) | Abrasion ($\mu$m) |
|---|---|---|---|
| Ex. 71 | Good | Faint black streaks were formed but the image was still acceptable. | 4.2 |
| Ex. 72 | Good | Good | 1.6 |
| Ex. 73 | Good | Good | 1.4 |
| Ex. 74 | Good | Good | 0.6 |
| Ex. 75 | Good | Slightly uneven density image due to partially uneven charging was formed. | 4.0 |
| Ex. 76 | Good | Good. However, since it was needed to increase the pressure applied to the charger, the abrasion quantity of the gap forming members was large. | 4.4 |
| Ex. 77 | Good | Good. However, the abrasion quantity of the gap forming members was large. | 4.5 |
| Comp. Ex. 22 | Good | Undesired image due to toner filming was produced. | 4.2 |
| Comp. Ex. 23 | Good | Undesired image due to toner filming was produced. | 1.8 |
| Comp. Ex. 24 | Good | Undesired image due to toner filming was produced. | 1.4 |
| Comp. Ex. 25 | Good | Undesired image due to toner filming was produced. | 0.6 |

Example 78

The procedures for preparation and evaluation of the charger and the photoreceptor in Example 71 were repeated except that the AC bias was not applied in the charging operation.

As a result of the running test, the 50,000$^{th}$ image was good. However, when half tone images were reproduced after the running test, the half tone images had slightly uneven image density due to uneven charging although the half tone images were still acceptable.

Example 79

The surface of the aluminum cylinder, which had been prepared by the method performed in Example 71, was subjected to an anodization treatment followed by a sealing treatment. The following charge generation layer coating liquid and charge transport layer coating liquid were coated thereon by a spray coating method and then dried one by one to form a CGL having a thickness of 0.2 $\mu$m and a CTL having a thickness of 28 $\mu$m.

Thus, a photoreceptor of the present invention was prepared.

| Charge generation layer coating liquid | |
|---|---|
| Charge generation material having formula (e) | 1 |
| Charge generation material having formula (f) | 1 |
| Polyvinyl butyral | 1 |
| Cyclohexanone | 100 |
| Cyclohexane | 40 |
| Charge transport layer coating liquid | |
| Charge transport material having formula (a) | 7 |
| Polycarbonate | 10 |
| Tetrahydrofuran | 400 |
| Cyclohexanone | 200 |

Example 80

The procedure for preparation of the photoreceptor in Example 79 was repeated except that the charge transport layer coating liquid was replaced with the following.

| Charge transport layer coating liquid | |
|---|---|
| Charge transport polymer having formula (d) | 8 |
| Tetrahydrofuran | 400 |
| Cyclohexanone | 200 |

Example 81

The procedures for preparation of the photoreceptor in Example 79 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Tetrahydrofuran | 400 |
| Cyclohexanone | 200 |

Example 82

The procedures for preparation of the photoreceptor in Example 79 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Titanium oxide | 1 |
| Tetrahydrofuran | 400 |
| Cyclohexanone | 200 |

Comparative Example 26

The procedure for preparation of the photoreceptor in Example 79 was repeated except that the cutting operation was not performed on the aluminum cylinder, i.e., the forming members were not formed on the photoreceptor.

Evaluation Method

Each of the photoreceptor in Example 79 to 82 and Comparative Example 26 was set in a process cartridge having the configuration as illustrated in FIG. 19 such that gears were provided on the rotating shaft of the photoreceptor and the charger and springs were provided on the rotating shaft of the charger to press the charger toward the photoreceptor.

The entire peripheral surface of the photoreceptor of Comparative Example 26 contacted the charger.

The distance t between the inside end GEa (GEb) of the gap forming member 333*a* (333*b*) and the end PEa (PEb) of the image forming portion 2 illustrated in FIG. 33 was 2 mm, which is greater than twice the gap g (i.e., 50 $\mu$m) formed between the photoreceptor and the charger.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −800V

AC bias: 1.7 kV (peak to peak voltage)
2.2 kHz (frequency)

Example 83

The procedures for preparation and evaluation of the photoreceptor in Example 79 were repeated except that the springs pressing the rotating shaft of the charger were not used.

The results are also shown in Table 9.

Example 84

The procedures for preparation and evaluation of the photoreceptor in Example 79 were repeated except that the photoreceptor was frictionally driven by the charger without using the gears.

The results are also shown in Table 9.

Example 85

The procedures for preparation and evaluation of the photoreceptor in Example 79 were repeated except that the charger rotated faster than the photoreceptor whereas the charger and photoreceptor rotated at the same speed in Example 79.

The results are also shown in Table 9.

TABLE 9

| | Potential (At the beginning of the running test) (V) | Potential (At the end of the 20000-sheet running test) (V) | Image qualities of the half tone images |
|---|---|---|---|
| Ex. 79 | −790 | −780 | Good |
| Ex. 80 | −795 | −785 | Good |
| Ex. 81 | −790 | −780 | Good |
| Ex. 82 | −785 | −775 | Good |
| Ex. 83 | −780 | −770 | Good |
| Ex. 84 | −785 | −775 | Good |
| Ex. 85 | −780 | −775 | Good |
| Comp. Ex. 26 | −780 | −750 | Uneven density image was formed. |

Example 86

The procedures for preparation and evaluation of the charger and the photoreceptor in Example 79 were repeated except that the AC bias was not applied in the charging operation.

As a result of the running test, the 20,000$^{th}$ image was good. However, when half tone images were reproduced after the running test, the half tone images had slightly uneven image density due to uneven charging although the half tone images were still acceptable.

Examples of the Fourth Embodiment

Example 87

On an aluminum cylinder, the following undercoat layer coating liquid, charge generation layer coating liquid and charge transport layer coating liquid were coated and then dried one by one to form an undercoat layer having a thickness of 3.5 μm, a CGL having a thickness of 0.2 μm and a CTL having a thickness of 28 μm.

| | |
|---|---|
| Undercoat layer coating liquid | |
| Titanium dioxide powder | 400 |
| Melamine resin | 65 |
| Alkyd resin | 120 |
| 2-butanone | 400 |
| Charge generation layer coating liquid | |
| Titanyl phthalocyanine | 3 |
| Polyvinyl butyral | 2 |
| n-butyl acetate | 200 |
| Charge transport layer coating liquid | |
| C-form polycarbonate | 10 |
| Charge transport material having formula (c) | 8 |
| Methylene chloride | 100 |

A flange was set on both ends of the thus prepared photoreceptor as illustrated in FIG. 38 such that the photoreceptor with the flange could be set in an image forming apparatus. The gap between the charger and the photoreceptor was 30 μm. In addition, the flanges were set such that the distance t between the inside edge FEa (or FEb) of the flange and the end PEa (or PEb) of the image forming portion was 1 mm.

Example 88

The procedure for preparation of the photoreceptor in Example 87 was repeated except that the flange was replaced with another flange to form a gap of 50 μm between the charger and photoreceptor.

Example 89

The procedure for preparation of the photoreceptor in Example 87 was repeated except that the flange was replaced with another flange to form a gap of 80 μm between the charger and photoreceptor.

Example 90

The procedure for preparation of the photoreceptor in Example 87 was repeated except that the flange was replaced with another flange to form a gap of 100 μm between the charger and photoreceptor.

Example 91

The procedure for preparation of the photoreceptor in Example 87 was repeated except that the flange was replaced with another flange to form a gap of 250 μm between the charger and photoreceptor.

Comparative Example 27

The procedure for preparation of the photoreceptor in Example 87 was repeated except that the flange was replaced with another flange to form a gap of 0 μm between the charger and photoreceptor (i.e., the surface of the charger contacted the surface of the photoreceptor).

Evaluation Method

Each of the photoreceptors in Examples 87 to 91 and Comparative Example 27 was evaluated as follows.

The rotating shaft of the drum photoreceptor and the rotating shaft of the charger were fixed using a ring member as illustrated in FIGS. 41 and 42 and the combination was set in an image forming apparatus.

A running test in which 30,000 copies were continuously produced was performed using a laser diode emitting light having a wavelength of 780 nm and a polygon mirror. The charging conditions are as follows.

DC bias: −930V

AC bias: 2.0 kV (peak to peak voltage)
2.0 kHz (frequency)

The results are shown in Table 10.

Example 92

The procedures for preparation and evaluation of the photoreceptor in Example 87 were repeated except that the photoreceptor was set in an image forming apparatus having the configuration as illustrated in FIG. 17 without using the ring member.

The results are shown in Table 10.

Comparative Example 28

The procedures for preparation and evaluation of the photoreceptor in Example 87 were repeated except that the distance t between the inside edge of the flange and the end of the image forming portion was changed to 0 mm.

The results are shown in Table 10.

Example 93

The procedures for preparation and evaluation of the photoreceptor in Example 87 were repeated except that the distance t between the inside edge of the flange and the end of the image forming portion was changed to 0.5 mm.

The results are shown in Table 10.

Example 94

The procedures for preparation and evaluation of the photoreceptor in Example 87 were repeated except that the distance t between the inside edge of the flange and the end of the image forming portion was changed to 2 mm.

The results are shown in Table 10.

TABLE 10

| | Initial image qualities | Image qualities of the 30,000$^{th}$ image |
|---|---|---|
| Ex. 87 | Good | Good |
| Ex. 88 | Good | Good |
| Ex. 89 | Good | Good |
| Ex. 90 | Good | Good |
| Ex. 91 | Good | Slightly uneven density image due to uneven discharging was formed but the image qualities were still acceptable. |
| Ex. 92 | Good | Slightly uneven density image due to partial abnormal discharging was formed. |
| Ex. 93 | Good | Good |
| Ex. 94 | Good | Good |
| Comp. Ex. 27 | Good | Undesired image due to toner filming was formed. |
| Comp. Ex. 28 | Good | Uneven images were formed on both sides of the copy sheet. In addition, background fouling was observed. |

Example 95

The procedures for preparation and evaluation of the charger and the photoreceptor in Example 87 were repeated except that the AC bias was not applied in the charging operation.

As a result of the running test, the 30,000$^{th}$ image was good. However, when half tone images were reproduced after the running test, the half tone images had slightly uneven image density due to uneven charging although the half tone images were still acceptable.

Example 96

The procedures for preparation and evaluation of the photoreceptor in Example 87 were repeated except that the charge transport layer coating liquid was replaced with the following.

| Charge transport layer coating liquid | |
|---|---|
| Charge transport polymer having formula (d) | 8 |
| Methylene chloride | 100 |

Example 97

The procedures for preparation of the photoreceptor in Example 87 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Methylene chloride | 100 |

Example 98

The procedures for preparation of the photoreceptor in Example 87 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Titanium oxide | 1 |
| Methylene chloride | 100 |

A flange was set on both ends of the thus prepared photoreceptor as illustrated in FIG. 38 such that the photoreceptor with the flange could be set in an image forming apparatus. The gap between the charger and the photoreceptor was 50 $\mu$m. In addition, the flanges were set such that the distance t between the inside edge FEa (or FEb) of the flange and the end PEa (or PEb) of the image forming portion was 1 mm.

Comparative Example 29

The procedure for preparation of the photoreceptor in Example 96 was repeated except that the flange was replaced with another flange to form a gap of 0 $\mu$m between the charger and photoreceptor (i.e., the surface of the charger contacted the surface of the photoreceptor).

Comparative Example 30

The procedure for preparation of the photoreceptor in Example 97 was repeated except that the flange was replaced with another flange to form a gap of 0 $\mu$m between the charger and photoreceptor (i.e., the surface of the charger contacted the surface of the photoreceptor).

Comparative Example 31

The procedure for preparation of the photoreceptor in Example 98 was repeated except that the flange was replaced with another flange to form a gap of 0 μm between the charger and photoreceptor (i.e., the surface of the charger contacted the surface of the photoreceptor).

Evaluation Method

Each of the photoreceptor in Examples 87 and 96 to 98 and Comparative Examples 27 and 29 to 31 was evaluated using an image forming apparatus having a configuration as illustrated in FIG. 44, in which gears were arranged on the rotating shafts of the cylindrical photoreceptor and the charger and springs were provided on the rotating shaft of the charger to press the charger toward the photoreceptor.

With respect to the photoreceptors of Comparative Examples 27 and 29 to 31, the entire peripheral surface of the photoreceptors contacted the charger.

A running test in which 50,000 copies were continuously produced was performed using a laser diode emitting light having a wavelength of 780 nm and a polygon mirror. The image qualities of the initial images and $50{,}000^{th}$ image were evaluated. In addition, the abrasion quantity of the surface of the photoreceptor was also measured. The charging conditions are as follows.

DC bias: −930 V

AC bias: 2.0 kV (peak to peak voltage)
2 kHz (frequency)

The results are shown in Table 11.

Example 99

The procedures for preparation and evaluation of the photoreceptor in Example 87 were repeated except that the springs pressing the rotating shaft of the charger were not used.

The results are also shown in Table 11.

Example 100

The procedures for preparation and evaluation of the photoreceptor in Example 87 were repeated except that as illustrated in FIG. 43 the photoreceptor was frictionally driven by the charger without using the gears.

The results are also shown in Table 11.

Example 101

The procedures for preparation and evaluation of the photoreceptor in Example 87 were repeated except that the charger rotated faster than the photoreceptor whereas the charger and photoreceptor rotated at the same speed in Example 87.

The results are also shown in Table 11.

TABLE 11

| | Image qualities (at the beginning of the running test) | Image qualities (at the end of the running test) | Abrasion (μm) |
|---|---|---|---|
| Ex. 87 | Good | Faint black streaks were formed but the image was still acceptable. | 4.0 |
| Ex. 96 | Good | Good | 1.5 |
| Ex. 97 | Good | Good | 1.3 |

TABLE 11-continued

| | Image qualities (at the beginning of the running test) | Image qualities (at the end of the running test) | Abrasion (μm) |
|---|---|---|---|
| Ex. 98 | Good | Good | 0.6 |
| Ex. 99 | Good | Slightly uneven density image due to partially uneven charging was formed. | 3.8 |
| Ex. 100 | Good | Good. However, since it was needed to increase the pressure applied to the charger, the abrasion quantity of the gap forming members was large. | 4.3 |
| Ex. 101 | Good | Good. However, the abrasion quantity of the gap forming members was large. | 4.5 |
| Comp. Ex. 27 | Good | Undesired image due to toner filming was produced. | 4.1 |
| Comp. Ex. 29 | Good | Undesired image due to toner filming was produced. | 1.6 |
| Comp. Ex. 30 | Good | Undesired image due to toner filming was produced. | 1.3 |
| Comp. Ex. 31 | Good | Undesired image due to toner filming was produced. | 0.6 |

Example 102

The surface of an aluminum cylinder was subjected to an anodization treatment followed by a sealing treatment. The following charge generation layer coating liquid and charge transport layer coating liquid were coated thereon and then dried one by one to form a CGL having a thickness of 0.2 μm and a CTL having a thickness of 28 μm.

Thus, a photoreceptor of the present invention was prepared.

| | |
|---|---|
| Charge generation layer coating liquid | |
| Charge generation material having formula (e) | 1 |
| Charge generation material having formula (f) | 1 |
| Polyvinyl butyral | 1 |
| Cyclohexanone | 100 |
| Cyclohexane | 40 |
| Charge transport layer coating liquid | |
| Charge transport material having the following formula (k) | 7 |

(k)

-continued

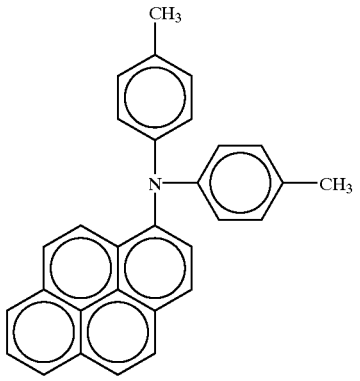

| | |
|---|---|
| Polycarbonate | 10 |
| Methylene chloride | 100 |

A flange as illustrated in FIG. 38 was provided on both ends of the photoreceptor to form a gap of 70$\mu$ between the surface of the photoreceptor and the charger to be set on the photoreceptor. The distance t between the inside edge FEa (FEb) of the flange of the flange and the end PEa (PEb) of the image forming portion was 2 mm.

Example 103

The procedure for preparation of the photoreceptor in Example 102 was repeated except that the charge transport layer coating liquid was replaced with the following.

| Charge transport layer coating liquid | |
|---|---|
| Charge transport polymer having formula (d) | 8 |
| Methylene chloride | 100 |

Example 104

The procedures for preparation of the photoreceptor in Example 102 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Methylene chloride | 400 |

Example 105

The procedures for preparation of the photoreceptor in Example 102 were repeated except that the following protective layer coating liquid was coated on the CTL and dried to form a protective layer having a thickness of 2 $\mu$m.

| Protective layer coating liquid | |
|---|---|
| Charge transport polymer having formula (d) | 4 |
| Z-form polycarbonate | 4 |
| Titanium oxide | 1 |
| Methylene chloride | 400 |

Comparative Example 32

The procedure for preparation of the photoreceptor in Example 102 was repeated except that the flange was replaced with another flange such that the gap was not formed between the photoreceptor and charger.

Evaluation Method

Each of the photoreceptors with flange prepared in Example 102 to 105 and Comparative Example 32 was set in a process cartridge having the configuration as illustrated in FIG. 19 such that gears were provided on the rotating shafts of the photoreceptor and the charger and springs were provided on the rotating shaft of the charger to press the charger toward the photoreceptor.

The entire peripheral surface of the photoreceptor of Comparative Example 32 contacted the charger.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −830V

AC bias: 1.7 kV (peak to peak voltage)
2.2 kHz (frequency)

The results are shown in Table 12.

Example 106

The procedures for preparation and evaluation of the photoreceptor in Example 102 were repeated except that the springs pressing the rotating shaft of the charger were not used.

The results are also shown in Table 12.

Example 107

The procedures for preparation and evaluation of the photoreceptor in Example 102 were repeated except that the photoreceptor was frictionally driven by the charger without using the gears.

The results are also shown in Table 12.

Example 108

The procedures for preparation and evaluation of the photoreceptor in Example 102 were repeated except that the charger rotated faster than the photoreceptor whereas the charging and photoreceptor rotated at the same speed in Example 102.

The results are also shown in Table 12.

TABLE 12

| | Potential (At the beginning of the running test) (V) | Potential (At the end of the 20000-sheet running test) (V) | Image qualities of the half tone images |
|---|---|---|---|
| Ex. 102 | −820 | −805 | Good |
| Ex. 103 | −825 | −815 | Good |
| Ex. 104 | −820 | −810 | Good |
| Ex. 105 | −815 | −805 | Good |
| Ex. 106 | −810 | −800 | Good |
| Ex. 107 | −815 | −805 | Good |
| Ex. 108 | −810 | −805 | Good |
| Comp. Ex. 32 | −815 | −790 | Undesired image was formed due to toner filming. |

Example 109

The procedures for preparation and evaluation of the charger and the photoreceptor in Example 102 were repeated except that the AC bias was not applied in the charging operation.

As a result of the running test, the 20,000$^{th}$ image was good. However, when half tone images were reproduced after the running test, the half tone images had slightly uneven image density due to uneven charging although the half tone images were still acceptable.

Examples of the Fifth Embodiment

Example 110

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 50 μm was formed thereon. Thus, a charging roller was prepared.

Preparation of Photoreceptor

Each of the following undercoat layer coating liquid, charge generation layer coating liquid and charge transport layer coating liquid was coated on a nickel seamless belt and then dried one by one to overlay an undercoat layer having a thickness of 3.5 μm, a CGL having a thickness of 0.5 μm and a CTL having a thickness of 28 μm on the nickel seamless belt.

| Undercoat layer coating liquid | |
|---|---|
| Titanium oxide powder | 400 |
| Melamine resin | 65 |
| Alkyd resin | 120 |
| 2-butanone | 400 |

-continued

| Charge generation layer coating liquid | |
|---|---|
| Titanyl phthalocyanine | 3 |
| Polyvinyl butyral | 2 |
| 2-butanone | 200 |
| **Charge transport layer coating liquid** | |
| A-form polycarbonate | 10 |
| Charge transport material having formula (c) | 8 |
| Methylene chloride | 100 |

Evaluation Method

The photoreceptor of Example 110 was evaluated as follows.

The rotating shaft of a driving roller supporting the drum photoreceptor and the rotating shaft of the charger were fixed using a ring member as illustrated in FIGS. 54 and 55 and the combination was set in an image forming apparatus.

In this case, the distance t between the inside edge REa (or REb) of the projected portion of the driving roller, which has a form illustrated in FIG. 5 and which is made of an ABS resin, and the end PEa (or PEb) of the image forming portion of the photoreceptor was 2 mm. In addition, the gap g between the surface of the charger and the surface of the photoreceptor was 50 μm.

A running test in which 30,000 copies were continuously produced was performed using a laser diode emitting light having a wavelength of 780 nm and a polygon mirror. The charging conditions are as follows.

DC bias: −900V

AC bias: 1.8 kV (peak to peak voltage)
1.5 kHz (frequency)

The results are shown in Table 13.

Example 111

The procedures for preparation and evaluation of the photoreceptor in Example 110 were repeated except that the driving roller was replaced with another driving roller to change the gap g between the surface of the charger and the surface of the photoreceptor from 50 μm to 80 μm.

The results are shown in Table 13.

Example 112

The procedures for preparation and evaluation of the photoreceptor in Example 110 were repeated except that the driving roller was replaced with another driving roller to change the gap g between the surface of the charger and the surface of the photoreceptor from 50 μm to 100 μm.

The results are shown in Table 13.

Example 113

The procedures for preparation and evaluation of the photoreceptor in Example 110 were repeated except that the driving roller was replaced with another driving roller to change the gap g between the surface of the charger and the surface of the photoreceptor from 50 μm to 150 μm.

The results are shown in Table 13.

Example 114

The procedures for preparation and evaluation of the photoreceptor in Example 110 were repeated except that the driving roller was replaced with another driving roller to change the gap g between the surface of the charger and the surface of the photoreceptor from 50 μm to 250 μm.

The results are shown in Table 13.

Comparative Example 33

The procedures for preparation and evaluation of the photoreceptor in Example 110 were repeated except that the driving roller was replaced with another driving roller to change the gap g between the surface of the charger and the surface of the photoreceptor from 50 μm to 0 μm.

The results are shown in Table 13.

Example 115

The procedures for preparation and evaluation of the photoreceptor in Example 110 were repeated except that the photoreceptor was evaluated using an image forming apparatus having the configuration as illustrated in FIG. 62, which did not use the ring member, instead of the image forming apparatus as illustrated in FIGS. 54 and 55.

The results are shown in Table 13.

Comparative Example 34

The procedures for preparation and evaluation of the photoreceptor in Example 110 were repeated except that the location of the inside edge REa (or REb) of the projected portion of the driving roller is the same as the location of the end PEa (or PEb) of the image forming portion (i.e., the distance t is 0 mm).

The results are shown in Table 13.

Example 116

The procedures for preparation and evaluation of the photoreceptor in Example 110 were repeated except that the distance t between the inside edge REa (or REb) of the projected portion of the driving roller and the end PEa (or PEb) of the image forming portion is 0.5 mm.

The results are shown in Table 13.

Example 117

The procedures for preparation and evaluation of the photoreceptor in Example 110 were repeated except that the distance t between the inside edge REa (or REb) of the projected portion of the driving roller and the end PEa (or PEb) of the image forming portion is 2 mm.

The results are shown in Table 13.

TABLE 13

| | Initial image qualities | Image qualities of the 30,000th image |
|---|---|---|
| Ex. 110 | Good | Good |
| Ex. 111 | Good | Good |
| Ex. 112 | Good | Good |
| Ex. 113 | Good | Good |
| Ex. 114 | Good | Slightly uneven density image due to uneven discharging was formed but the image qualities were still acceptable. |

TABLE 13-continued

| | Initial image qualities | Image qualities of the 30,000th image |
|---|---|---|
| Ex. 115 | Good | Slightly uneven density image due to partial defective discharging was formed. |
| Ex. 116 | Good | Good |
| Ex. 117 | Good | Good |
| Comp. Ex. 33 | Good | Undesired image due to toner filming was formed. |
| Comp. Ex. 34 | Good | Uneven images were formed on both sides of the copy sheet. In addition, background fouling was observed. |

Example 118

The procedures for preparation and evaluation of the photoreceptor in Example 110 were repeated except that the material of the driving roller was changed to stainless steel.

As a result, the images had good image qualities even after the 30,000-sheet running test. However, there was a faint abnormal image due to abnormal charging in the images.

Example 119

The procedures for preparation and evaluation of the charger and the photoreceptor in Example 110 were repeated except that the AC bias was not applied in the charging operation.

As a result of the running test, the 30,000th image was good. However, when half tone images were reproduced after the running test, the half tone images had slightly uneven image density due to uneven charging although the half tone images were still acceptable.

Example 120

The procedures for preparation and evaluation of the photoreceptor in Example 110 were repeated except that the charge transport layer coating liquid was replaced with the following.

| Charge transport layer coating liquid | |
|---|---|
| Charge transport polymer having the following formula (m) | 8 |

(m)

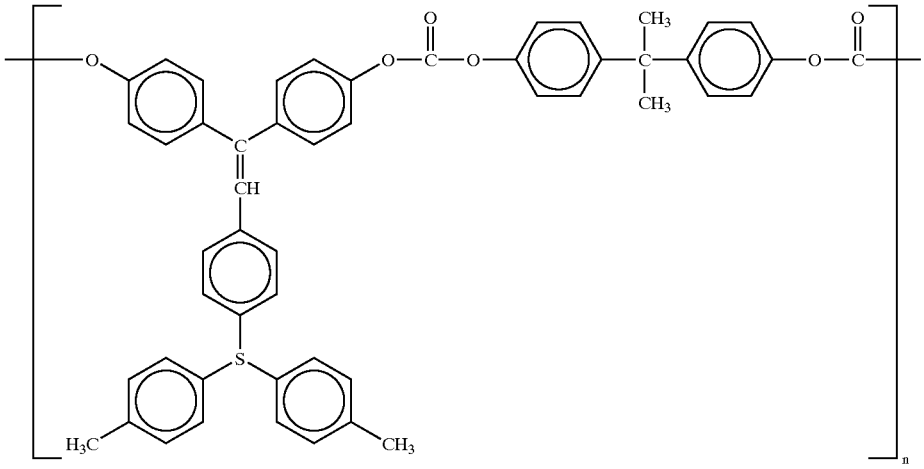

| | |
|---|---|
| Methylene chloride | 100 |

Example 121

The procedures for preparation of the photoreceptor in Example 110 were repeated except that the following protective layer coating liquid was coated on the CTL and dried to form a protective layer having a thickness of 2 μm.

| Protective layer coating liquid | |
|---|---|
| Charge transport polymer having formula (m) | 4 |
| A-form polycarbonate | 4 |
| Methylene chloride | 100 |

Example 122

The procedures for preparation of the photoreceptor in Example 110 were repeated except that the following protective layer coating liquid was coated on the CTL and dried to form a protective layer having a thickness of 2 μm.

| Protective layer coating liquid | |
|---|---|
| Charge transport polymer having formula (m) | 4 |
| A-form polycarbonate | 4 |
| Titanium oxide | 1 |
| Methylene chloride | 100 |

Evaluation Method

Each of the photoreceptors in Examples 120 to 122 was evaluated using an image forming apparatus having the configuration as illustrated in FIG. 57, in which gears were arranged on the rotating shafts of the driving roller supporting the photoreceptor and the charger and springs were provided on the rotating shaft of the charger to press the charger toward the photoreceptor.

In this case, the distance t between the inside edge REa (or REb) of the projected portion of the driving roller supporting the photoreceptor, which is made of an ABS resin, and the end PEa (or PEb) of the image forming portion of the photoreceptor was 1 mm. In addition, the gap g between the surface of the charger and the surface of the photoreceptor was 50 μM.

A running test in which 50,000 copies were continuously produced was performed using a laser diode emitting light having a wavelength of 780 nm and a polygon mirror. The image qualities of the initial images and $50{,}000^{th}$ image were evaluated. In addition, the abrasion quantity of the surface of the photoreceptor was also measured. The charging conditions are the same as those in Example 110.

The results are shown in Table 14.

Example 123

The procedures for preparation and evaluation of the photoreceptor in Example 120 were repeated except that the springs pressing the rotating shaft of the charger were not used.

The results are also shown in Table 14.

Example 124

The procedures for preparation and evaluation of the photoreceptor in Example 120 were repeated except that the photoreceptor was frictionally driven by the charger without using the gears.

The results are also shown in Table 14.

Example 125

The procedures for preparation and evaluation of the photoreceptor in Example 120 were repeated except that the charger rotated faster than the photoreceptor whereas the charger and photoreceptor rotated at the same speed in Example 120.

The results are also shown in Table 14.

Comparative Example 34

The procedures for preparation and evaluation of the photoreceptor in Example 120 were repeated except that the driving roller was replaced with another driving roller to change the gap g between the surface of the charger and the surface of the photoreceptor from 50 μm to 0 μm.

The results are shown in Table 14.

Comparative Example 35

The procedures for preparation and evaluation of the photoreceptor in Example 121 were repeated except that the driving roller was replaced with another driving roller to change the gap g between the surface of the charger and the surface of the photoreceptor from 50 μm to 0 μm.

The results are shown in Table 14.

Comparative Example 36

The procedures for preparation and evaluation of the photoreceptor in Example 122 were repeated except that the driving roller was replaced with another driving roller to change the gap g between the surface of the charger and the surface of the photoreceptor from 50 μm to 0 μm.

The results are shown in Table 14.

Evaluation Method

Each of the photoreceptors of Example 110 and Comparative Example 33, which had been subjected to the 30,000-sheet running test, was further subjected to a 20,000-sheet running test (namely, 50,000-sheet running test in total) using the same image forming apparatus. The image qualities were also evaluated similarly after the 50,000-sheet running test.

In addition, each of the photoreceptors of Examples 120 to 125 and Comparative Examples 34 to 36 was also subjected to the 50,000-sheet running test using the image forming apparatus mentioned above. At this point, the abrasion amount of the surface of each photoreceptor was also measured.

The results are shown in Table 14.

TABLE 14

| | Image qualities (at the beginning of the running test) | Image qualities (at the end of the running test) | Abrasion (μm) |
|---|---|---|---|
| Ex. 110 | Good | Faint black streaks were formed but the image was still acceptable. | 2.1 |
| Ex. 120 | Good | Good | 1.0 |
| Ex. 121 | Good | Good | 0.7 |

TABLE 14-continued

| | Image qualities (at the beginning of the running test) | Image qualities (at the end of the running test) | Abrasion (μm) |
|---|---|---|---|
| Ex. 122 | Good | Good | 0.3 |
| Ex. 123 | Good | Slightly uneven density image due to partially uneven charging was formed. | 2.0 |
| Ex. 124 | Good | Good. However, since it was needed to increase the pressure applied to the charger, the abrasion quantity of the gap forming members was large. | 2.3 |
| Ex. 125 | Good | Good. However, the abrasion quantity of the gap forming members was large. | 2.4 |
| Comp. Ex. 33 | Good | Undesired image due to toner filming was produced. | 2.2 |
| Comp. Ex. 34 | Good | Undesired image due to toner filming was produced. | 1.0 |
| Comp. Ex. 35 | Good | Undesired image due to toner filming was produced. | 0.7 |
| Comp. Ex. 36 | Good | Undesired image due to toner filming was produced. | 0.3 |

Example 126

An aluminum layer was deposited on one side of a seamless polyethylene terephthalate film to subject the film to an electroconductive treatment. The following charge generation layer coating liquid and charge transport layer coating liquid were coated thereon and dried one by one to form a CGL having a thickness of 0.2 μm and a CTL having a thickness of 28 μm.

Thus, a photoreceptor of the present invention was prepared.

Charge generation layer coating liquid

| | |
|---|---|
| Charge generation material having formula (e) | 1 |
| Charge generation material having the following formula (n) | 1 |

(n)

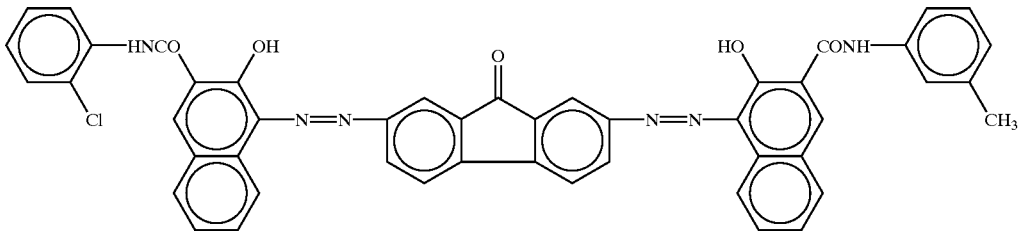

| | |
|---|---|
| Polyvinyl butyral | 1 |

-continued

| | |
|---|---|
| Cyclohexanone | 100 |
| Cyclohexane | 40 |
| Charge transport layer coating liquid | |
| Charge transport material having formula (h) | 7 |
| A-form polycarbonate | 10 |
| Methylene chloride | 100 |

Example 127

The procedures for preparation and evaluation of the photoreceptor in Example 126 were repeated except that the charge transport layer coating liquid was replaced with the following.

| Charge transport layer coating liquid | |
|---|---|
| Charge transport polymer having formula (m) | 8 |
| Methylene chloride | 100 |

Example 128

The procedures for preparation of the photoreceptor in Example 126 were repeated except that the following protective layer coating liquid was coated on the CTL and dried to form a protective layer having a thickness of 2 μm.

| Protective layer coating liquid | |
|---|---|
| Charge transport polymer having formula (m) | 4 |
| A-form polycarbonate | 4 |
| Methylene chloride | 100 |

Example 129

The procedures for preparation of the photoreceptor in Example 126 were repeated except that the following protective layer coating liquid was coated on the CTL and dried to form a protective layer having a thickness of 2 μm.

| Protective layer coating liquid | |
|---|---|
| Charge transport polymer having formula (m) | 4 |
| A-form polycarbonate | 4 |
| Titanium oxide | 1 |
| Methylene chloride | 100 |

Evaluation Method

Each of the photoreceptors in Examples 126 to 129 was set in a process cartridge having the configuration as illustrated in FIG. 63 in which gears were provided on the rotating shaft of the photoreceptor and the charger and springs were provided on the rotating shaft of the charger to press the charger toward the photoreceptor. In this case, the distance t between the inside edge REa (or REb) of the projected portion of the driving roller which supports the photoreceptor as illustrated in FIG. 51 and which is made of an ABS resin, and the outside edge PEa (or PEb) of the image forming portion of the photoreceptor was 2 mm. In addition, the gap g between the surface of the charger and the surface of the photoreceptor was 70 μm.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −950V

AC bias: 2.0 kV (peak to peak voltage)
2.0 kHz (frequency)

The results are shown in Table 15.

Example 130

The procedures for preparation and evaluation of the photoreceptor in Example 126 were repeated except that the springs pressing the rotating shaft of the charger were not used.

The results are also shown in Table 15.

Example 131

The procedures for preparation and evaluation of the photoreceptor in Example 126 were repeated except that the photoreceptor was frictionally driven by the charger without using the gears.

The results are also shown in Table 15.

Example 132

The procedures for preparation and evaluation of the photoreceptor in Example 126 were repeated except that the charger rotated faster than the photoreceptor whereas the charger and photoreceptor rotated at the same speed in Example 126.

The results are also shown in Table 15.

Comparative Example 37

The procedures for preparation and evaluation of the photoreceptor in Example 126 were repeated except that the driving roller was replaced with a conventional driving roller to change the gap g from 70 μm to 0 μm.

The results are shown in Table 15.

TABLE 15

| | Potential (At the beginning of the running test) (V) | Potential (At the end of the 20000-sheet running test) (V) | Image qualities of the half tone images |
|---|---|---|---|
| Ex. 126 | −948 | −930 | Good |
| Ex. 127 | −945 | −925 | Good |
| Ex. 128 | −943 | −920 | Good |
| Ex. 129 | −945 | −928 | Good |
| Ex. 130 | −938 | −928 | Good |
| Ex. 131 | −935 | −920 | Good |
| Ex. 132 | −935 | −925 | Good |
| Comp. Ex. 37 | −940 | −890 | Undesired image due to toner filming was formed. |

Example 133

The procedures for preparation and evaluation of the charger and the photoreceptor in Example 126 were repeated except that the AC bias was not applied in the charging operation.

As a result of the running test, the $20{,}000^{th}$ image was good. However, when half tone images were reproduced after the running test, the half tone images had slightly uneven image density due to uneven charging although the half tone images were still acceptable.

Effect of the Invention

As can be understood from the above description, according to the present invention, a photoreceptor capable of stably producing good images without forming a toner film on the charger used even after repeated use is provided. In addition, an image forming method and apparatus and a process cartridge using the photoreceptor, which can produce good images for a long period of time are also provided. Further, according to the present invention, the abrasion of the photoreceptor and the charger used can be reduced, and thereby the life of the photoreceptor and the charger can be prolonged. Therefore, an image forming apparatus and a process cartridge having good durability can be provided.

Although the charger is one of proximity charging devices in the present invention, the proximity charger is simple and an additional device for forming and maintaining a gap between a photoreceptor and the charger is not needed. Therefore the proximity charger is low-cost. Since a gap forming member is formed on both end portions of the photoreceptor, the gap forming member stably forms and maintains a gap between the photoreceptor and the charger without being peeled. Therefore, problems such as uneven charging and banding phenomenon, which often occur when non-contact charging is performed, can be avoided, and good images can be stably produced for a long period of time.

This document claims priority and contains subject matter related to Japanese Patent Application No. 2001-226432, filed on Jul. 26, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member comprising a photoreceptor configured to bear an electrostatic latent image while rotating in a direction and comprising an electroconductive substrate and at least one layer including a photosensitive layer, the photoreceptor including an image forming portion having two ends substantially parallel to the rotating direction and a gap forming member located outside of each of the two ends of the image forming portion, said gap forming member having an inside end substantially perpendicular to an axial axis of said image bearing member substantially parallel to the rotating direction;

a charging roller configured to charge the photoreceptor while rotating, the charging roller contacting the gap forming members of the photoreceptor to form a gap g between a surface of the image forming portion of the photoreceptor and a peripheral surface of the charging roller;

a light irradiator configured to irradiate the photoreceptor with light to form the electrostatic latent image in the image forming portion of the photoreceptor;

an image developer configured to develop the electrostatic latent image with a toner to form a toner image on the image forming portion of the photoreceptor; and an image transfer device configured to transfer the toner image onto a receiving material, wherein the following relationship is satisfied:

$$t \geqq 2g$$

where t represents a distance between an edge of said photoreceptor and the inside end of one of the gap forming members next to said edge of said photoreceptor.

2. The image forming apparatus according to claim 1, wherein the gap forming member is located on each end portion of the photoreceptor, and wherein the at least one layer of the photoreceptor at the end portion is thicker than the at least one layer at the image forming portion by the gap g.

3. The image forming apparatus according to claim 1, wherein the gap forming member is located on each end portion of the photoreceptor, and wherein the electroconductive substrate of the photoreceptor at the end portion is thicker than the electroconductive substrate at the image forming portion by the gap g.

4. The image forming apparatus according to claim 1, wherein the image bearing member further comprises a flange located on each end of the photoreceptor, and wherein the flange serves as the gap forming member.

5. The image forming apparatus according to claim 1, further comprising a pressing device configured to press at least one of the charging roller and the photoreceptor to the other.

6. The image forming apparatus according to claim 5, wherein the pressing device comprises a spring.

7. The image forming apparatus according to claim 1, wherein each of the charging roller and the photoreceptor has a rotating shaft, and wherein the rotating shafts are rotatably supported by a ring member.

8. The image forming apparatus according to claim 1, wherein the charging roller and the photoreceptor each have a respective driving device configured to independently drive the charging roller and the photoreceptor.

9. The image forming apparatus according to claim 8, wherein each of the driving devices is, independently, a member selected from the group consisting of gears, couplings and belts.

10. The image forming apparatus according to claim 1, wherein the charging roller and the photoreceptor rotate at a same speed.

11. The image forming apparatus according to claim 1, wherein the image bearing member further comprises a roller and the photoreceptor is a belt-form photoreceptor, wherein the roller supports the belt-form photoreceptor and has a projected portion located outside both ends of the belt form photoreceptor, and wherein the projected portions of the roller serve as the gap forming members.

12. The image forming apparatus according to claim 11, further comprising a pressing device configured to press at least one of the charging roller and the roller to the other.

13. The image forming apparatus according to claim 12, wherein the pressing device comprises a spring.

14. The image forming apparatus according to claim 11, wherein each of the charging roller and the roller has a rotating shaft, and wherein the rotating shafts are rotatably supported by a ring member.

15. The image forming apparatus according to claim 11, wherein the charging roller and the roller each have a respective driving device configured to independently drive the charging roller and the roller.

16. The image forming apparatus according to claim 15, wherein each of the driving devices is, independently, a member selected from the group consisting of gears, couplings and belts.

17. The image forming apparatus according to claim 11, wherein the charging roller and the belt-form photoreceptor rotate at a same speed.

18. The image forming apparatus according to claim 11, wherein a surface of the roller contacting the gap forming members is electrically insulative.

19. The image forming apparatus according to claim 11, wherein the electroconductive substrate of the belt photoreceptor is a seamless belt.

20. The image forming apparatus according to claim 1, wherein the gap forming members are electrically insulative.

21. The image forming apparatus according to claim 1, wherein the gap forming members have a thickness of from 10 to 200 $\mu$m.

22. The image forming apparatus according to claim 1, wherein the gap g is from 10 to 200 $\mu$m.

23. The image forming apparatus according to claim 1, wherein the charging roller charges the photoreceptor by applying a DC voltage overlapped with an AC voltage.

24. The image forming apparatus according to claim 1, wherein the photosensitive layer of the photoreceptor comprises a charge generation layer and a charge transport layer.

25. The image forming apparatus according to claim 24, wherein the charge transport layer comprises a polycarbonate having a triarylamine group in at least one of a main chain or a side chain thereof.

26. The image forming apparatus according to claim 1, wherein the photoreceptor further includes a protective layer, and wherein the protective layer comprises a filler.

27. The image forming apparatus according to claim 1, wherein the photoreceptor further includes a protective layer, and wherein the protective layer comprises a charge transport material.

28. The image forming apparatus according to claim 27, wherein the charge transport material is a charge transport polymer.

29. The image forming apparatus according to claim 28, wherein the charge transport polymer comprises a polycarbonate resin having a triarylamine group in at least one of a main chain or a side chain thereof.

30. A process cartridge comprising:

an image bearing member comprising a photoreceptor configured to bear an electrostatic latent image while rotating in a direction and comprising an electroconductive substrate and at least one layer including a photosensitive layer, the photoreceptor having an image forming portion having two ends substantially parallel to the rotating direction and a gap forming member located outside of each of the two ends of the image forming portion, said gap forming member having an inside end substantially perpendicular to an axial axis of said image bearing member substantially parallel to the rotating direction; and a charging roller configured to charge the photoreceptor while rotating, the charging roller contacting the gap forming members of the photoreceptor to form a gap g between a surface of the image forming portion of the photoreceptor and a peripheral surface of the charging roller, wherein the following relationship is satisfied:

$$t \geqq 2g$$

where t represents a distance between an edge of said photoreceptor and the inside end of one of the gap forming members next to said edge of said photoreceptor.

31. The process cartridge according to claim 30, wherein the gap forming member is located on each end portion of the photoreceptor, and wherein the at least one layer of the photoreceptor at the end portion is thicker than the at least one layer at the image forming portion by the gap g.

32. The process cartridge according to claim 30, wherein the gap forming member is located on each end portion of the photoreceptor, and wherein the electroconductive substrate of the photoreceptor at the end portion is thicker than the electroconductive substrate at the image forming portion by the gap g.

33. The process cartridge according to claim 30, wherein the image bearing member further comprises a flange located on each end of the photoreceptor, and wherein the flange serves as the gap forming member.

34. The process cartridge according to claim 30, further comprising a pressing device configured to press at least one of the charging roller and the photoreceptor to the other.

35. The process cartridge according to claim 34, wherein the pressing device comprises a spring.

36. The process cartridge according to claim 30, wherein each of the charging roller and the photoreceptor has a rotating shaft, and wherein the rotating shafts are rotatably supported by a ring member.

37. The process cartridge according to claim 30, wherein the charging roller and the photoreceptor each have a respective driving device configured to independently drive the charging roller and the photoreceptor.

38. The process cartridge according to claim 37, wherein each of the driving devices is, independently, a member selected from the group consisting of gears, couplings and belts.

39. The process cartridge according to claim 30, wherein the charging roller and the photoreceptor rotate at a same speed.

40. The process cartridge according to claim 30, wherein the image bearing member further comprises a roller and the photoreceptor is a belt-form photoreceptor, wherein the roller supports the belt-form photoreceptor and has a projected portion located outside both ends of the belt form photoreceptor, and wherein the projected portions of the roller serve as the gap forming members.

41. The process cartridge according to claim 40, further comprising a pressing device configured to press at least one of the charging roller and the roller to the other.

42. The process cartridge according to claim 41, wherein the pressing device comprises a spring.

43. The process cartridge according to claim 40, wherein each of the charging roller and the roller has a rotating shaft, and wherein the rotating shafts are rotatably supported by a ring member.

44. The process cartridge according to claim 40, wherein the charging roller and the roller each have a respective driving device configured to independently drive the charging roller and the roller.

45. The process cartridge according to claim 44, wherein each of the driving devices is, independently, a member selected from the group consisting of gears, couplings and belts.

46. The process cartridge according to claim 40, wherein the charging roller and the belt-form photoreceptor rotate at a same speed.

47. The process cartridge according to claim 40, wherein a surface of the roller contacting the gap forming members is electrically insulative.

48. The process cartridge according to claim 40, wherein the electroconductive substrate of the belt-form photoreceptor is a seamless belt.

49. The process cartridge according to claim 30, wherein the gap forming members are electrically insulative.

50. The process cartridge according to claim 30, wherein the gap forming members have a thickness of from 10 to 200 $\mu$m.

51. The process cartridge according to claim 30, wherein the gap g is from 10 to 200 $\mu$m.

52. The process cartridge according to claim 30, wherein the charging roller charges the photoreceptor by applying a DC voltage overlapped with an AC voltage.

53. The process cartridge according to claim 30, wherein the photosensitive layer of the photoreceptor comprises a charge generation layer and a charge transport layer.

54. The process cartridge according to claim 53, wherein the charge transport layer comprises a polycarbonate resin having a triarylamine group in at least one of a main chain or a side chain thereof.

55. The process cartridge according to claim 30, wherein the photoreceptor further includes a protective layer, and wherein the protective layer comprises a filler.

56. The process cartridge according to claim 30, wherein the photoreceptor includes a protective layer, and wherein the protective layer comprises a charge transport material.

57. The process cartridge according to claim 56, wherein the charge transport material is a charge transport polymer.

58. The process cartridge according to claim 57, wherein the charge transport polymer comprises a polycarbonate resin having a triarylamine group in at least one of a main chain or a side chain thereof.

59. A photoreceptor comprising:

an electroconductive substrate;

at least one layer including a photosensitive layer located overlying the electroconductive substrate;

an image forming portion having two ends; and a gap forming portion located outside of each of the two ends of the image forming portion, said gap forming portion having an inside end substantially perpendicular to an axial axis of said electroconductive substrate and being configured to form a gap g between a surface of the image forming portion and a peripheral surface of a charging roller being configured to be disposed against said gap forming portion, wherein the at least one layer at the gap forming portion has a thickness greater than a thickness of the at least one layer at the image forming portion or the electroconductive substrate at the gap forming portion has a thickness greater than a thickness of the electroconductive substrate at the image forming portion, and wherein a gap t, representing a distance between one of the ends of said image forming portion and the inside end of said gap forming portion, is greater than or equal to 2 g.

60. The photoreceptor according to claim 59, wherein the at least one layer at the gap forming portion has a thickness greater than a thickness of the at least one layer at the image forming portion by 10 to 200 $\mu$m.

61. The photoreceptor according to claim 59, wherein the electroconductive substrate at the gap forming portion has a thickness greater than a thickness of the electroconductive substrate at the image forming portion by 10 to 200 $\mu$m.

62. The photoreceptor according to claim 59, wherein the photosensitive layer comprises a charge generation layer and a charge transport layer.

63. The photoreceptor according to claim 62, wherein the charge transport layer comprises a polycarbonate resin having a triarylamine group in at least one of a main chain or a side chain thereof.

64. The photoreceptor according to claim 59, wherein the photoreceptor further includes a protective layer located overlying the photosensitive layer, and wherein the protective layer comprises a filler.

65. The photoreceptor according to claim 59, wherein the photoreceptor further includes a protective layer located on the photosensitive layer, and wherein the protective layer comprises a charge transport material.

66. The photoreceptor according to claim 65, wherein the charge transport material is a charge transport polymer.

67. The photoreceptor according to claim 66, wherein the charge transport polymer comprises a polycarbonate having a triarylamine group in at least one of a main chain or a side chain thereof.

68. A photoreceptor comprising:

an electroconductive substrate;

at least one layer including a photosensitive layer located overlying the electroconductive substrate;

an image forming portion having two ends substantially parallel to the rotating direction;

a non-image portion located outside of each of the two ends of the image forming portion; and a flange provided on the non-image portion such that the flange covers the non-image portion and, when said photoreceptor is positioned against a charging roller, said flange being configured to form a gap g between a surface of the image forming portion and a peripheral surface of the charging roller, wherein a gap t, representing a distance between one of the ends of said image forming portion and an inside end of said flange, is greater than or equal to 2 g.

69. The photoreceptor according to claim 68, wherein the flange has a diameter greater than a diameter of the image forming portion of the photoreceptor by 10 to 200 $\mu$m.

70. The photoreceptor according to claim 68, wherein the photosensitive layer comprises a charge generation layer and a charge transport layer.

71. The photoreceptor according to claim 70, wherein the charge transport layer comprises a polycarbonate having a triarylamine group in at least one of a main chain or a side chain thereof.

72. The photoreceptor according to claim 68, wherein the photoreceptor further includes a protective layer located overlying the photosensitive layer, and wherein the protective layer comprises a filler.

73. The photoreceptor according to claim 68, wherein the photoreceptor further includes a protective layer located on the photosensitive layer, and wherein the protective layer comprises a charge transport material.

74. The photoreceptor according to claim 73, wherein the charge transport material is a charge transport polymer.

75. The photoreceptor according to claim 74, wherein the charge transport polymer comprises a polycarbonate having a triarylamine group in at least one of a main chain or a side chain thereof.

76. A method for manufacturing a photoreceptor comprising:

coating a coating liquid to form a photosensitive layer overlying an electroconductive substrate having two ends; end cutting the surface of a central portion of the photoreceptor so as to form a flange at both ends of said substrate and to prepare the photoreceptor such that the photoreceptor has an image forming portion having two ends substantially parallel to the two ends of electroconductive substrate, and has a non-image portion located outside of each of the two ends of image forming portion, wherein said flange is configured to form a gap g between a surface of the image forming portion and a peripheral surface of a charging roller when said photoreceptor is positioned against the charging roller, and a gap t, representing a distance between one of the ends of said image forming portion and an inside end of said flange, is greater than or equal to 2 g.

77. The method according to claim 76, wherein the photoreceptor at the non-image forming portion has a thickness greater than a thickness thereof at the image forming portion by 10 to 200 $\mu$m.

78. The method according to claim 76, wherein the coating step is performed by a spray coating method.

79. The method according to claim 76, further comprising:

coating an outermost layer coating liquid overlying the photosensitive layer to form an outermost layer overlying the photosensitive layer.

80. A method for manufacturing a photoreceptor comprising:

coating a coating liquid to form a photosensitive layer overlying an electroconductive substrate having two ends and a recessed portion at a central portion thereof, to prepare the photoreceptor such that the photoreceptor has an image forming portion having two ends substantially parallel to the two ends of electroconductive substrate, and has a non-image portion located outside of each of the two ends of image forming portion, wherein said recessed portion is configured to form a gap g between a surface of the image forming portion and a peripheral surface of a charging roller when said photoreceptor is positioned against the charging roller, and a gap t, representing a distance between one of the ends of said image forming portion and an inside end of said recessed portion, is greater than or equal to 2 g.

81. The method according to claim 80, wherein the photoreceptor at the non-image forming portion has a thickness greater than a thickness thereof at the image forming portion by 10 to 200 $\mu$m.

82. The method according to claim 80, wherein the coating step is performed by a spray coating method.

83. The method according to claim 80, further comprising:

coating an outermost layer coating liquid overlaying the photosensitive layer to for an outermost layer overlaying the photosensitive layer.

* * * * *

UNITED STATES PATENT AND TRADEMARK OFFICE

CERTIFICATE OF CORRECTION

PATENT NO. : 6,803,162 B2
APPLICATION NO. : 10/205413
DATED : October 12, 2004
INVENTOR(S) : Niimi It is certified that error appears in the above-identified patent and that said Letters Patent is hereby corrected as shown below:

On the title page, the Terminal Disclaimer information has been omitted. Item (45) and the (*) Notice should read:

**-- (45) Date of Patent: *Oct 12, 2004 --**

-- (*) Notice: Subject to any disclaimer, the term of this patent is extended or adjusted under 35 U.S.C. 154(b) by 48 days.

This patent is subject to a terminal disclaimer --

Signed and Sealed this

Twentieth Day of March, 2007

JON W. DUDAS
*Director of the United States Patent and Trademark Office*